US007004831B2

(12) United States Patent
Hino et al.

(10) Patent No.: US 7,004,831 B2
(45) Date of Patent: Feb. 28, 2006

(54) COIN SORTING APPARATUS

(75) Inventors: Yushi Hino, Himeji (JP); Masaharu Tochio, Himeji (JP); Daisuke Hoshino, Himeji (JP)

(73) Assignee: Glory Kogyo Kabushiki Kaisha, Kyogo-ken (JP)

( * ) Notice: Subject to any disclaimer, the term of this patent is extended or adjusted under 35 U.S.C. 154(b) by 0 days.

(21) Appl. No.: 10/885,029

(22) Filed: Jul. 7, 2004

(65) Prior Publication Data

US 2004/0238320 A1 Dec. 2, 2004

Related U.S. Application Data

(62) Division of application No. 10/088,413, filed as application No. PCT/JP01/08109 on Sep. 18, 2001, now Pat. No. 6,783,452.

(30) Foreign Application Priority Data

| | | |
|---|---|---|
| Sep. 18, 2000 | (JP) | 2000-281591 |
| Oct. 12, 2000 | (JP) | 2000-311616 |
| Nov. 14, 2000 | (JP) | 2000-346332 |
| Mar. 19, 2001 | (JP) | 2001-079206 |
| Mar. 19, 2001 | (JP) | 2001-079217 |
| Mar. 21, 2001 | (JP) | 2001-080687 |

(51) Int. Cl.
*G07D 3/00* (2006.01)
*G07D 3/06* (2006.01)

(52) U.S. Cl. ..... 453/5

(58) Field of Classification Search ..... 453/3, 453/5, 12, 57; 194/293, 342, 346, 347
See application file for complete search history.

(56) References Cited

U.S. PATENT DOCUMENTS

| | | | | |
|---|---|---|---|---|
| 3,174,488 | A | 3/1965 | Rau | |
| 4,383,540 | A | 5/1983 | De Meyer et al. | |
| 5,135,433 | A | 8/1992 | Watanabe | |
| 5,163,867 | A * | 11/1992 | Rasmussen | 453/10 |
| 5,197,919 | A * | 3/1993 | Geib et al. | 453/10 |
| 5,295,899 | A * | 3/1994 | Adams et al. | 453/10 |
| 5,450,919 | A | 9/1995 | Shitani | |
| 5,468,182 | A * | 11/1995 | Geib | 453/10 |
| 5,518,101 | A | 5/1996 | Simizu | |
| 5,542,880 | A * | 8/1996 | Geib et al. | 453/10 |
| 5,542,881 | A * | 8/1996 | Geib | 453/10 |
| 5,597,061 | A | 1/1997 | Nishiumi | |
| 5,865,673 | A | 2/1999 | Geib et al. | |
| 6,039,644 | A | 3/2000 | Geib et al. | |
| 6,042,470 | A | 3/2000 | Geib et al. | |
| 6,318,537 | B1 | 11/2001 | Jones et al. | |
| 6,602,125 | B1 * | 8/2003 | Martin | 453/12 |
| 6,609,604 | B1 | 8/2003 | Jones et al. | |

FOREIGN PATENT DOCUMENTS

| | | |
|---|---|---|
| JP | 62-71771 | 5/1987 |
| JP | 4-98483 | 3/1992 |

(Continued)

*Primary Examiner*—Donald P. Walsh
*Assistant Examiner*—Mark J. Beauchaine
(74) *Attorney, Agent, or Firm*—Wenderoth, Lind & Ponack, L.L.P.

(57) ABSTRACT

A coin sorting apparatus includes a stationary member and a rotary disk member arranged under the stationary member. The stationary member has a guide structure for guiding coins, and the guide structure includes a coin passage and at least one coin-sorting guide. Each coin-storing guide has a step arranged so that a peripheral portion of a coin having a diameter greater than a reference diameter runs up onto the step.

25 Claims, 30 Drawing Sheets

FOREIGN PATENT DOCUMENTS

| | | |
|---|---|---|
| JP | 5-73758 | 3/1993 |
| JP | 7-175953 | 7/1995 |
| JP | 7-200910 | 8/1995 |
| JP | 8-44925 | 2/1996 |
| JP | 8-147519 | 6/1996 |
| JP | 9-293154 | 11/1997 |

* cited by examiner

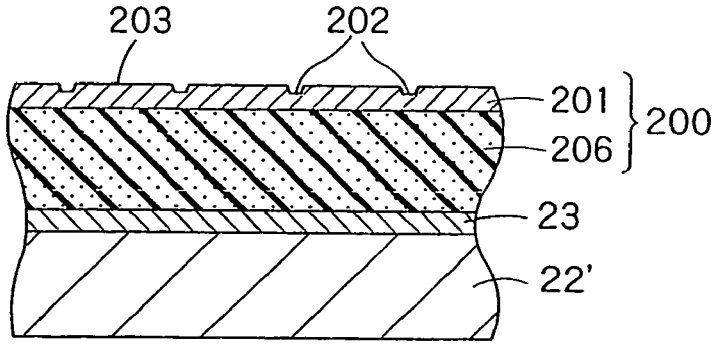
FIG. 38
FIG. 39a
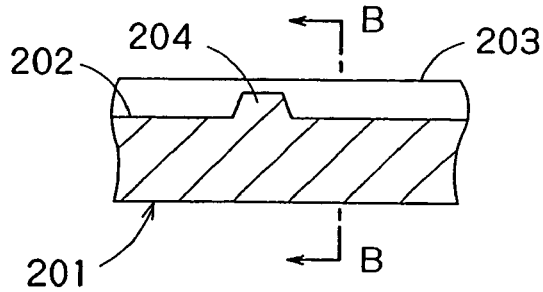
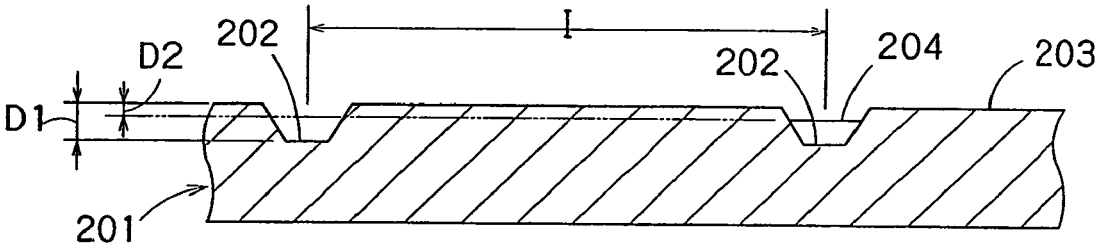
FIG. 39b
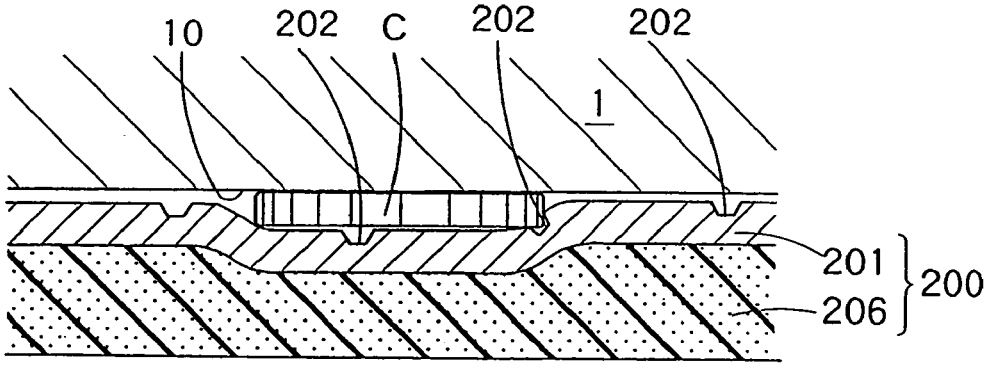
FIG. 40

Account number : 12346789

2001-03-22 10:30:23

I1 I2 I3

| Denomi | Number | Value |
|---|---|---|
| 2 EURO | 2546 | 5092.00 |
| 1 EURO | 2005 | 2005.00 |
| 0.5 EURO | 852 | 426.00 |
| 0.2 EURO | 1163 | 232.60 |
| 0.1 EURO | 385 | 38.50 |
| 0.05 EURO | 287 | 14.35 |
| 0.02 EURO | 128 | 2.56 |
| 0.01 EURO | 699 | 6.99 |

[ EURO Total value ] 7,818.00 101

| | | |
|---|---|---|
| 2 DEM | 885 | 1,770.00 |
| 1 DEM | 726 | 726.00 |
| 0.5 DEM | 237 | 118.50 |
| 0.1 DEM | 776 | 77.60 |
| 0.05 DEM | 274 | 13.70 |
| 0.02 DEM | 250 | 5.00 |
| 0.01 DEM | 120 | 1.20 |

[ DEM Total value ] 2,712.00 102

[ Convert into EURO ] 5,304.00 103

[ Amount Total value ] 13,122.00 104

FIG. 44

COIN SORTING APPARATUS

This is a Divisional Application of U.S. application Ser. No. 10/088,413 filed Mar. 20, 2002 now U.S. Pat. No. 6,783,452, which was the National Stage of International Application No. PCT/JP01/08109, filed Sep. 18, 2001.

TECHNICAL FIELD

The present invention relates to a coin sorting apparatus for sorting coins of mixed denominations, and a coin receiving system provided with such a coin sorting apparatus.

BACKGROUND ART

Generally, a conventional coin sorting apparatus included in a coin receiving system is provided with a single coin sorting unit that sorts coins of mixed denominations sequentially by denomination.

The coin sorting unit of the conventional coin sorting apparatus, in general, conveys coins successively in a horizontal direction along a coin passage, sorts the coins by diameter, and drops coins of different denominations through sorting holes of sizes respectively corresponding to denominations. Generally, a coin feed unit for feeding coins one by one into the coin passage is so constructed as to push coins one by one from a rotating feed disk through a thickness-limiting plate into the coin passage.

This conventional coin sorting apparatus has the following problems. The numbers of diameter and thickness classes of coins to be sorted increase when the denominations of coins to be sorted increases and, in some cases, it is difficult for the conventional coin sorting apparatus to sort coins of a large number of mixed denominations by a single coin sorting unit. Even if the coin sorting apparatus could sort those coins, only limited sorting methods are feasible by the coin sorting unit.

As regards Euro coins, in particular, there are Euro coins of eight denominations and the countries associated with Euro coins are in the process of currency unification for unifying their traditional currency systems into the common Euro currency system. Thus both the coins of the currency systems of those countries and Euro coins are used. The foregoing problem in the conventional coin sorting apparatus becomes more serious when those coins of such a large variety of denominations must be sorted.

FIG. 45 shows the lower surface 401*b* of a stationary disk 401 included in a prior art rotary disk type coin sorting apparatus disclosed in JP-A-63-250793 (1988) in a schematic plan view. The coin sorting apparatus is provided with a rotary disk, not shown, disposed under the lower surface 401*b* of the stationary disk 401, having a resilient upper surface and capable of rotation. The stationary disk 401 is provided with a central coin-feed opening 401*a*. Coins C fed into the coin-feed opening 401*a* slide along the lower surface 401*b* of the stationary disk 401 as the rotary disk rotates.

The stationary disk 401 guides and sorts the coins C by diameter as the coins C slide along the lower surface 401*b* thereof. More specifically, a coin guide passage 410 is formed in the lower surface 401*b* of the stationary disk 401 so as to face the coin-feed opening 401*a*. The coin guide passage 410 has a coin guide section 411 for guiding coins C fed into the coin-feed opening 401*a*, and a land 413 for separating superposed coins C.

A coin arranging part 402 is formed contiguously with the coin guide passage 410. Coins Care moved radalaly outward by centrifugal force acting thereon and their edges engage the outer edge 404 of the coin arranging part 402, whereby the coins C are arranged sequentially. As the rotary disk rotates, the coins C thus arranged by the coin arranging part 402 are held resiliently between the lower surface 401*b* of the stationary disk 401 and the resilient upper surface of the rotary disk and are moved along and inside a geometric circular guide line 406.

FIG. 45 shows an arrangement for sorting coins of three denominations, i.e., large coins C1 having a big diameter, medium coins C2 having a medium diameter and small coins C3 having a small diameter, by way of example. A small coin guide groove 415*a*, a medium coin guide groove 415*b* and a large coin guide groove 415*c* are arranged in that order along the guide line 406 from the upstream side downward. The guide grooves 415*a*, 415*b* and 415*c* selectively guide only small coins C3, medium coins C2 and large coins C1, respectively, so as to eject respective coins outside the stationary disk 401.

More concretely, the small coin guide groove 415*a* permits only small coins C3 among coins moving along the guide line 406 to enter therein, guides small coins C3 outward by the radial inner edge 416*a* so that small coins C3 are ejected from the stationary disk 401, and does not permit large coins C1 and middle coins C2 to enter therein. The medium coin guide groove 415*b* permits only medium coins C2 to enter therein, guides medium coins C2 outward by the radial inner edge 416*b* so that medium coins C2 are ejected from the stationary disk 401, and does not permit large coins C1 to enter therein. The large coin guide groove 415*c* permits large coins C1 passed by the guide grooves 415*a* and 415*b* to enter therein and guides large coins C1 outward by the radial inner edge 416*c* so that small coins C3 are ejected from the stationary disk 401.

This prior art coin sorting apparatus has the following problems. Since coins C are arranged in succession along the guide line 406 by the coin arranging part 402 by the agency of centrifugal force acting on coins C, the rotary disk needs to be at a comparatively high rotating speed. Consequently, the degree of freedom for determining the rotating speed of the rotary disk, i.e., sorting speed, is reduced.

When the coin sorting apparatus is jammed with coins, it is advantageous if the sorting process can be continued by rotating the rotary disk in the normal direction after temporarily reversing the rotary disk. However, coins which have been moved outside the guide line 406 by the respective radial inner edges 416*a* to 416*c* of the coin guide grooves 415*a* to 415*c* cannot be moved back to their initial positions inside the guide line 406 even if the rotary disk is reversed. Thus, the coin sorting apparatus is unable to resume its sorting operation normally even if the rotary disk is rotated in the normal direction after temporarily reversing the rotary disk.

There have been proposed coin sorting apparatuses, including the foregoing prior art coin sorting apparatus, which sort coins sliding along the lower surface of a stationary disk by diameter. In those prior art coin sorting apparatus, coins held between a resilient member attached to the upper surface of a rotary disk and a stationary disk are moved in the rotating direction of the rotary disk. Coins moved in the rotating direction of the rotary disk slide relative to the lower surface of the stationary member, are sorted by diameter, and sorted coins are ejected outside from the stationary disk. Thus the coins are moved spirally along the lower surface of the stationary disk.

Those coin sorting apparatuses have the following problems. The surface of the resilient member is coated with a synthetic rubber having a comparatively low corrosion resistance, such as butyl rubber. The resilient member is abraded comparatively rapidly and the coin conveying ability of the resilient member is reduced in a comparatively short time, so that it is difficult for the coin sorting apparatuses to maintain ability to carry out a reliable coin sorting operation for a long period of time.

The surface of the resilient member is flat and smooth and has an isotropic coin holding ability. Therefore, a force exerted on coins by the resilient member to restrain coins from radial movement increases excessively if the moving ability of the resilient member to move coins in the rotating direction of the rotary disk is increased. Such contradictory conditions are a serious obstacle to the enhancement of the reliability of the coin sorting operation.

A prior art coin sorting apparatus disclosed in Japanese Patent No. 2557278 shown in FIGS. 46 and 47 has a guide structure 513 for guiding coins C, defining a substantially horizontal passage, and a conveyor belt 514 for conveying coins C along the guide structure 513. A coin feed unit 9 is disposed near an inlet end of the guide structure 513. The coin feed unit 9 is provided with a feed disk 90 for feeding coins C one by one onto the guide structure 513.

The guide structure 513 is provided in its middle part with an ejecting hole 511. A rotary member 510 is disposed under the ejecting hole 511. As shown in FIG. 46, an identification unit 516 is disposed on the upstream side of the ejecting hole 511 of the guide structure 513 to identify coins. A coin sensor 517 for detecting a coin C is disposed in a section between the identification unit 516 and the ejecting hole 511 of the passage.

As shown in FIG. 47, the rotary member 510 is supported for turning about an axis parallel to the carrying surface of the passage and perpendicular to a coin conveying direction in which coins C are conveyed. The rotary member 510 has a flat part 510A having a flat surface parallel to the axis of the rotary member 510 and a cylindrical part 510B having a cylindrical surface whose axis coincides with the axis of the rotary member 510. A pressure roller 515 is disposed at a position corresponding to the ejecting hole 511 in contact with the upper side of the conveyor belt 514 to press a coin C down.

The rotary member 510 can be turned by a rotary solenoid actuator R shown in FIG. 46 between a coin-passing position to support a coin C to enable the coin C to move past the ejecting hole 511, at which the cylindrical part 510B faces the ejecting hole 511 as shown in FIG. 47(*a*), and a coin-ejecting position to eject a coin C through the ejecting hole 511, at which the flat part 510A faces the ejecting hole 511 as shown in FIG. 47(*b*). FIG. 47(*c*) shows the rotary member 510 at a transient position through which the rotary member 510 is returned from the coin-ejecting position shown in FIG. 47(*b*) to the coin-passing position shown in FIG. 47(*a*). When the rotary member 510 is set at the coin-ejecting position shown in FIG. 47(*b*), the flat surface of the flat part 510A declines downstream relative to the passage of the guide structure 513.

This prior art coin sorting apparatus operates as follows.

(1) A coin C being conveyed through the guide structure 513 by the conveyor belt 514 is supported by the cylindrical part 510B of the rotary member 510 as the same moves over the ejecting hole 511 and is conveyed past the ejecting hole 511 when the rotary member 510 is set at the coin-passing position shown in FIG. 47(*a*).

(2) A coin C being conveyed through the guide structure 513 by the conveyor belt 514 drops into the ejecting hole 511, slides down along the flat surface of the flat part 510A and is ejected when the rotary member 510 is at the coin-ejecting position shown in FIG. 47(*b*).

This coin sorting apparatus has the following problems. When the rotary member 510 is set at the coin-passing position shown in FIG. 47(*a*), a leading part of a coin C moving over the rotary member 510 moves over the edge of the ejecting hole 511 onto the passage, and then the coin C is partly held between the surface of the passage and the conveyor belt 514. If the rotary member 510 is turned toward the coin-ejecting position in this state, a part of the cylindrical part 510B supporting a back part of the coin C moves toward the upstream side of the guide structure 513 as shown in FIG. 47(*b*).

Accordingly, if the timing of turning the rotary member 510 from the coin-passing position toward the coin-ejecting position is advanced excessively, the preceding coin C cannot be successfully conveyed past the ejecting hole 511. This restriction on the timing of turning the rotary member 510 from the coin-passing position toward the coin-ejecting position is an obstacle to the enhancement of the sorting speed of the coin sorting process.

In addition, the coin moving straight in the conveying direction is passed over or dropped into the ejecting hole 511 along the same direction in a plane view. Thus, the difference between the diameter of the smallest coin C that can pass over the ejecting hole 511 with the rotary member 510 set at the coin-passing position (FIG. 47(*a*)) and the diameter of the largest coin C capable of dropping through the ejecting hole 511 with the rotary member 510 set at the coin-ejecting position (FIG. 47(*b*)) should not be very large. That is, the prior art coin sorting apparatus is capable of sorting only coins having different diameters in a narrow range.

All the conventional coin receiving systems are capable of accepting only coins of the same specific currency unit, such as yen or dollar, and reject all the coins of other currency units. There are some coin receiving systems that convert the amount of money of a first currency unit (e.g. yen) into the corresponding amount of money of a second currency unit (e.g. dollar) and perform a money receiving procedure, which also is capable of accepting only coins of the same currency unit.

However, for example, the countries of the EU are in the process of currency unification for changing their old (traditional) currency units into the new currency unit "Euro". Therefore it is very convenient if both the coins of the old currency unit and the new currency unit can be accepted and a sum total amount of money in the new currency unit can be used for a money receiving procedure.

DISCLOSURE OF THE INVENTION

Accordingly, it is an object of the present invention to provide a coin sorting apparatus capable of sorting coins of many denominations with high reliability and of greatly increasing the degree of freedom of selection of sorting method for a sorting unit, and a coin receiving system provided with such a coin sorting apparatus.

Another object of the present invention is to provide a coin sorting apparatus provided with a rotary disk and having a high degree of freedom for setting the rotating speed of the rotary disk, and capable of continuing a normal sorting operation even if the rotation of the rotary disk in a normal direction is resumed after temporarily reversing the rotary disk.

Another object of the present invention is to provide a coin sorting apparatus capable of maintaining a reliable coin sorting operation for an extended period of time.

Another object of the present invention is to provide a coin sorting apparatus capable of sorting coins at a sorting speed higher than that at which conventional coin sorting apparatuses sort coins, and of sorting coins of diameters in a range wider than that of diameters of coins that can be sorted by conventional coin sorting apparatuses.

Another object of the present invention is to provide a coin receiving system provided with a coin sorting apparatus and capable of accepting coins of both an old currency unit and a new currency unit, and of receiving the amount of money represented by those coins of different currency units in the sum total amount of money in the new currency unit.

According to a first aspect of the present invention, there is provided a coin sorting apparatus for sorting coins of at least three denominations, comprising presorting means for broadly sorting the coins by size into those of at least two groups and main sorting means for sorting by denomination the coins of the respective groups sorted by the presorting means.

In the coin sorting apparatus, main sorting means sort the coins of respective groups broadly sorted by the presorting means, so that the number of denominations of coins to be dealt with by a single sorting operation can be reduced. Thus, coins of many denominations can be surely sorted and the degree of freedom of selection of a sorting method by which the main sorting means sort coins can be greatly increased. Accordingly, coins of denominations which are difficult to sort by a single coin sorting means, such as Euro coins, can be surely and smoothly sorted by a general coins sorting means.

In the coin sorting apparatus, the presorting means may include a stationary member provided with a central coin-feed opening, and a rotary disk supported for rotation and disposed under the stationary member closely adjacent to the lower surface of the stationary member. The presorting means may be constructed such that coins fed into the coin-feed opening of the stationary member slide along the lower surface of the stationary member as the rotary disk rotates. The stationary member may be provided with guide structures for selectively guiding the respective groups of coins sliding along the lower surface thereof. Thus, coins fed into the coin-feed opening of the stationary member slide along the lower surface of the stationary member and are selectively guided by guide structures to sort the coins into the groups, as the rotary disk rotates.

In the coin sorting apparatus, the main sorting means may include a guide passage for substantially horizontally guiding coins to be sorted, one by one. A conveying means conveys the coins along the guide passage and a plurality of sorting units, each for sorting out coins of one of the denominations, are arranged at intervals along the guide passage. The main sorting means conveys the coins to be sorted along the guide passage by the conveying means, and the sorting units sort out the coins of the corresponding denominations, respectively. The number of denominations to be sorted by the main sorting means is reduced to reduce the number of the sorting units and hence the length of the guide passage may be short. Thus, the coin sorting apparatus can be formed in a small size.

According to a second aspect of the present invention, there is provided a coin receiving system for sorting coins of at least three denominations and executing a money receiving management for the coins. The coin receiving system comprises presorting means for broadly sorting the coins by size into those of at least two groups. A coin identifying means identifies the coins of each of the groups formed by broadly sorting the coins by the presorting means. A rejecting means rejects coins that could not be identified by the coin identifying means. A main sorting means sorts, by denomination, the coins of the respective groups identified by the coin identifying means, and money receiving means counts the amount of money represented by the coins identified by the coin identifying means to receive the money.

The coin receiving system can sort coins similarly to the foregoing coin sorting apparatus, and receive money represented by the sorted coins.

Preferably, the coin receiving system further includes different coin sorting means for sorting out different coins that have been identified as coins of different denominations from those of coins capable of being sorted by the main sorting means by the coin identifying means. The different coins are sorted out by the different coin sorting means so that the main sorting means can sort coins more smoothly.

Preferably, the coin identifying means is adapted to identify the different coins, and the money receiving means is adapted to receive the coins to be sorted by the main sorting means and the different coins to be sorted by the different coin sorting means. Thus, the coin receiving system is capable of receiving money represented by the coins including the different coins.

According to a third aspect of the present invention, there is provided a coin sorting apparatus comprising a stationary member provided with a central coin-feed opening and a rotary disk supported for rotation disposed under the stationary member and closely adjacent to the lower surface of the stationary member. The coin sorting apparatus is constructed such that coins fed into the coin-feed opening of the stationary member slide along the lower surface of the stationary member as the rotary disk rotates. The stationary member is provided with guide structures for selectively guiding coins sliding along the lower surface thereof, according to the diameters of the coins, and the guide structures have a coin passage formed in the lower surface of the stationary member and having a radial inner edge portion configured to engage outer edges of all the coins, and at least one coin-sorting guide. The coin-sorting guide has a step formed such that a peripheral part of each of coins having diameters greater than a reference diameter runs up onto the step, with the outer edge thereof engaging the radial inner edge portion of the coin passage. An ejecting passage guides the coin that has run up onto the step and ejects the same coin outside the stationary member.

In this coin sorting apparatus, coins fed into the coin-feed opening slide along the lower surface of the stationary member as the rotary disk rotates and are selectively guided by the guide structures according to their diameters. Although the outer edges of all the coins engage the radial inner edge portion of the coin passage, only the coins having diameters greater than the predetermined reference diameter run up onto the step of the coin-sorting guide. The coins that have run up onto the step are moved along the ejecting passage and are ejected outside the stationary member. The rest of the coins that do not run up onto the step are moved further forward along the coin passage.

Thus, the coin-sorting guide sorts the coins by diameter. When two or more coin-sorting guides are used for sorting coins of at least three denominations, coins respectively having larger diameters are sorted out before those respectively having smaller diameters.

Since this coin sorting apparatus guides coins so that the outer edges of the coins engage the radial inner edge portion of the coin passage and sorts the coins by diameter, the sorting operation does not depend on centrifugal force.

In the coin sorting apparatus, it is preferable that the coin passage has radial inner and outer edges configured to engage outer edges of coins moving along the coin passage. The coin passage is configured to curve such that an upstream section thereof on the upstream side of the step extends away from a center of the stationary member. A downstream section thereof on the downstream side of the step extends to approach the center of the stationary member toward the downstream side. In this description, the terms "upstream" and "downstream" are used for signifying directional and positional attributes with respect to a direction in which coins are moved when the rotary disk is rotated in the normal direction.

A range of movement of coins on the coin passage is limited by the radial inner and outer edges of the coin passage. Since the upstream section of the coin passage is curved so as to extend away from the center of the stationary member, the radial inner edge of the upstream section of the coin passage pushes coins toward the periphery of the stationary member as the rotary disk is rotated in the normal direction so that the coins engage with radial inner edge portion thereof. The downstream section of the coin passage extends to approach the center of the stationary member toward the downstream side. Therefore, when the rotary disk is rotated in the reverse direction, the radial inner edge portion of the downstream section (upstream section when the rotary disk is reversed) is able to come into engagement with the outer edges of coins and to push coins toward the periphery of the stationary member. Therefore, it is insured that the outer edge of the coin, at a position corresponding to the step, is in contact with the radial inner edge portion of the coin passage when the rotation of the rotary disk is resumed after the rotary disk has been temporarily reversed. Thus, the coin sorting apparatus is able to continue the normal coin sorting operation when the rotation of the rotary disk in the normal direction is resumed after temporarily reversing the rotary disk.

Preferably, a pressing means for pressing the coins toward the radial inner edge of the coin passage is disposed in the upstream section of the coin passage on the upstream side of the step. The pressing means presses coins toward the radial inner edge portion of the upstream section of the coin passage on the upstream side of the land to insure that the outer edges of all the coins are brought into contact with the radial inner edge portion of the coin passage.

Preferably, the guide structures of the stationary member are constructed so that the coin that has run up onto the step lies in a substantially horizontal position. Thus the coin is prevented from being caught in the coin passage due to tilting and can be smoothly ejected.

Preferably, the guide structures of the stationary member include a step-forming plate forming the step and are movable along a width of the coin passage for positional adjustment. Thus the width of a section of the coin passage corresponding to the step can be adjusted according to the diameters of coins to be sorted. The width of the coin passage can be finely adjusted to improve the accuracy and smoothness of the coin sorting process.

Preferably, a foreign matter sorting means is disposed in the downstream section of the coin passage for selectively guiding a foreign matter having a thickness smaller than that of the thinnest coin so that the foreign matter is ejected outside the stationary member. Thus the foreign matters having a thickness smaller than those of the coins can be separated from the coins and can be ejected outside the stationary member, and the foreign matters and the coins can be separately collected.

Preferably, the foreign matter sorting means has a foreign matter passage formed in the stationary member and branching away from the coin passage to an outside of the stationary member. A gate portion is formed at a junction of the coin passage and the foreign matter passage, together with the rotary disk defining a gap of such a size as allows the foreign matter to pass, but not the thinnest coin. Whereas coins are unable to pass the gate portion at the junction of the coin passage and the foreign matter passage and move along the coin passage, foreign matters pass the gate into the foreign matter passage. Thus foreign matters are separated from coins.

According to a fourth aspect of the present invention, there is provided a coin sorting apparatus comprising a stationary member provided with a central coin-feed opening. A rotary disk is supported for rotation, disposed under the stationary member closely adjacent to the lower surface of the stationary member, and has a disk body and a resilient member attached to an upper surface of the disk body. The coin sorting apparatus is constructed such that coins fed into the coin-feed opening of the stationary member slide along the lower surface of the stationary member as the rotary disk rotates. The stationary member is provided with guide structures for selectively guiding coins sliding along the lower surface thereof, according to their diameters, and the resilient member of the rotary disk has a urethane rubber layer having a surface provided with a plurality of radial grooves.

In this coin sorting apparatus, coins fed into the coin-feed opening of the stationary member slide along the lower surface of the stationary member as the rotary disk rotates. The guide structures guide the coins selectively according to their diameters to sort the coins by diameter.

The urethane rubber layer is capable of improving the abrasion resistance of the resilient member of the rotary disk more effectively than layers of other synthetic rubbers. The plurality of radial grooves formed in the surface of the urethane rubber layer engage the outer edges of coins to enhance the conveying force that can be exerted on coins in the direction of rotation of the rotary disk without increasing the holding force that restrains coins from radial movement. Since the urethane rubber layer having the surface provided with the plurality of radial grooves are subject to deformation, coins respectively having different thicknesses and arranged side by side can be surely held between the stationary member and the rotary disk. Thus the coin sorting apparatus is capable of maintaining a reliable coin sorting operation for a long period of time.

Preferably, circumferential intervals between the radial grooves at the periphery of the resilient member are smaller than a diameter of the smallest coin. Even in a state where small coins lie successively in a circumferential direction on the rotary disk, all the small coins are necessarily on the radial grooves, respectively, so that the radial grooves are able to exercise the foregoing effect thereof at all times.

Preferably, the urethane rubber layer of the resilient member is formed of a thermoplastic urethane rubber. The urethane rubber layer provided with the radial grooves of the thermoplastic urethane rubber can be easily formed by injection molding.

Preferably, the resilient member has a porous resilient layer underlying the urethane rubber layer. Thus the resilient member is highly compressible and is capable of flexibly dealing with coins respectively having different thicknesses.

Preferably, the porous resilient layer is formed of rubber sponge. The resilient member including the porous resilient layer of rubber sponge having particularly high resilience is capable of surely holding adjacently arranged coins respectively having different thicknesses.

Preferably, a part of at least one of the radial grooves of the urethane rubber layer is configured to have a depth shallower than other parts of the same groove so as to serve as an indicator. As the urethane rubber layer is abraded gradually, the bottom surface of the part serving as the indicator first becomes flush with the upper surface of the abraded urethane rubber layer so as to notify the abrasion of the urethane rubber layer or to provide information for deciding the time for replacing the resilient member with a new one.

Preferably, a metal plate, detachable from the disk body, is fixed to the lower surface of the resilient member. The metal plate, detachable from the disk body, facilitates work for replacing the resilient member with a new one.

According to a fifth aspect of the present invention, there is provided a coin sorting apparatus comprising a passage member having a substantially horizontal passage surface and provided with an ejecting hole. A guide member extends on the passage surface of the passage member to guide coins along the passage surface from the upstream side toward the downstream side of the passage member. A conveyor belt extends so as to hold coins together with the passage surface of the passage member to convey coins along the guide member from an upstream side toward a downstream side of the passage member. A support roller is disposed under the ejecting hole opposite to the conveyor belt. The ejecting hole of the passage member is contiguous with the guide member and has a guiding side wall extending obliquely away from the guide member toward the downstream side of the passage member. The support roller is adapted to be turned between a coin-passing position where the upper end thereof is at a level not lower than that of the upper edge of the guiding side wall, and a coin-ejecting position where the upper end thereof is at a level lower than that of the upper edge of the guiding side wall.

The coin sorting apparatus in the fifth aspect of the present invention has the following features.

(i) When the support roller is at the coin-passing position, a coin guided for movement along the passage surface by the guide member and conveyed by the conveyor belt is held between the support roller and the conveyor belt in a range corresponding to the ejecting hole and does not drop into the ejecting hole and passes the ejecting hole.

(ii) When the support roller is at the coin-ejecting position, a coin guided for movement along the passage surface by the guide member and conveyed by the conveyor belt drops through the ejecting hole from its front end onto the support roller, and the outer edge of the coin engages the guiding side wall. The guiding side wall guides the coin so as to move laterally away from the guide member toward the downstream side of the passage surface. Consequently, the coin moves obliquely laterally away from the support roller and drops through the ejecting hole.

Thus, the coin is moved obliquely laterally on the support roller into the ejecting hole and to drop from the support roller, instead of being moved and dropped straight in a conveying direction along the support roller. Thus the coin to be ejected can be quickly moved away from the support roller to advance the timing of returning the support roller to the support position.

A coin passing over the support roller located at the support position is held between the passage surface and the conveyor belt when a part on the side of the guide member of the coin runs onto the passage surface after passing the guiding side edge of the ejecting hole. Even if the support roller is turned from the coin-passing position to the coin-ejecting position in this state, the coin does not drop into the ejecting hole and passes the ejecting hole, and the succeeding coin drops into the ejecting hole.

Thus, coins can be sorted with reliability even if the timing of turning the support roller from the coin-passing position to the coin-ejecting position and that of turning the support roller from the coin-ejecting position to the coin-passing position are advanced. Consequently, the coin sorting apparatus is capable of operating at a sorting speed higher than that at which conventional coin sorting apparatuses operate.

Since a coin moving in the conveying direction is made to pass the ejecting hole straight or is made to drop obliquely laterally into the ejecting hole, the difference between the diameter of the largest coin that is able to drop into the ejecting hole when the support roller is set at the coin-ejecting position and that of the smallest coin that can pass over the ejecting hole when the support roller is set at the coin-passing position can be greater than that in conventional coin sorting apparatuses. Therefore, the coin sorting apparatus in the fifth aspect of the invention is capable of sorting coins having diameters in a range wider than that of diameters of coins that can be sorted by conventional coin sorting apparatuses.

The support roller may include a support shaft supported for rotation substantially in parallel to the passage surface and substantially perpendicularly to a conveying direction in which coins are conveyed. An eccentric member is eccentrically mounted on the support shaft to have a major-radius section and a minor-radius section, and a free roller member is mounted for free rotation on the circumference of the eccentric member. The support shaft of the support roller is turned so that the major-radius section faces up to set the support roller at the coin-passing position, where the free roller member is at an up position, and is turned so that the minor-radius section faces up to set the support roller at the coin-ejecting position, where the free roller member is at a down position.

The coin sorting apparatus may further include a coin identifying means for identifying coins disposed in a position corresponding to the upstream side of the ejecting hole of the passage member. A controller changes the position of the support roller between the coin-passing position and the coin-ejecting position, depending on the result of identification by the coin identifying means. Thus the working position of the support roller is determined selectively on the basis of the result of an identification of the coin identifying means either to pass the coin examined by the coin identifying means or to eject the same coin.

Preferably, the coin sorting apparatus further includes a pressure roller adapted to press the coin through the conveyor belt against the support roller to hold the coin between the conveyor belt and the support roller. The coin can be firmly held between the conveyor belt and the support roller when the pressure roller exerts pressure on the conveyor belt.

According to a sixth aspect of the present invention, there is provided a coin receiving system comprising coin feed means for feeding mixed coins including new coins of a new currency unit and old coins of an old currency unit one by one. A coin identifying means identifies the coins fed by the coin feed means by denomination. A new coin holding unit temporarily holds the new coins. An old coin holding unit temporarily holds old coins. A sorting means sorts the new coins from the old coins and delivers the new coins to the new coin holding unit and the old coins to the old coin holding unit.

A new coin storing unit stores the new coins received from the new coin holding unit. An old coin storing unit stores the old coins received from the old coin holding unit. A counting means counts a total amount of money in the new currency unit and a total amount of money in the old currency unit on the basis of results of identification by the coin identifying means. Arithmetic means converts the total amount of money in the old currency unit into a converted amount of money as a corresponding total amount of money in the new currency unit by using a predetermined exchange rate, and calculates a sum total amount of money in the new currency unit by adding the total amount of money in the new currency unit and the converted amount of money together. A display means displays information of the total amount of money in the new currency unit, the total amount of money in the old currency unit, the converted amount of money, and the sum total amount of money in the new currency unit. Accepting-instruction means gives an accepting instruction to receive money according to the information displayed by the display means. Money receiving means stores the new and old coins that have been temporarily reserved in the new and old coin holding units, and in the new and old coin storing units, respectively, in response to the accepting instruction provided by the accepting-instruction means, and receives money for the sum total amount of money in the new currency unit.

The coin receiving system is capable of dealing with coins of both the new currency unit and the old currency unit, and of receiving money for the "sum total amount of money in the new currency unit" represented by those coins of both currency units. Since the display means displays the total amount of money in the new currency unit, the converted amount of money, and the sum total amount of money in the new currency unit, the money receiving procedure can be executed in response to the accepting instruction after precisely confirming those amounts of money displayed by the display means.

Preferably, the coin receiving system further includes printing-instruction means for providing an accepting instruction for the accepting-instruction means, and providing a printing instruction. A printing means prints out at least part of the information displayed by the display means in response to the printing instruction provided by the printing-instruction means. The printing instruction means provides the accepting instruction and the printing instruction to accomplish the money receiving procedure, and the contents of the money receiving procedure can be printed for recording.

Preferably, the sorting means is adapted to sort the new coins by denomination and sort out the old coins regardless of denomination. The new coin holding unit and the new coin storing unit have divisions respectively for holding temporarily and storing the new coins sorted by denomination, and the old coin holding unit and the old coin storing unit are adapted to temporarily reserve and store the old coins of mixed denominations. Thus, new coins to be reused can be collected in individual denominations, and old coins not to be reused and to be disposed of are collected in mixed denominations to achieve efficient coin recovery.

BRIEF DESCRIPTION OF THE DRAWINGS

FIG. 38 is a fragmentary sectional view of the rotary disk shown in FIG. 37, taken along a line perpendicular to radial grooves;

FIG. 39*a* is an enlarged longitudinal sectional view of a radial groove formed in a urethane rubber layer of the rotary disk shown in FIG. 37 and provided with a wear indicator;

FIG. 39*b* is a sectional view of the urethane rubber layer taken on line B—B in FIG. 39*a;*

FIG. 40 is a sectional view in a plane perpendicular to the radial groove of the rotary disk in a state where a coin is held between a resilient member included in the rotary disk and a stationary disk;

FIG. 44 is a view of a transaction sheet printed and issued by a printing unit included in the coin receiving system shown in FIG. 41;

BEST MODE FOR CARRYING OUT THE INVENTION

First to third embodiments of the present invention will be described with reference to the accompanying drawings.

First Embodiment

The general construction of the first embodiment, the respective constructions of component units, and operations, functions and effects of the first embodiment will be described in that order with reference to FIGS. 1 to 12*b*.

[General Construction]

Figure 1:
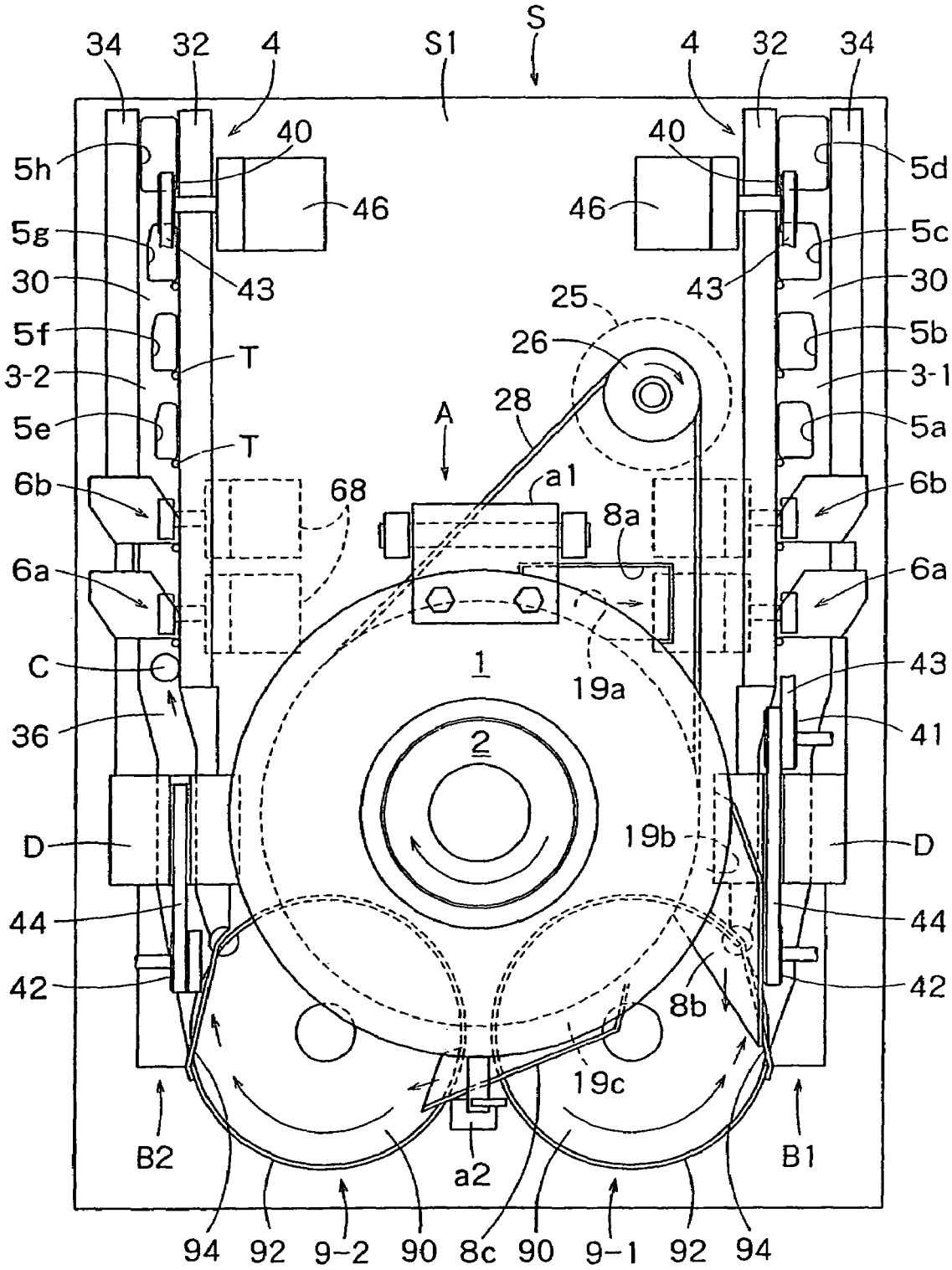
FIG. 1 is a plan view of a coin sorting apparatus in a first embodiment according to the present invention.

A coin receiving system in this embodiment is provided with a coin sorting apparatus s shown in FIG. 1 to sort coins of mixed denominations by denomination. The coin sorting apparatus S includes a presorting unit or mechanism (presorting means) A for sorting coins into three groups, and two main sorting lines or units (main sorting means) B1 and B2 for sorting coins of the two groups by denomination, respectively.

The coin receiving system in this embodiment is intended to deal with coins of mixed currency units including Euro coins of eight denominations, and "different coins", such as old coins, i.e., old-denomination coins, to be replaced with Euro coins. Euro coins are those of eight denominations that can be classified by diameter into two groups. In the following description, a currency unit, "cent Euro" will be referred simply as "cent".

(1) Group of medium coins respectively having medium diameters: Coins of four denominations in order of increasing diameter: 20 cent, 1 Euro, 50 cent and 2 Euro (2) Group of small coins respectively having small diameters: Coins of four denominations in order of increasing diameter: 1 cent, 2 cent, 10 cent and 5 cent The different coins, such as old coins, include large coins having diameters greater than that of 2 Euro coins and belonging to a large coin group to be broadly sorted from the other groups. The different coins also include small and medium coins having diameters corresponding to those of coins of the medium coin group and the small coin group.

Figure 2:
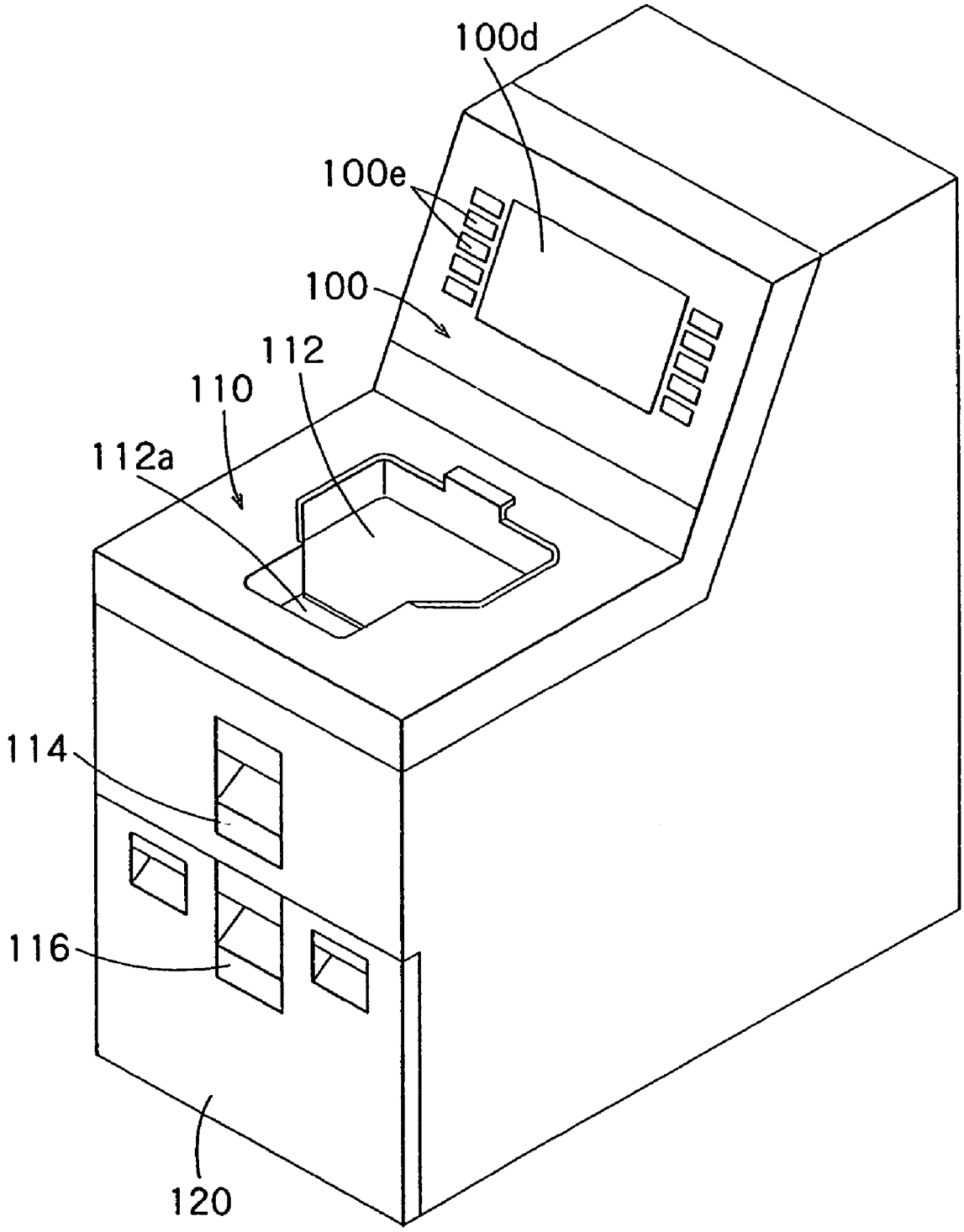
FIG. 2 is a perspective view of a coin receiving system employing the coin sorting apparatus shown in FIG. 1.
Figure 3:
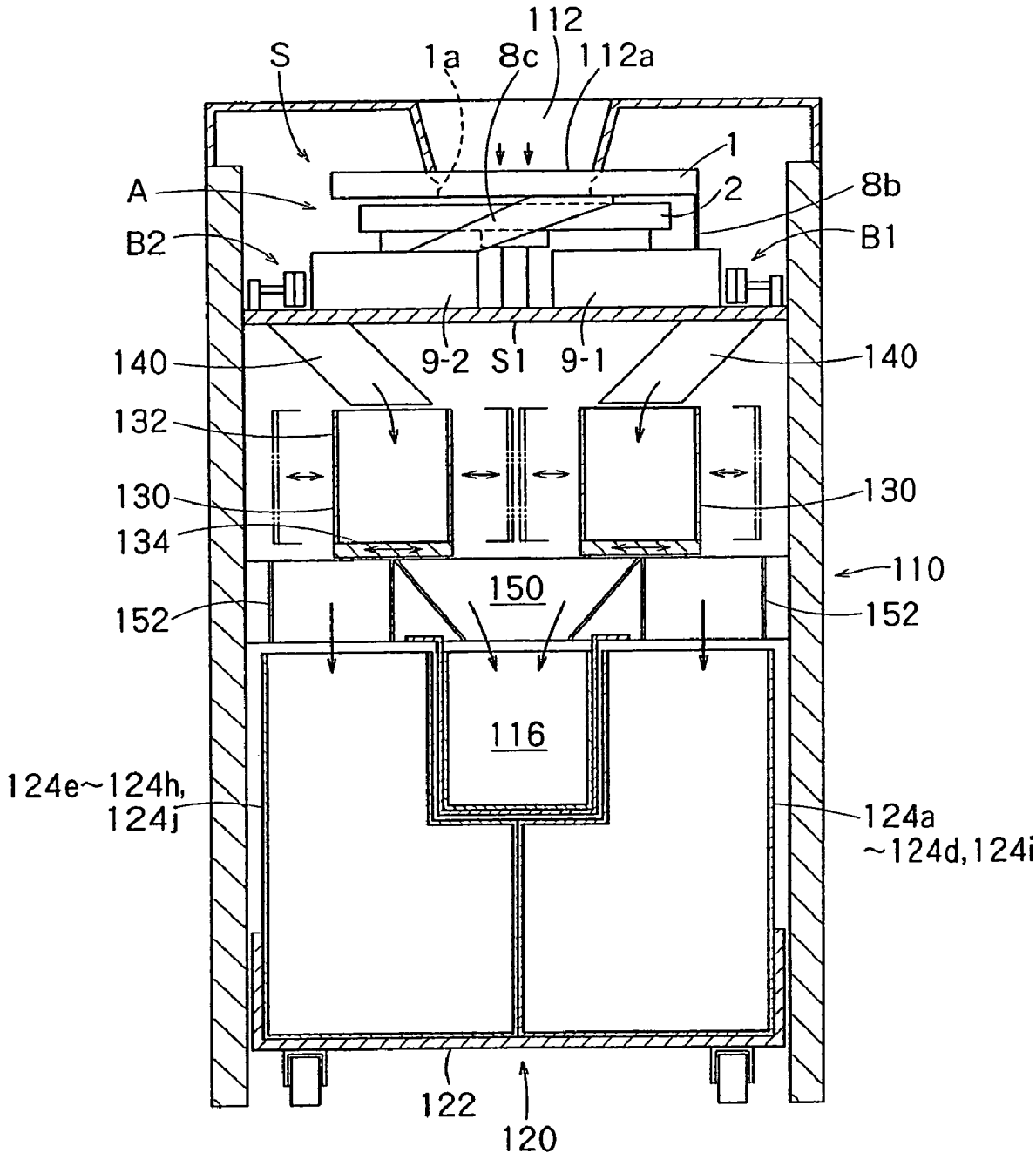
FIG. 3 is a sectional view in a plane parallel to the front of the coin receiving system shown in FIG. 2, showing a processing unit included in the coin receiving system shown in FIG. 2.

The coin sorting apparatus S is included in a coin processing unit 110 as shown in FIG. 3 included in the coin receiving system shown in FIG. 2. An information processing unit 100 is disposed behind the coin processing unit 110 and projects upward to a level above that of the upper surface of the coin processing unit 110. A display 100*d* for displaying necessary information and an operating unit 100*e* provided with a plurality of operating buttons and such are placed on the front wall of the information processing unit 100. A hopper 112 for feeding coins to be sorted is placed on the top wall of the coin processing unit 100. A coin-feed opening 112*a* through which coins drop from the hopper 112 into the coin processing unit 110 is formed in a front part of the bottom of the hopper 112.

Figure 4:
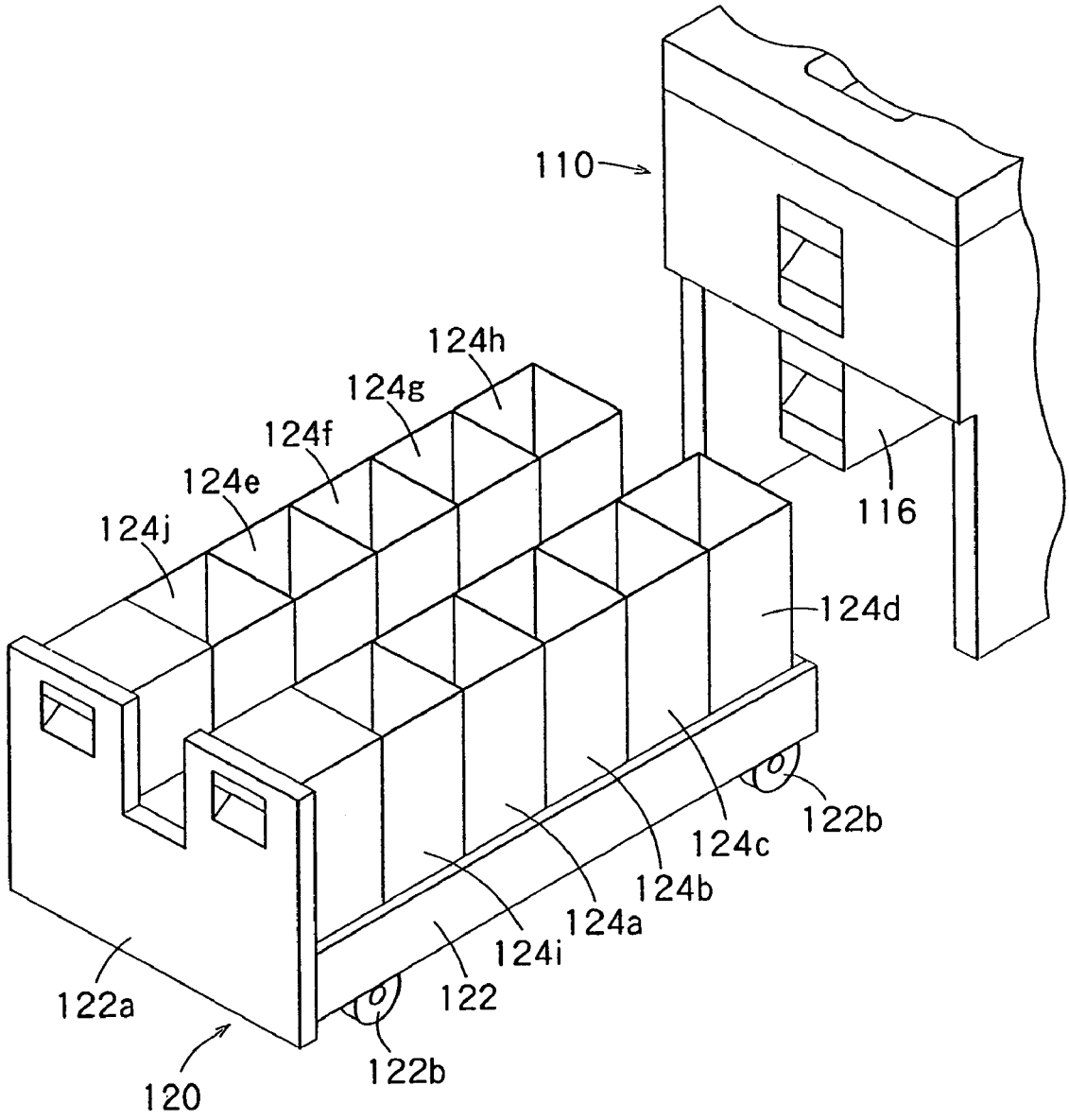
FIG. 4 is an enlarged, fragmentary perspective view of the coin receiving system shown in FIG. 2 in a state where a storing unit is drawn out of a housing.

The coin processing unit 110 is provided with a rejected coin box 114, a return box 116 and a storage unit 120, which can be drawn forward. As shown in FIGS. 3 and 4, the storage unit 120 has a plurality of coin storing cassettes (coin storing units) 124*a* to 124*j*, and a wheeled drawer 122 detachably holding the coin storing cassettes 124*a* to 124*j*. The drawer 122 has a front wall 122*a* and four casters 122*b*. As obvious from FIGS. 3 and 4, the storage unit 120 and the return box 116 are independent of each other and can be individually drawn out.

As shown in FIGS. 1 and 3, the presorting unit A has a stationary disk (stationary member) 1, and a rotary disk 2 disposed under the stationary disk 1 contiguously with the lower surface of the stationary disk 1. An inlet opening 1*a* is formed in a central part of the stationary disk 1 so as to correspond to the coin-feed opening 112*a*. The presorting unit A is formed such that a coin fed through the inlet opening 1*a* of the stationary disk 1 slides relative to the lower surface of the stationary disk 1 as the rotary disk 2 rotates. A guide structure is formed in the stationary disk 1. The guide structure defines coin passages respectively for selectively guiding coins of the groups sliding along the lower surface of the stationary disk 1.

Referring to FIG. 1, the main sorting units B1 and B2 have guide passages 3-1 and 3-2 for guiding coins C to be sorted one by one for substantially horizontal movement, respectively. Conveying mechanisms 4 are disposed over the guide passages 3-1 and 3-2, respectively, to convey coins C along the guide passages 3-1 and 3-2. Four sorting holes 5*a* to 5*d* and four sorting holes 5*e* to 5*h* are arranged successively at intervals along the guide passages 3-1 and 3-2, respectively. Coins of respective denominations drop through the corresponding sorting holes 5*a* to 5*h*.

Coin feed units (coin feeding means) 9-1 and 9-2 are disposed at upstream ends of the guide passages 3-1 and 3-2 of the main sorting units B1 and B2, respectively. The coin feed units 9-1 and 9-2 feeds coins of the two groups sorted beforehand by the presorting unit A onto the corresponding guide passages 3-1 and 3-2, respectively. The coin feed units 9-1 and 9-2 are provided with rotatable feed disks 90, respectively. Coins of the two groups roughly sorted by the presorting unit A are delivered onto the feed disks 90, respectively. Thickness limiting plates 94 for separating overlapping coins to feed coins one by one are disposed at the entrances of the guide passages 3-1 and 3-2 so as to extend over peripheral parts of the feed disks 90, respectively. Other areas corresponding to the circumferences of the feed disks 90 are covered with circumferential walls 92, respectively.

Identification units(coin identifying means) D are disposed at positions corresponding to upstream parts of the guide passages 3-1 and 3-2 of the main sorting units B1 and B2, respectively, to identify coins fed by the coin feed units 9-1 and 9-2 by denomination. The identification units D may be, for example, publicly known ones capable of identifying coins through the magnetic determination of the material of coins or through the optical recognition of the images, such as relief patterns.

Rejection units (rejecting means) 6*a* and old coin sorting units (old coin sorting means) 6*b* are arranged successively between the identification unit D and the sorting hole 5*a* and between the identification unit D and the sorting hole 5*e* in the guide passages 3-1 and 3-2 of the main sorting units B1 and B2, respectively. The rejection units 6*a* sort out different coins, i.e., coins that cannot be identified by the identification units D, such as foreign coins and counterfeit coins, before those coins reach the sorting holes 5*a* to 5*d* and the sorting holes 5*e* to 5*h*, respectively.

The old coin sorting units 6*b* sort out old coins, i.e., coins of different denominations from those of coins to be sorted by the sorting holes 5*a* to 5*h*, before those coins reach the sorting holes 5*a* to 5*d* and the sorting holes 5*e* to 5*h*, respectively. The identification units D of the coin receiving system in the first embodiment are capable of identifying old coins of old denominations and the coin receiving system is capable of dealing with the receipt of the old coins, which are sorted out by the old coin sorting units 6*b*, in addition to the receipt of Euro coins which are sorted by the main sorting units B1 and B2. The coin receiving system is provided with a money receiving means, i.e., a control unit U shown in FIG. 10, capable of calculating the amount of money of coins including Euro coins and the old coins and identified by the identification units D for receiving management.

As shown in FIG. 3, chutes 140 are extended down from the sorting holes 5*a* to 5*d*, the sorting holes 5*e* to 5*h* and the old coin sorting units 6*b*. Temporary storage boxes (temporary holding units) 130 are disposed at the lower ends of the chutes 140, respectively, to store coins temporarily therein. A return passage 150 connected to the return box 116, and storing passages 152 connected to the coin storing cassettes 124*a* to 124*d*, 124*i*, 124*e* to 124*h* and 124*j* are disposed under the temporary storage boxes 130.

Each of the temporary storage boxes 130 has a cylindrical body 132 and a bottom plate 134 closing the open lower end of the cylindrical body 132. The cylindrical body 132 and the bottom plate 134 of each temporary storage box 130 can be shifted in opposite lateral directions by half a distance equal to the width of the temporary storage box 130. When the temporary storage box 130 is moved to a position above the return passage 150 or the storing passage 152, the lower end of the cylindrical body 132 of the temporary storage box 130 can be fully opened. The temporary storage boxes 130 are moved by a box driving mechanism, not shown.

[Component Units]

(1) The presorting unit A, (2) the main sorting units B1 and B2, (3) the rejection units 6*a* and the old coin sorting unit 6*b* will be concretely described hereinafter.

(1) Presorting Unit

The construction of the presorting unit A will be described with reference to FIGS. 1 and 5 to 9. Referring to FIG. 1, the stationary disk 1 and the rotary disk 2 of the presorting unit A are joined by a hinge a1 so that the stationary member 1 can be turned on the hinge a1 relative to the rotary disk 2. A locking device a2 connected to a part diametrically opposite to the hinge a1 of the stationary disk 1 locks the stationary disk 1 in place over the movable disk 2.

Figure 5:
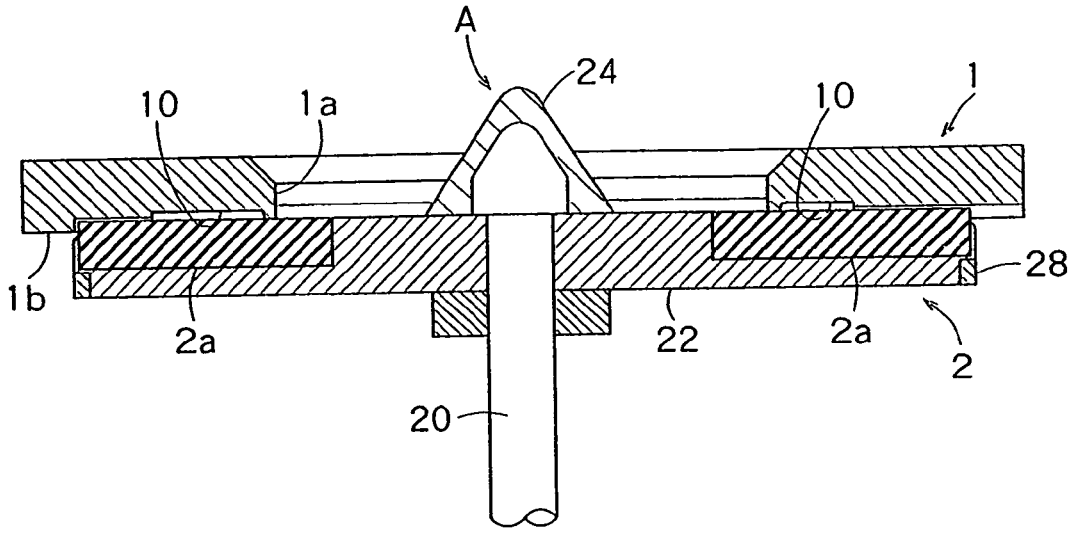
FIG. 5 is a longitudinal sectional view of a presorting unit included in the coin sorting apparatus shown in FIG. 1.

Referring to FIG. 5, the rotary disk 2 comprises a disk body 22 supported for rotation on a shaft 20 and an annular resilient member 2*a* attached to a peripheral part of the upper surface of the disk body 22. The resilient member 2*a* is formed of a resilient material, such as rubber, to hold coins together with the stationary disk 1 and to move coins as the rotary disk 2 is rotated. The resilient member 2*a* absorbs the variation of a gap between the stationary disk 1 and the rotary disk 2 and differences between the thicknesses of coins of different denominations. A conical member 24 is disposed on a central part of the rotary disk 2 to prevent coins from staying on the central part of the rotary disk 2.

As shown in FIG. 1, the rotary disk 2 is driven for rotation by a motor 25 through a pulley 26 attached to the output shaft of the motor 25 and a drive belt 28 extended between the pulley 26 and the disk body 22 (FIG. 5) of the rotary disk 2.

Figure 6:
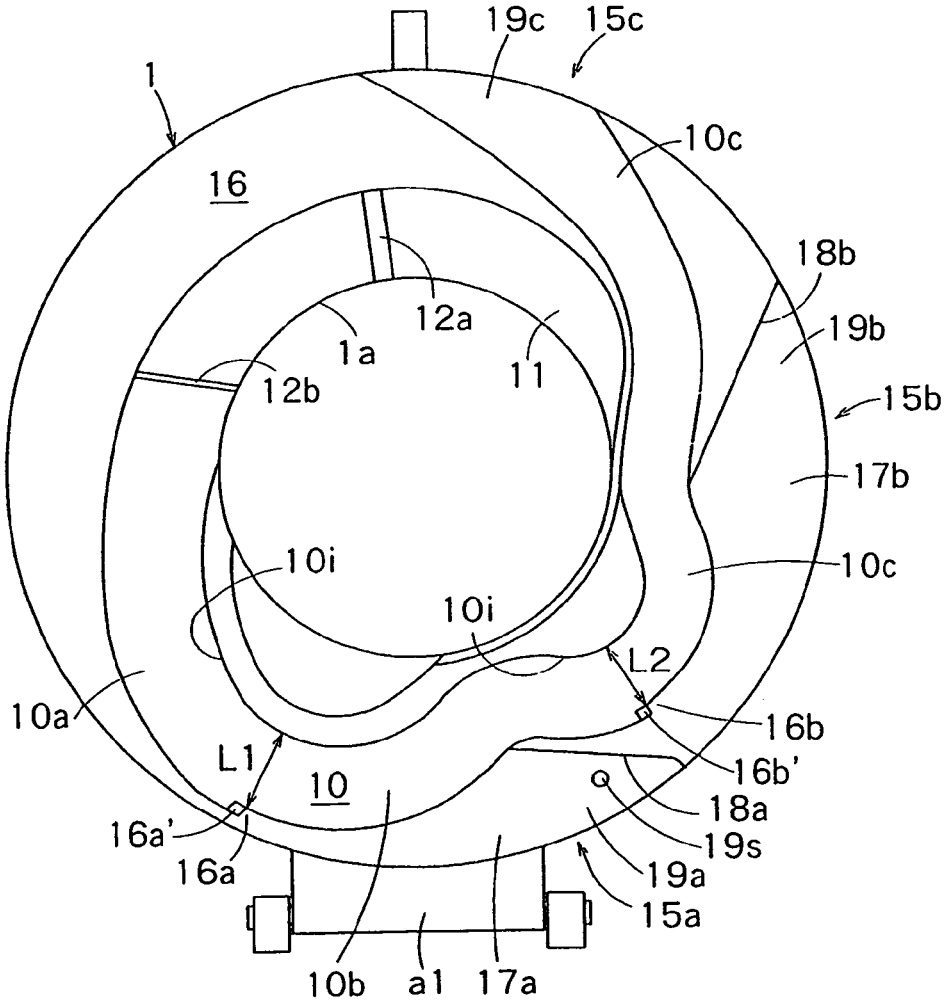
FIG. 6 is a bottom view of a stationary disk included in the presorting unit of the coin sorting apparatus shown in FIG. 1.
Figure 7:
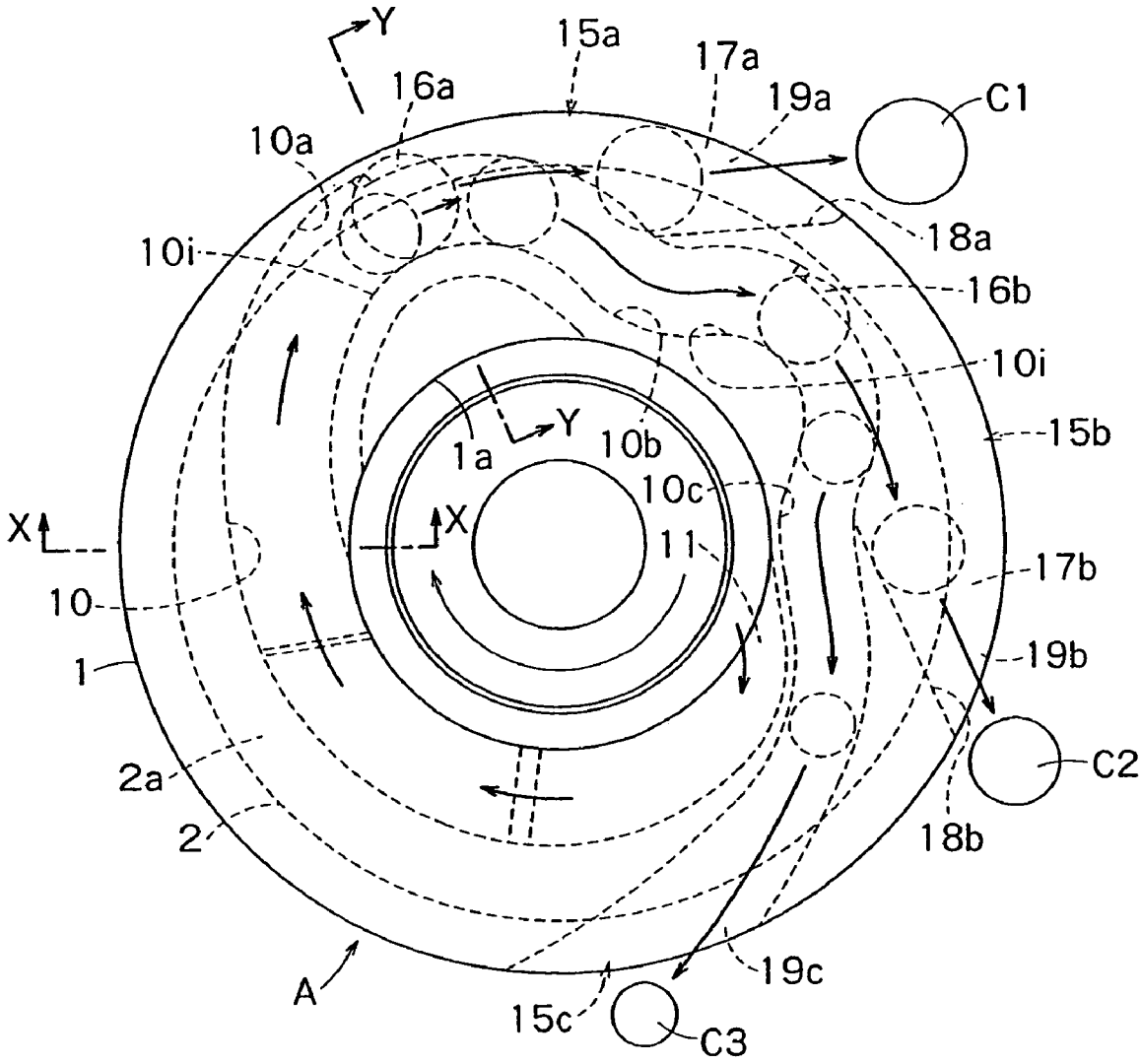
FIG. 7 is a plan view of the stationary disk shown in FIG. 6 of assistance in explaining the movement of coins in the presorting unit of the coin sorting apparatus shown in FIG. 1.

A coin passage 10 formed in the lower surface 1*b* of the stationary disk 1 will be described with reference to FIGS. 6 to 9. The coin passage 10 extends counterclockwise as viewed in FIG. 6 in a meandering spiral from the inlet opening 1*a* toward the periphery of the stationary disk 1. The coin passage 10 has, arranged from the inlet opening toward the periphery of the stationary disk 1, a large-coin passage section 10*a*, a medium-coin passage section 10*b* and a small-coin passage section 10*c*. As shown in FIGS. 6 and 7, the large-coin passage section 10*a* has a width that permits the passage of large coins C1, the medium-coin passage section 10*b* has a width L1 that permits the passage of only medium coins C2 and small coins C3, and the small-coin passage section 10*c* has a width L2 that permits the passage of only small coins C3.

As shown in FIG. 6, the large-coin passage section 10*a* has a coin entrance 11 facing the inlet opening 1*a*, and stairs 12*a* and 12*b* formed at an interval on the downstream side of the coin entrance 11. The coin entrance 11 is formed such that the thickness of a gap between the coin entrance 11 and the resilient member 2*a* of the rotary disk 2 is greater than that of the thickest coins. Thus, all the coins fed into the inlet opening 1*a* can be moved into the coin entrance 11 by centrifugal force as the rotary disk 2 rotates.

Figure 8:
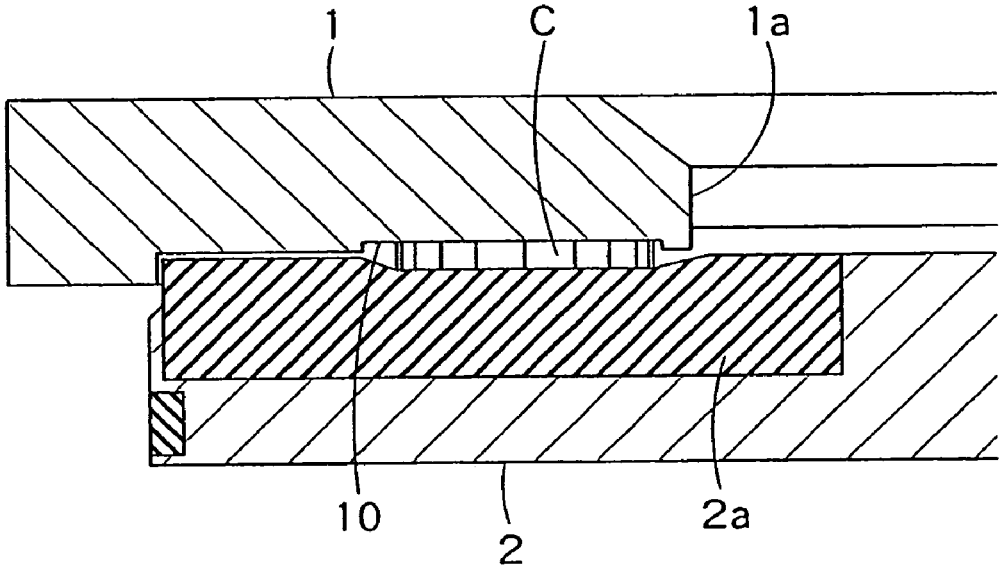
FIG. 8 is a sectional view of the presorting unit shown in FIG. 7 taken on line X—X in FIG. 7, in a state where coins are moving in the coin passage.

The stairs 12*a* and 12*b* are formed to reduce the thickness of the gap between the resilient member 2*a* of the rotary disk 2 and the large-coin passage section 10*a* stepwise toward the downstream end of the large-coin passage section 10*a*. By virtue of the stairs 12*a* and 12*b*, overlapping coins are separated from each other to ensure that coins do not overlap each other and move in a single file in the coin passage 10 as shown in FIG. 8, which is a sectional view taken on line X—X in FIG. 7, showing a state where coins C are moving in the coin passage 10. Since the large-coin passage section 10*a* extends spirally toward the circumference, the outer edges of all the coins moving in the large-coin passage section 10*a* engage the radial inner edge 10*i* as shown in FIG. 7.

Figure 9:
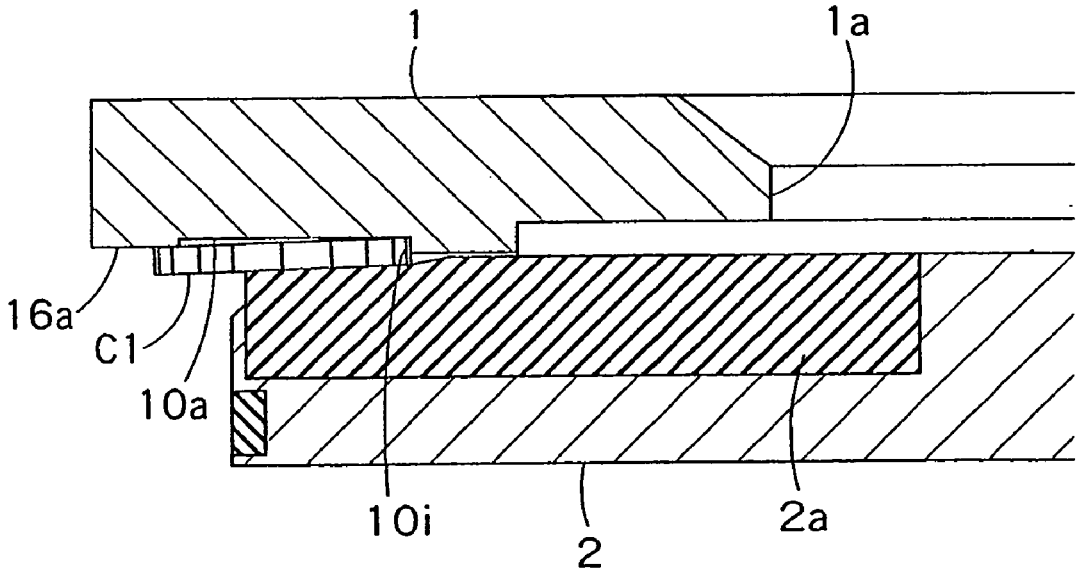
FIG. 9 is a sectional view of the presorting unit taken on line Y—Y in FIG. 7.

Referring to FIGS. 6 and 7, a large-coin sorting guide 15*a* is connected to the radial outer side of the medium-coin passage section 10*b* to guide only large coins C1 selectively and to eject large coins C1 in a substantially tangential direction. The large-coin sorting guide 15*a* has a step 16*a* and an ejecting passage 17*a*. The step 16*a* is formed at a boundary between the large-coin passage section 10*a* and the medium-coin passage section 10*b*. Only large coins C1 of a diameter greater than the width L1 of the medium-coin passage section 10*b* run onto an outer part of the step 16*a* as shown in FIG. 7 and FIG. 9 showing a section taken on line Y—Y in FIG. 7. A ramp 16*a*' is formed on the upstream side of the step 16*a* to facilitate coins running onto the step 16*a*.

The ejecting passage 17*a* has a guide edge 18*a* for guiding a coin that has run onto the step 16*a* for movement in a substantially tangential direction, and an outlet 19*a* through which the coin guided by the guide edge 18*a* is ejected outside. A counting sensor 19*s* (FIG. 6) is disposed at a position immediately in front of the outlet 19*a* to count large coins C1 passed the outlet 19*a*. Since all the coins engage the radial inner edge 10*i*, medium coins C2 and small coins C3 respectively having diameters smaller than the width L1 do not run onto the step 16*a* and move into the medium-coin passage section 10*b*.

A medium-coin sorting guide 15*b* is connected to the radial outer side of the small-coin passage section 10*c* to guide only medium coins C2 selectively and to eject medium coins C2 in a substantially tangential direction. The medium-coin sorting guide 15*b*, similarly to the large-coin sorting guide 15*a*, has a step 16*b* and an ejecting passage 17*b*.

The step 16*b* is formed at a boundary between the medium-coin passage section 10*b* and the small-coin passage section 10*c*. Only medium coins C2 of a diameter greater than the width L2 of the small-coin passage section 10*c* run onto an outer part of the step 16*b*. A ramp 16*b*' is formed on the upstream side of the step 16*b* to facilitate coins running onto the step 16*b*.

The medium-coin passage section 10*b* extends downstream and is curved toward the inner circumference and then toward the outer circumference. Therefore, the outer edges of all the coins moving in the medium-coin passage section 10*b* engage the radial inner edge 10*i* as shown in FIG. 7. Thus, small coins C3 of a diameter smaller than the width L2 move into the small-coin passage section 10*c* without running onto the step 16*b*.

The small-coin passage section 10*c* extends downstream toward the inner circumference and toward the outer circumference, and terminates in a small-coin sorting guide 15*c* having an outlet 19*c*.

As shown in FIG. 1, a large coin dropping hole 8*a*, a medium coin dropping chute 8*b* and a small coin dropping chute 8*c* are disposed so as to correspond to the outlets 19*a*, 19*b* and 19*c* of the presorting unit A, respectively. The large coin dropping hole 8*a* is connected to the temporary storage box 130 (FIG. 3) corresponding to the coin storing cassette 124*i* or 124*j* (FIGS. 3 and 4). The medium coin dropping chute 8*b* and the small coin dropping chute 8*c* deliver medium coins ejected through the outlet 19*b* and small coins ejected through the outlet 19*c* to the coin feed units 9-1 and 9-2, respectively.

(2) Main Sorting Units

The construction of the main sorting units B1 and B2 will be concretely described with reference to FIGS. 1 and 10. Although the rejection units 6*a* and the old coin sorting units 6*b* are disposed on the respective guide passages 3-1 and 3-2 of the main sorting units B1 and B2, respectively, the construction of the rejection units 6*a* and the old coin sorting units 6*b* will be described in the next section (3).

The main sorting units B1 and B2 have the guide passages 3-1 and 3-2, conveying mechanisms 4 and the sorting holes 5*a* to 5*d* and 5*e* to 5*h*, respectively. Those corresponding components of the main sorting units B1 and B2, excluding the sizes of the sorting holes 5*a* to 5*d* and 5*e* to 5*h*, are identical. Therefore, basically, only the main sorting unit B1 for sorting medium coins on the right-hand side in FIG. 1 will be described.

The guide passage 3-1 is formed on a base plate S1 (FIG. 3) supporting the coin sorting apparatus S. The guide passage 3-1 comprises a main guide member 32 and an auxiliary guide member 34, and has a passage surface 30 defined on the surface of the base plate S1 by the guide members 32 and 34. The guide members 32 and 34 are extended on the base plate S1. Although the guide passage 3-1 is substantially straight, the guide passage 3-1 has an oblique section 36 slightly obliquely extending toward the auxiliary guide member 34 between the identification unit D and the rejection unit 6*a*, which is best shown in the guide passage 3-2. Thus, the outer edges of coins C moving along the guide passage 301 engage the main guide member 32 and coins C move along the main guide member 32.

The conveying mechanism 4 includes pulleys 40, 41 and 42 disposed at positions in an end part (an upper part as viewed in FIG. 1) of the guide passage 3-1, near the oblique section 36, and in an inlet part (a lower part as viewed in FIG. 1) of the guide passage 3-1, respectively. Conveyor belts 43 and 44 are extended between the pulleys 40 and 41, and between the pulleys 41 and 42, respectively. A motor 46 drives the pulley 40 for rotation. The conveyor belts 43 and 44 are biased toward the main guide member 32 along which coins C move. The conveyor belts 43 and 44 come into contact with the upper surfaces of coins, press coins against the passage surface 30 and make coins slide along the passage surface 30 to convey coins as shown in FIG. 11*b*.

The sorting holes 5*a* to 5*d* are formed in the base plate S1 in substantially rectangular shapes of different sizes dependent on the diameters of coins to be dropped therein, respectively. One side edge on the side of the main guide member 32 of each of the sorting holes 5*a* to 5*d* is spaced slightly from the main guide member 32. The other side edge on the side of the auxiliary guide member 34 of each of the sorting holes 5*a* to 5*d* is spaced a distance slightly greater than the diameter of coins to be dropped therein and smaller than the diameter of coins greater than that of coins to be dropped therein apart from the main guide member 32.

Each of the sorting holes 5*a* to 5*d* is formed so as to make coins to be sorted out drop therein and to pass coins having diameters greater than that of coins to be sorted out. With this object in view, the sorting holes 5*a* to 5*d* are arranged from the upstream side downward in order of increasing diameters of corresponding coins. More concretely, the sorting holes 5*a*, 5*b*, 5*c* and 5*d* are formed to enable only 20 cent coins, 1 Euro coins, 50 cent coins and 2 Euro coins to drop therein, respectively.

The sorting holes 5*e*, 5*f*, 5*g* and 5*h* of the main sorting unit B2 for sorting smaller coins are formed to enable only 1 cent coins, 2 cent coins, 10 cent coins and 5 cent coins to drop therein, respectively. Sensors T for detecting the passage of coins are disposed immediately in front of the sorting holes 5*a* to 5*d* and sorting holes 5*e* to 5*h*, respectively.

(3) Rejection Units and Old Coin Sorting Units

The rejection units 6*a* and the old coin sorting units 6*b* will be described with reference to FIGS. 10 to 12*b*. Although only the main sorting unit B1 on the right-hand side in FIG. 1 is shown in FIG. 10, the rejecting unit 6*a* and the old coin sorting unit 6*b* of the other main sorting unit B2 are basically the same as those shown in FIG. 10, respectively. Although only the rejection unit 6*a* is shown in FIG. 10, the rejection unit 6*a* and the old coin sorting unit 6*b* are the same in mechanism. Therefore, both the reference characters 6*a* and 6*b* are indicated side by side in FIGS. 11*a* to 12*b*, and the rejection unit 6*a* and the old coin sorting unit 6*b* are referred to inclusively as "unit 6*a*, 6*b*" in the following description.

Referring to FIGS. 11*a* to 12*b*, the unit 6*a*, 6*b* has an ejecting hole 60 formed in the base plate S1 (passage member), a support roller 62 and a presser roller 66. The ejecting hole 60 extends from a position near the main guide member 32 across the auxiliary guide member 34 to a position on the outer side of the auxiliary guide member 34. The support roller 62 and the presser roller 66 are disposed on the lower and the upper side of the base plate S1, respectively, at positions corresponding to the ejecting hole 60.

Figure 11A:
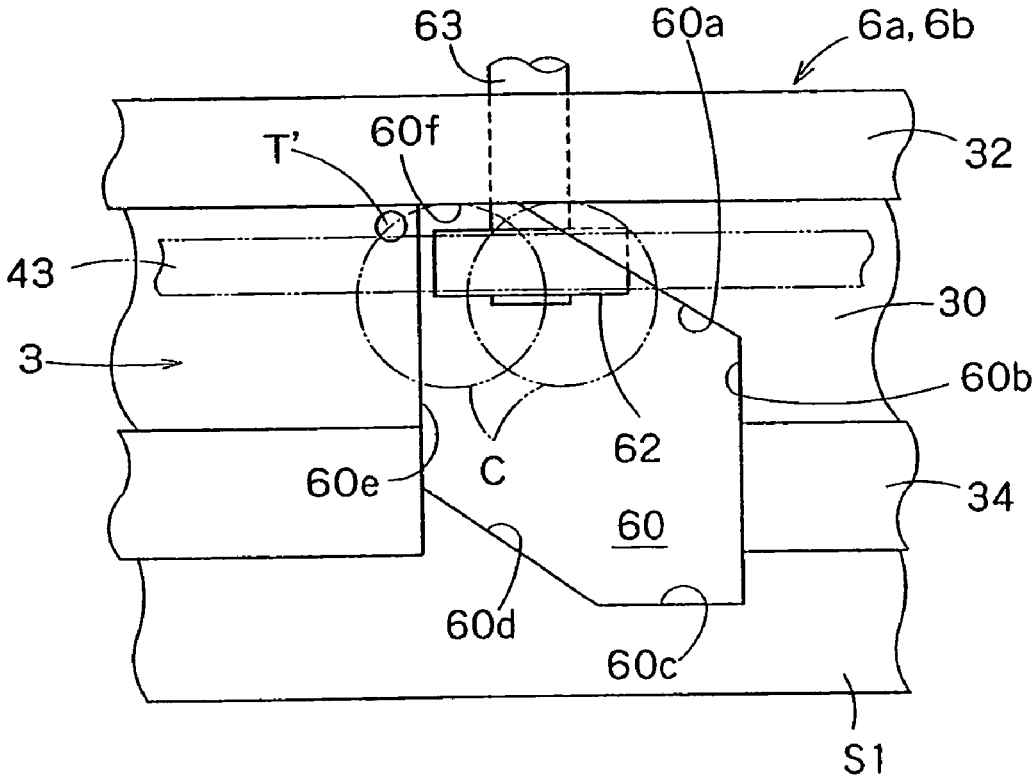
FIG. 11*a* is an enlarged plan view of a rejecting unit (old coin sorting unit) included in the coin sorting apparatus shown in FIG. 10 in a state for passing a coin.
Figure 11B:
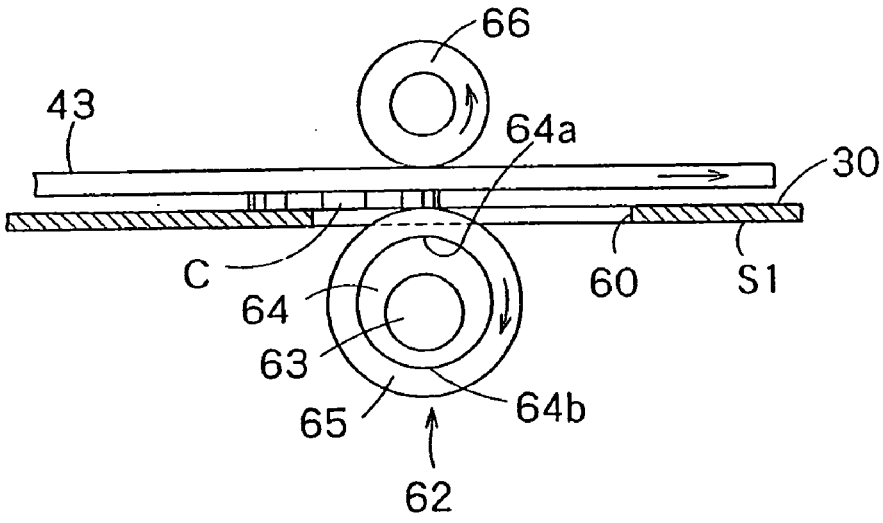
FIG. 11*b* is a longitudinal sectional view corresponding to FIG. 11*a;*

As shown in FIG. 11*a*, the ejecting hole 60 has a hexagonal shape defined by a guide edge-face (guiding side wall) 60*a*, a downstream edge-face 60*b*, an outer edge-face 60*c*, an opposite edge-face 60*d*, an upstream edge-face 60*e* and an inner edge-face 60*f*. The guide edge-face 60*a* and the opposite edge-face 60*d*, the downstream edge-face 60*b* and the upstream edge-face 60*e*, and the outer edge-face 60*c* and the inner edge-face 60*f* are parallel to each other, respectively. The inner edge-face 60*f* coincides with the inner side of the main guide member 32.

The guide edge-face 60*a* extends on the passage surface 30 obliquely away from the main guide member 32 in a downstream direction to a middle of the width of the guide passage and is inclined at an angle of about 30° to the main guide member 32. An end on the side of the main guide member 32 of the guide edge-face 60*a* corresponds to the axis of the support roller 62.

A coin sensor T' for detecting the arrival and passage of a coin C is disposed immediately in front of the upstream edge-face 60*e* of the ejecting hole 60. A signal provided by the sensor T' is given to a control unit U shown in FIG. 10.

Referring to FIG. 11*b*, the support roller 62 has a shaft 63, an eccentric bearing (eccentric member) 64 and a free roller member 65. The support roller 62 is turned between a coin-passing position where the upper end thereof is at a level not lower than that of the upper edge of the guide edge-face 60*a* (passage surface 30) and a coin-ejecting position where the upper end thereof is at a level below that of the upper edge of the guide edge-face 60*a* of the ejecting hole 60.

Figure 10:
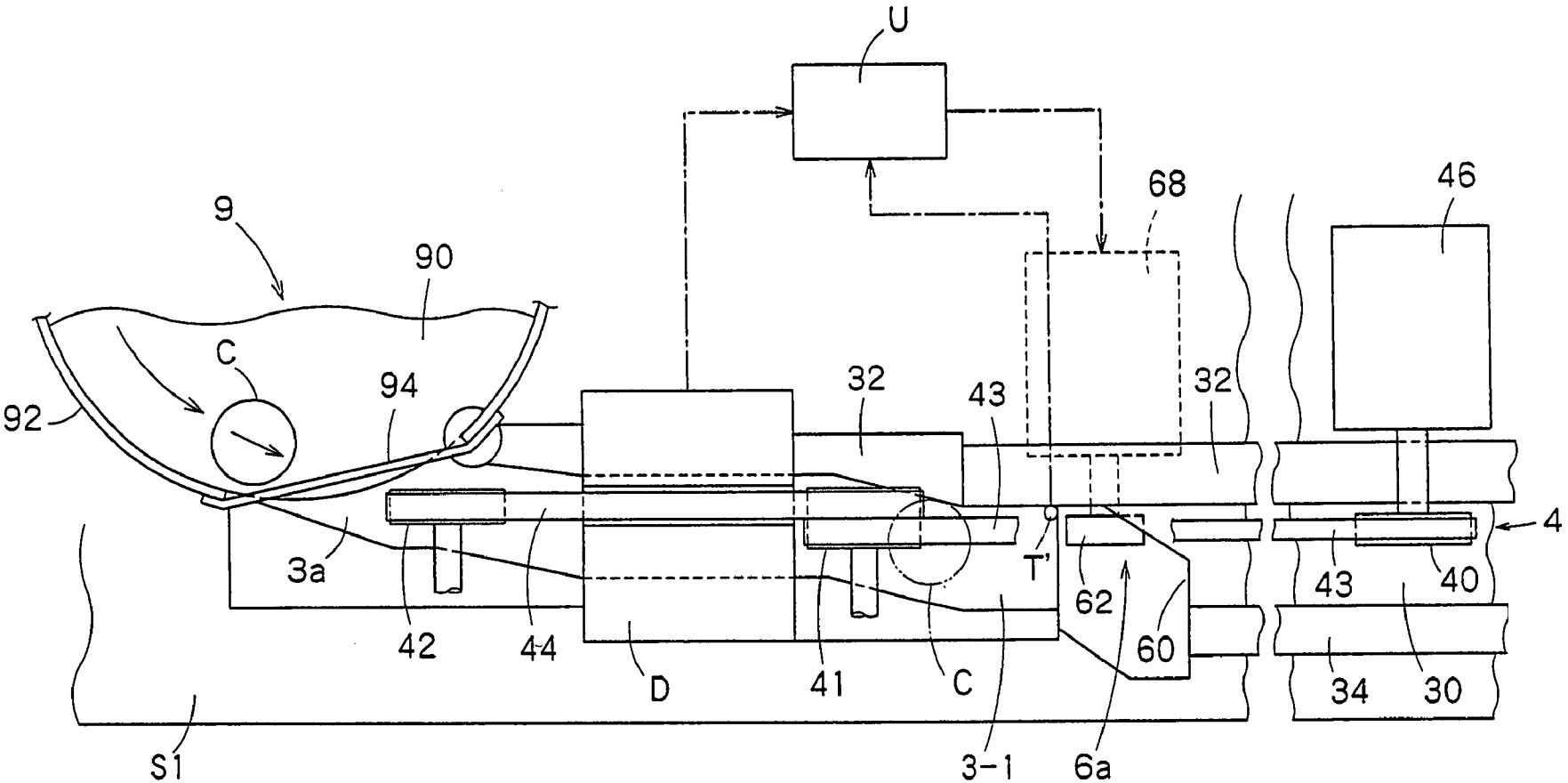
FIG. 10 is an enlarged, fragmentary plan view of a main sorting unit included in the coin sorting apparatus shown in FIG. 1.

More concretely, the eccentric bearing 64 fastened to the shaft 63 is turned by a stepping motor 68 (FIG. 10). In a state where the support roller 62 is set at the coin-passing position, a major-radius section 64*a* of the eccentric bearing 64 faces up as shown in FIG. 11*b*. In a state where the support roller 62 is set at the coin-ejecting position, a minor-radius section 64*b* faces up as shown in FIG. 12*b*.

A signal indicating the result of the coin identifying operation of the identification unit D is given to the control unit (controller) U. The control unit U gives a drive signal to and controls the stepping motor 68 (FIG. 10).

The free roller member 65 is mounted for free rotation on the circumference of the eccentric bearing 64. The presser roller 66 is adapted to rotate while pressing the coin C with the conveyor belt 43 against the support roller 62 so as to hold the coin C between the conveyor belt 43 and the support roller 62 set at the coin-passing position as shown in FIG. 11*b*.

Preferably, the upper end of the support roller 62 (the upper end of the free roller member 65) is at a level slightly higher than that of the upper edge of the guide edge-face 60*a* of the ejecting hole 60 (passage surface 30) when the support roller 62 is set at the coin-passing position shown in FIG. 11*b*.

When the support roller 62 is set at the coin-ejecting position shown in FIG. 12*b*, the outer edge of a coin supported on the support roller 62 must be able to come into contact with the guide edge-face 60*a* of the ejecting hole 60. Theoretically, when the support roller 62 is set at the coin-ejecting position, the level of the upper end of the support roller 62, though dependent on the thickness of a coin to be supported thereon, must be lower than that of the upper edge of the guide edge-face 60*a*. In view of surely bringing the outer edge of a coin C into contact with the guide edge-face 60*a* of the ejecting hole 60, it is preferable that the level of the upper end of the support roller 62 is slightly lower than that of the lower edge of the guide edge-face 60*a*.

When the identification unit D decides that a coin is one to be ejected, such as an unidentifiable coin, an old coin or a special coin, the coin is ejected by the following operations. The identification unit D gives an identification signal indicating the result of identification of a coin C to the control unit U. Upon the detection of the coin at the position corresponding to the sensor T', the sensor T' gives a coin detection signal to the control unit U. Then, the control unit U gives a drive signal to the stepping motor 68 to set the support roller 62 at the coin-ejecting position shown in FIG. 12*b*. After the passage of a time needed by the coin C to move away from the support roller 62, the control unit U gives a drive signal to the stepping motor 68 to set the support roller 62 at the coin-passing position shown in FIG. 11*b*.

[Operations and Functions]

The operations and functions of the first embodiment thus constructed will be described in terms of (1) processes to be carried out by the presorting unit A, and (2) processes to be carried out by the main sorting units B1 and B2. Coins to be processed by the following processes are, as mentioned above, mixed coins including Euro coins of eight denominations, old coins and different coins. Incidentally, certain of the operations and functions that are apparent from the above-described constructions will be omitted.

(1) Processes to be Carried Out by the Presorting Unit

The coins to be processed are loaded into the hopper 112 shown in FIGS. 2 and 3, and fed into the inlet opening 1*a* of the presorting unit A. As shown in FIG. 7, coins fed in the inlet opening 1*a* enter the coin entrance 11 and are moved along the coin passage 10 as the rotary disk 2 rotates.

Among coins moved along the large-coin passage section 10*a* and reaching the step 16*a* of the large-coin sorting guide 15*a*, only large coins (old coins) C1 run onto the step 16*a* and are advanced to the ejecting passage 17*a*, are counted by the counting sensor 19*s*, and are ejected through the outlet 19*a*. The rest of the coins, i.e., medium coins C2 and small coins C3, are advanced into the medium-coin passage section 10*b*.

Among the medium and the small coins C2 and C3 reached the step 16*b* of the medium-coin sorting guide 15*b*, only the medium coins C2 run onto the step 16*b* are moved along the ejecting passage 17*b* and are ejected through the outlet 19*b*. The rest of the coins, i.e., the small coins C3, are advanced into the small-coin passage section 10*c* and are ejected through the outlet 19*c* of the small-coin sorting guide 15*c*.

The large coins C1 ejected through the outlet 19*a* of the presorting unit A are dropped through the large coin dropping hole 8*a* (FIG. 1) into the temporary storage box 130 for temporary storage. If the large coins C1 are old coins of a single denomination, the number of the old coins are counted by the counting sensor 19*s* (FIG. 6) for receiving management. The medium coins C2 and the small coins C3 ejected through the outlets 19*b* and 19*c* of the presorting unit A, respectively, are delivered through the chutes 8*b* and 8*c* to the coin feed units 9-1 and 9-2, respectively (FIGS. 1 and 3).

(2) Processes to be Carried Out by the Main Sorting Units

Referring to FIG. 1, the medium coins C2 and the small coins C3 delivered respectively to the coin feed units 9-1 and 9-2 are fed one by one via the thickness limiting plates 94 onto the guide passages 3-1 and 3-2 as the feed disks 90 rotates. The coins fed onto the guide passages 3-1 and 3-2 are conveyed along the guide passages 3-1 and 3-2 by the conveying mechanisms 4.

While the medium and the small coins are being conveyed along the guide passages 3-1 and 3-2, respectively, the identification units D identify the medium and the small coins. Different coins that could not be identified by the identification units D are sorted out by the rejecting units 6*a* before the different coins advance to the sorting holes 5*a* to 5*d* and the sorting holes 5*e* to 5*h*. The old coins, which were identified as coins not to be sorted by the sorting holes 5*a* to 5*d* and the sorting holes 5*e* to 5*h* by the identification units D, are sorted out by the old coin sorting units 6*b* before the same reach the sorting holes 5*a* to 5*d* and the sorting holes 5*e* to 5*h*.

The medium and the small coins passed the rejection units 6*a* and the old coin sorting units 6*b* are sorted by denomination by the main sorting units B1 and B2 and are dropped through the sorting holes 5*a* to 5*d* and the sorting holes 5*e* to 5*h* respectively corresponding to coins of different denominations. The coins dropped through the sorting holes 5*a* to 5*d* and the sorting holes 5*e* to 5*h*, and the old coins selected by the old coin sorting unit 6*b*, are stored temporarily in the temporary storage boxes 130, respectively, for coins of different denominations. The different coins sorted out by the rejection units 6*a* are eventually delivered to the rejected coin box 114 (FIG. 2).

The support rollers 62 of each rejection unit 6*a* and each old coin sorting unit 6*b* are controlled for a sorting process for sorting out coins C in the following manner.

(i) Each of coins C being conveyed by the conveying belt 43 along the main guide members 32 of the guide passages 3-1 and 3-2 is held between the support roller 62 and the conveyor belt 43 pressed by the presser roller 66 and passes the ejecting hole 60 instead of dropping into the ejecting hole 60 when the support roller 62 is set at the coin-passing position as shown in FIGS. 11*a* and 11*b*.

Figure 12A:
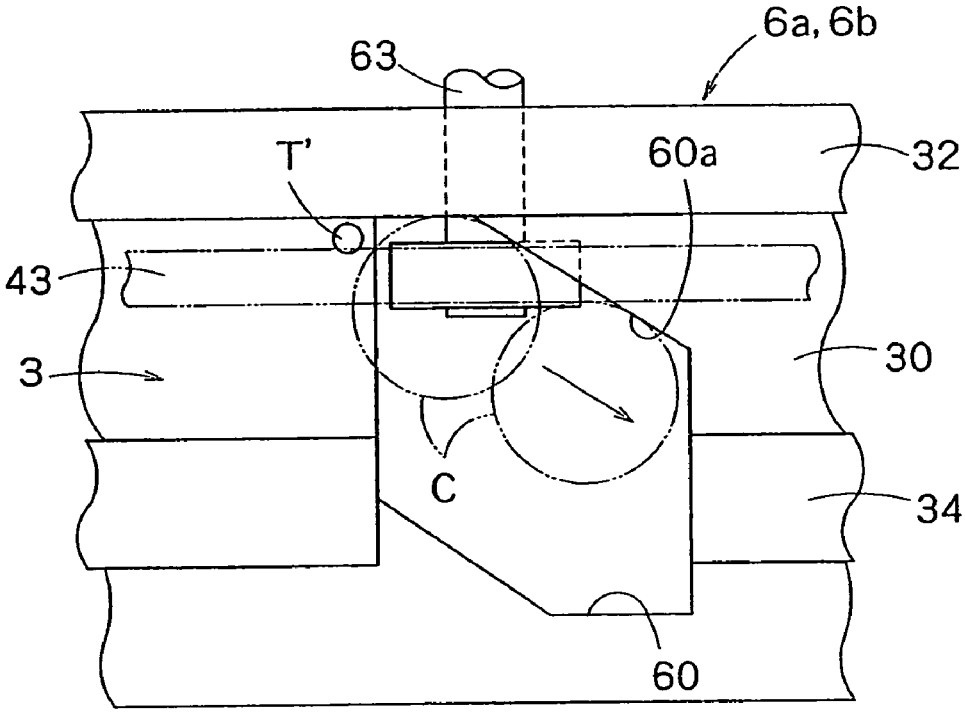
FIG. 12*a* is an enlarged plan view of the rejection unit (old coin sorting unit) included in the coin sorting apparatus shown in FIG. 10 in a state for ejecting a coin.
Figure 12B:
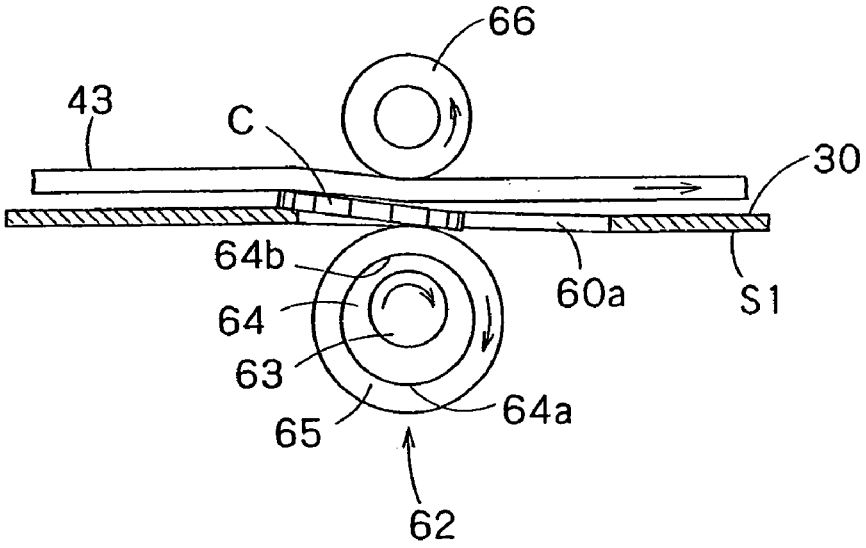
FIG. 12*b* is a longitudinal sectional view corresponding to FIG. 12*a;*
Figure 13:
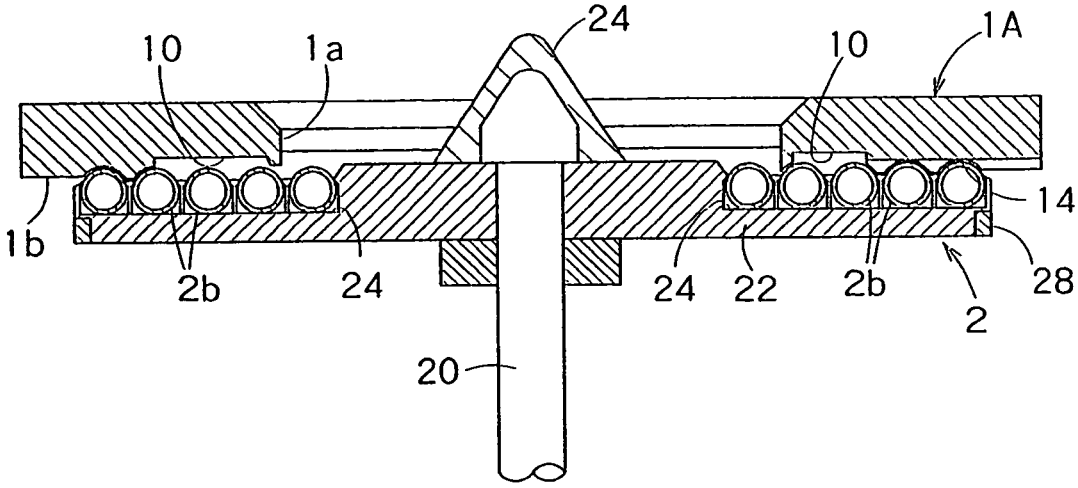
FIG. 13 is a view, similar to FIG. 5, of essential parts of a coin sorting apparatus in a first modification of the coin sorting apparatus in the first embodiment.

(ii) Each of coins C being conveyed by the conveying belt 43 along the main guide members 32 of the guide passages 3-1 and 3-2 sinks in a tilted position in the ejecting hole 60 onto the support roller 62 and its outer edge engages the guide edge-face 60*a* of the ejecting hole 60 when the support roller 62 is set at the coin-ejecting position as shown in FIGS. 12*a* and 12*b*. The guide edge-face 60*a* guides the coin C so that the coin C is spaced laterally away from the main guide member 32 as the same moves downstream along the guide passage 3-1. Consequently, the coin C moves obliquely laterally away from the support roller 62 and drops into the ejecting hole 60 so that the coin C is rejected through the hole 60.

Respective total amounts of money of the Euro coins, i.e., the large, medium and small coins, and the old coins of different denominations stored temporarily in the temporary storage boxes 130 have been calculated individually by the money receiving means. Sum total amount of money of the new and the old coins also has been calculated by the money receiving means. After the amount of money displayed by the display 100*d* of the information processing unit 100 (FIG. 2) has been confirmed and a receiving operation has been accomplished by operating the operating unit 100*e*, the coins contained in the temporary storage boxes 130 are transferred to the corresponding coin storing cassettes 124*a* to 124*j* (FIGS. 3 and 4), respectively. Coins that need to be returned among those temporarily stored in the temporary storage boxes 130 due to disagreement with confirmed amounts of money are transferred from the temporary storage boxes 130 to the return box 116 (FIGS. 3 and 4) by operating the operating unit 100 for returning the same coins.

[Effect]

As apparent from the foregoing description, according to the first embodiment, the two groups of coins (medium and small coins) roughly sorted by the presorting unit A are sorted by denomination by the main sorting units B1 and B2. Thus the number of denominations to be sorted by each sorting operation can be reduced. The coins (medium and small coins) of each group sorted by the presorting unit A are identified by the identification units D, and coins to be rejected are rejected by the rejection units 6*a* and the old coin sorting units 6*b* on the basis of the result of identification of the coins by the identification units D. Therefore, the number of denominations of the coins to be sorted by the main sorting units B1 and B2 can be further reduced; that is, old coins and the like can be excluded from coins to be sorted by the main sorting units B1 and B2.

Accordingly, coins of many denominations can be surely sorted. The degree of freedom of selection of sorting method to be carried out by the main sorting units B1 and B2 can be greatly increased; that is, even mixed coins including Euro coins of mixed denominations and old coins, which are difficult to sort by a single sorting means, can be surely and smoothly sorted by the main sorting units B1 and B2, which are similar to generally known sorting apparatuses.

More specifically, Euro coins of eight denominations include coins having a thickness not smaller than twice the thickness of the thinnest coins. Therefore, it is difficult to separate overlapping coins by the thickness limiting plate 94 (FIG. 10) to feed coins one by one if a single main sorting unit is used for sorting Euro coins of all denominations, because the thickness limiting plate 94 set so as to define a gap to permit the thickest coins to pass therethrough permits the superposed thinnest coins to pass therethrough.

In this embodiment, each of the groups of coins roughly sorted by the presorting unit A does not include coins having a thickness not smaller than twice the thickness of the thinnest coins. Therefore, the thickness limiting plates 94 of the coin feed units 9-1 and 9-2 separate overlapping coins so that the coins are fed one by one and hence the main sorting units B1 and B2 are able to surely sort the coins.

Since the number of denominations of coins to be sorted by each of the main sorting unit B1 and B2 is reduced, the guide passages 3-1 and 3-2 of the main sorting units B1 and B2 need to be provided with the four sorting holes 5*a* to 5*d* and the four sorting holes 5*e* to 5*h*, respectively, instead of eight sorting holes for single sorting means, so that the guide passages 3-1 and 3-2 have a short length.

The coin receiving system in this embodiment is capable of dealing with mixed coins including the Euro coins of eight denominations to be sorted by the main sorting units B1 and B2 and old coins (i.e. the large coins C1 to be sorted by the presorting unit A and the different coins to be sorted out by the old coin sorting units 6*b*) for money receiving management.

As mentioned above, the rejection units 6*a* and the old coin sorting units 6*b* move a coin C in an obliquely lateral direction on the support roller 62 and drop the coin C from the support roller 62, instead of moving and dropping the coin C straight in a conveying direction along the support roller 62. Thus the coin C to be ejected can be quickly separated from the support roller 62 set at the coin-ejecting position and hence the timing of returning the support roller 62 from the coin-ejecting position to the coin-passing position can be advanced.

A coin C advancing past the support roller 62 set at the coin-passing position passes the guide edge-face 60*a* of the ejecting hole 60 and runs onto the passage surface 30 on the side of the main guide member 32. Then the coin C is held between the passage surface 30 and the conveying belt 43. Therefore, even if the support roller 62 is turned to the coin-ejecting position after the coin C has run onto the passage surface 30, the coin C does not drop into the ejecting hole 60, but the succeeding coin C can be dropped into the ejecting hole 60.

Thus, the coin receiving system is capable of surely sorting coins even if the timing of changing the position of the support roller 62 between the coin-passing position and the coin-ejecting position is advanced, and is capable of sorting coins at a sorting rate higher than that at which the conventional coin receiving system sort coins.

Whereas a coin C moving in the conveying direction is moved straight to pass the support roller 62 when the support roller 62 is set at the coin-passing position (FIGS. 11*a* and 11*b*), a coin C to be ejected by setting the support roller 62 at the coin-ejecting position (FIGS. 12*a* and 12*b*) is moved obliquely laterally and dropped from the support roller 62. Therefore, the difference between the diameter of the smallest coin that can pass the ejecting hole 60 (when the support roller 62 is set at the coin-passing position) and that of the largest coin that can drop into the ejecting hole 60 (when the support roller 62 is set at the coin-ejecting position) is greater than that in the conventional coin receiving system. Thus, the coin receiving system in this embodiment is capable of sorting coins having diameters in a range wider than that of diameters of coins that can be sorted by the conventional sorting apparatus.

[Modifications]

Although the embodiment has been described as applied to sorting mixed coins including Euro coins of eight denominations and coins of other denominations, such as old coins, the present invention is applicable, in principle, to sorting coins regardless of denominations, when coins of at least three denominations are sorted roughly into two or more groups of coins and the groups of coins are subjected to sorting.

A publicly known guide structure capable of selectively guiding coins of different denominations for rough sorting may be used instead of the foregoing guide structure of the presorting unit A. Sorting units of publicly known mechanisms, such as electrical sorting units, may be employed instead of the foregoing coin sorting units of the main sorting units B1 and B2. For example, the sorting units for sorting respective coins of all the denominations may be similar to the rejecting units 6*a*.

The shape of the ejecting holes 60 of the rejecting units 6*a* and the old coin sorting units 6*b* is not limited to that shown in FIG. 11*a*. The ejecting holes 60 may be of any shape provided that the ejecting holes 60 have the function of the guide edge-face 60*a* and are capable of dropping coins to be dropped therethrough. The presser roller 66 is employed in the foregoing embodiment in view of further firmly holding a coin between the support roller 62 and the conveyor belt 43. However, the presser roller 66 may be omitted if a coin can be surely held between the support roller 62 and the conveying belt 43.

Seven specific modifications of this embodiment will be described hereinafter.

(1) Referring to FIGS. 13 to 18 showing essential parts of a coin sorting apparatus in a first modification of the coin sorting apparatus in the first embodiment, the coin sorting apparatus has a rotary disk 2 provided with a plurality of resilient ring belts 2*b* instead of the resilient member 2*a*, and a stationary disk 1A provided in its lower surface 1*b* with grooves 14 of a shape conforming to upper parts of the resilient belts 2*b*.

The resilient belts 2*b* of the rotary disk 2 are hollow rings formed of a resilient material, such as urethane rubber, and having a circular cross section. The rotary disk 2 has a disk body 22 provided with concentric circular grooves 24 respectively for accommodating the resilient belts 2*b*.

Figure 16:
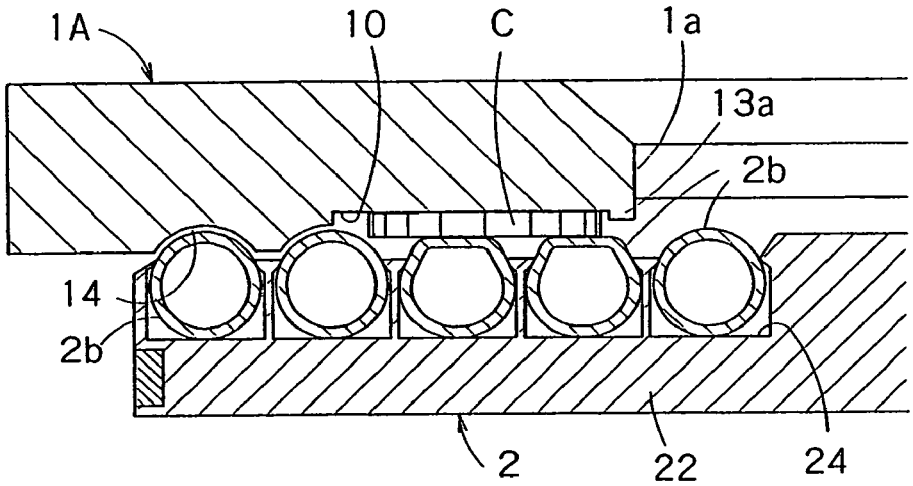
FIG. 16 is a view, similar to FIG. 8, of the parts shown in FIG. 13.
Figure 17:
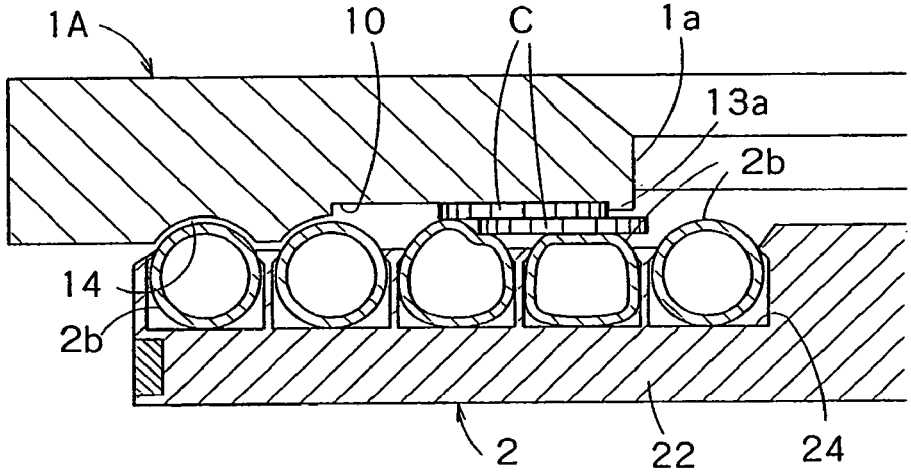
FIG. 17 is a view, similar to FIG. 16, showing a state where overlapping coins are passed.
Figure 18:
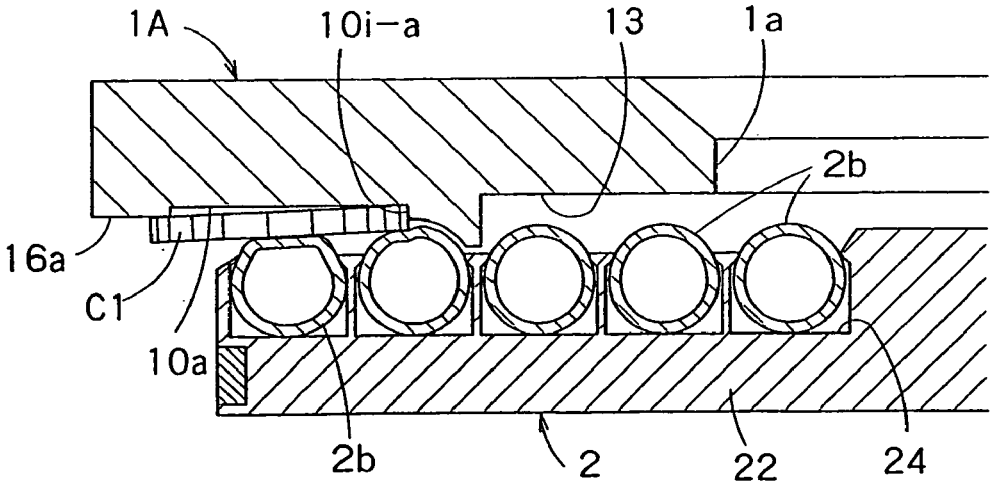
FIG. 18 is a view, similar to FIG. 9, of the parts shown in FIG. 13.

The plurality of resilient belts 2*b* attached to the disk body 22, similarly to the resilient member 1*a*, hold coins together with the stationary disk 1A, move coins held between the resilient belts 2*b* and the stationary disk 1A as the rotary disk 1A rotates and absorb the variation of the gap between the stationary disk 1A and the resilient belts 2*b* and the difference in thickness between coins of different denominations (FIGS. 16 to 18).

Figure 14:
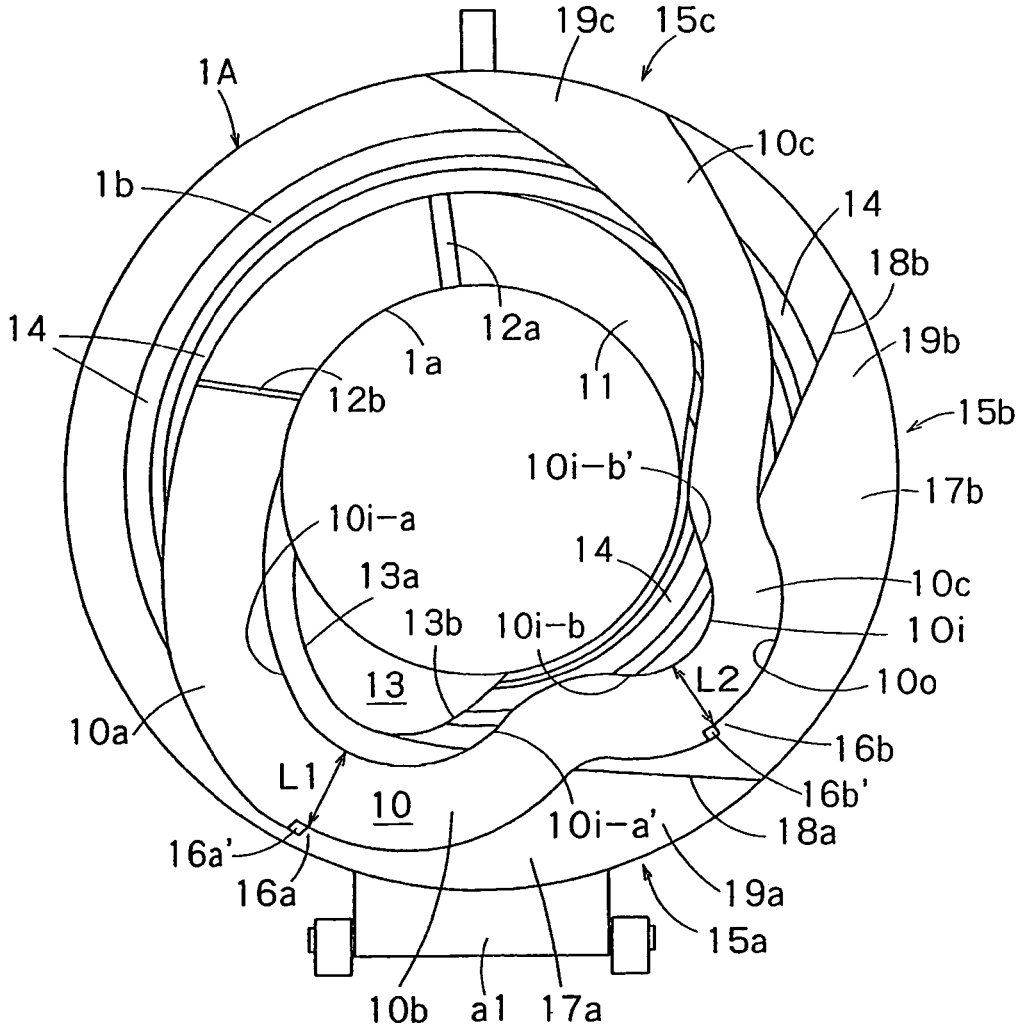
FIG. 14 is a view, similar to FIG. 6, of the parts shown in FIG. 13.

As shown in FIGS. 16 to 18, upper parts of the resilient belts 2*b* attached to the rotary disk 2 are received in the grooves 14 formed in the lower surface 1*b* of the stationary disk 1A to effectively prevent coins from moving out of sections 10*a* to 10*c* of a coin passage 10. As shown in FIG. 14, the grooves 14 are formed only in a part of the lower surface 1*b* of the stationary disk 1A where the distance between the stationary disk 1A and the rotary disk 2 is short.

Grooves are not formed in parts of the lower surface 1*b* of the stationary disk 1A in which coin sorting guides 15*a* and 15*b* are formed.

As shown in FIG. 14, a superposed coin returning part 13 is formed contiguously with an inlet opening 1*a* in a region corresponding to the boundary between the large-coin passage section 10*a* and the medium-coin passage section 10*b*. The superposed coin returning part 13 deals with superposed coins that passed stairs 12*a* and 12*b* without being separated. The upstream and the downstream side of the superposed coin returning part 13 are limited by an upstream shoulder portion 13*a* and a downstream shoulder portion 13*b*, respectively.

The upstream shoulder portion 13*a* is formed in a height smaller than the thickness of the thinnest coins (FIG. 17) to permit only the lower one, i.e., the one on the side of the rotary disk 2, of two superposed coins to pass toward the inlet opening 1*a*. The downstream step 13*b* guides a coin passed by the upstream shoulder portion 13*a* toward the inlet opening 1*a*.

The operation and effect of the first embodiment and the first modification will be additionally described with reference to FIGS. 14 and 15.

Figure 15:
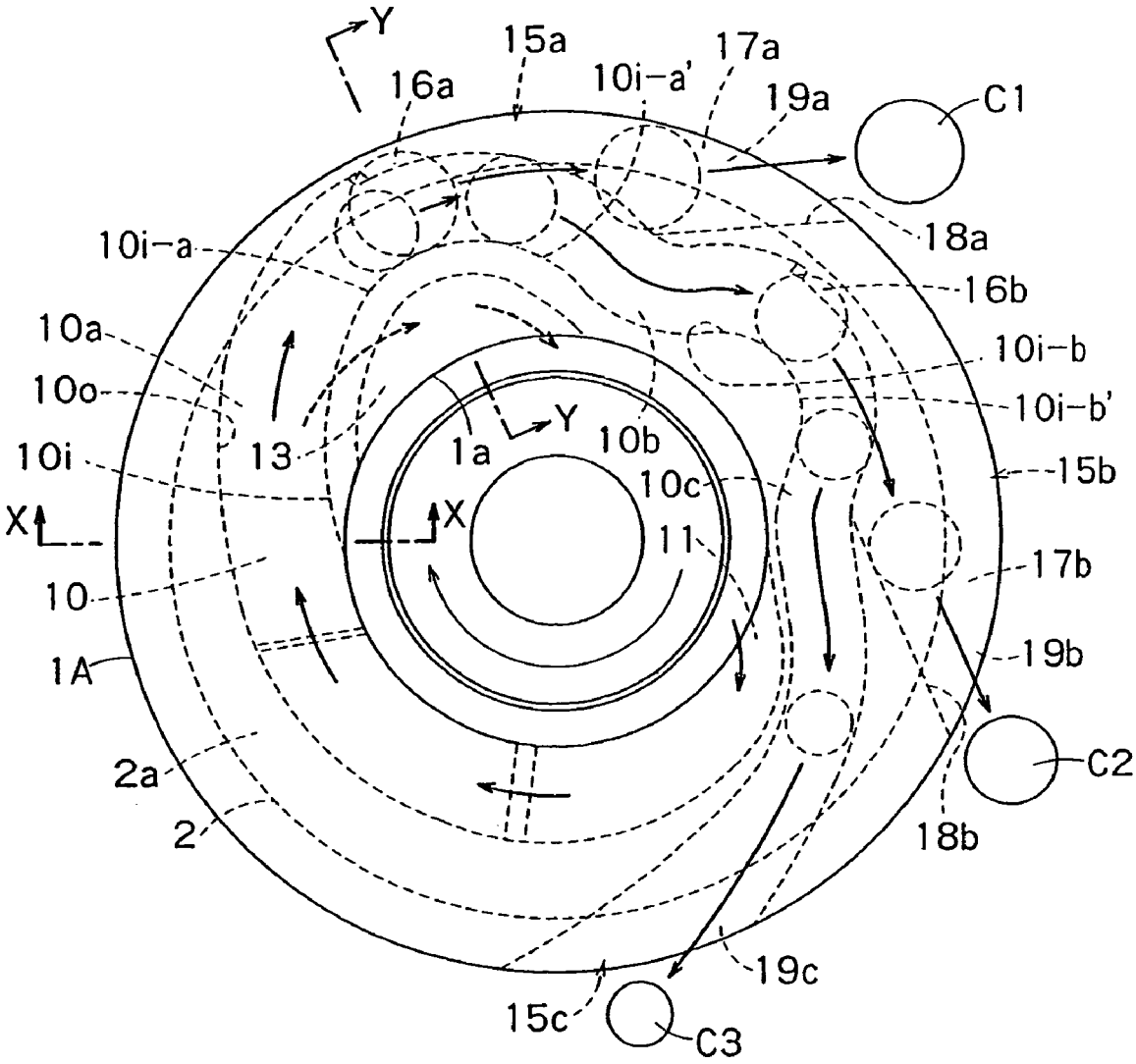
FIG. 15 is a view, similar to FIG. 7, of the parts shown in FIG. 13.

When the coin sorting apparatus operates for an ordinary coin sorting process, the rotary disk 2 is rotated in the normal direction, i.e., a clockwise direction as viewed in FIG. 15. The outer edges of coins are brought into engagement with the radial inner edge portions 10*i-a* and 10*i-b* of the sections of the coin passage 10 to sort coins by diameter. Thus, this coin sorting operation does not need to use centrifugal force acting on coins, which is essential to conventional coin sorting apparatuses. Therefore, this coin sorting apparatus has a high degree of freedom of selection of the rotating speed of the rotary disk 2, i.e., sorting rate.

Positions of coins moving along the coin passage 10 are limited to a region between the radial inner edge 10*i* and the radial outer edge 10*o* of the coin passage 10. Upstream sections of the coin passage 10 on the upstream side of steps 16*a* and 16*b* extend away from the center of the stationary disk 1A toward the downstream side so as to urge coins radial outward by the radial inner edge 10*i* of the coin passage 10 when the rotary disk 2 is rotated in the normal direction, so that the coins engage the radial inner edge portions 10*i-a* and 10*i-b*.

Downstream sections of the coin passage 10 on the downstream side of the steps 16*a* and 16*b* approach the center of the stationary disk 1A toward the downstream side. Therefore, when the rotary disk 2 is rotated in the reverse direction, the radial inner edge 10*i* of the upstream sections of the coin passage 10 (upstream sections of the coin passage 10 with respect to the direction of reverse rotation) urges coins radially outward to make the coins engage the radial inner edge portions 10*i-a*' and 10*i-b*'.

Consequently, even if the rotary disk 2 is rotated in the normal direction after having been reversed, it is insured that the outer edges of coins are in contact with the radial inner edge portions 10*i-a* and 10*i-b*. Therefore the normal sorting operation can be continued even if the rotary disk 2 is rotated in the normal direction after having been reversed. Thus, when the coin passage 10 is jammed with coins while the rotary disk 2 is rotating in the normal direction for the coin sorting operation and the rotary disk 2 is stopped, the rotation of the rotary disk 2 in the normal direction for the coin sorting operation can be resumed after temporarily reversing the rotary disk 2 and clearing the clogged coin passage 10.

Figure 19:
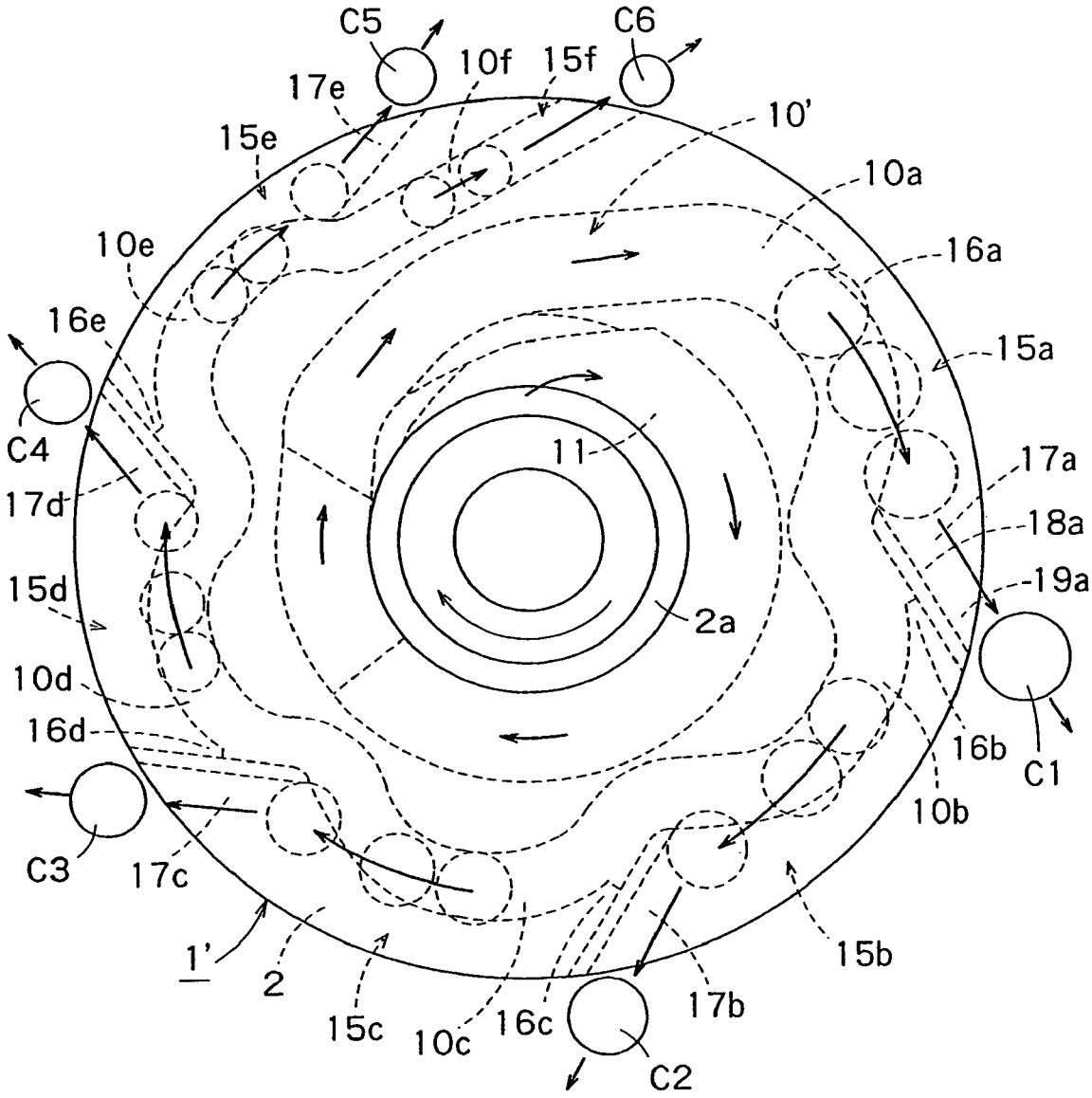
FIG. 19 is a view, similar to FIG. 7, of essential parts of a coin sorting apparatus in a second modification of the coin sorting apparatus in the first embodiment.

(2) Referring to FIG. 19 showing essential parts of a coin sorting apparatus in a second modification of the coin sorting apparatus in the first embodiment, a stationary disk 1' is provided with a coin passage 10' and six coin sorting guides 15*a* to 15*f* arranged around the coin passage 10'. The coin sorting guides 15*a* to 15*e* have steps 16*a* to 16*e* corresponding to the respective diameters of six different coins C1 to C6, and ejecting passages 17*a* to 17*e* including guide edges 18*a* to 18*e* and outlets 19*a* to 19*e*, respectively. In FIG. 19, the coins C1 to C3 are not the large coin C1, the medium coin C2 and the small coin C3 mentioned in the description of the first embodiment, and matters signified by subscripts a, b and c are different from those signified by subscripts a, b and c used in the description of the first embodiment.

While the coin sorting apparatus in the first embodiment sorts coins by diameter into three groups, the coin sorting apparatus in the first modification is able to sort coins into six groups. For example, sorting coins respectively having six different diameters by diameter into three groups is rough sorting. The coin sorting apparatus in the first modification is capable of sorting coins of six denominations by denomination into six groups. Coins can be sorted by diameter not only into three or six groups, but also can be sorted into an optional number of groups by providing the stationary disk 1' with a desired number of coin sorting guides.

Figure 20:
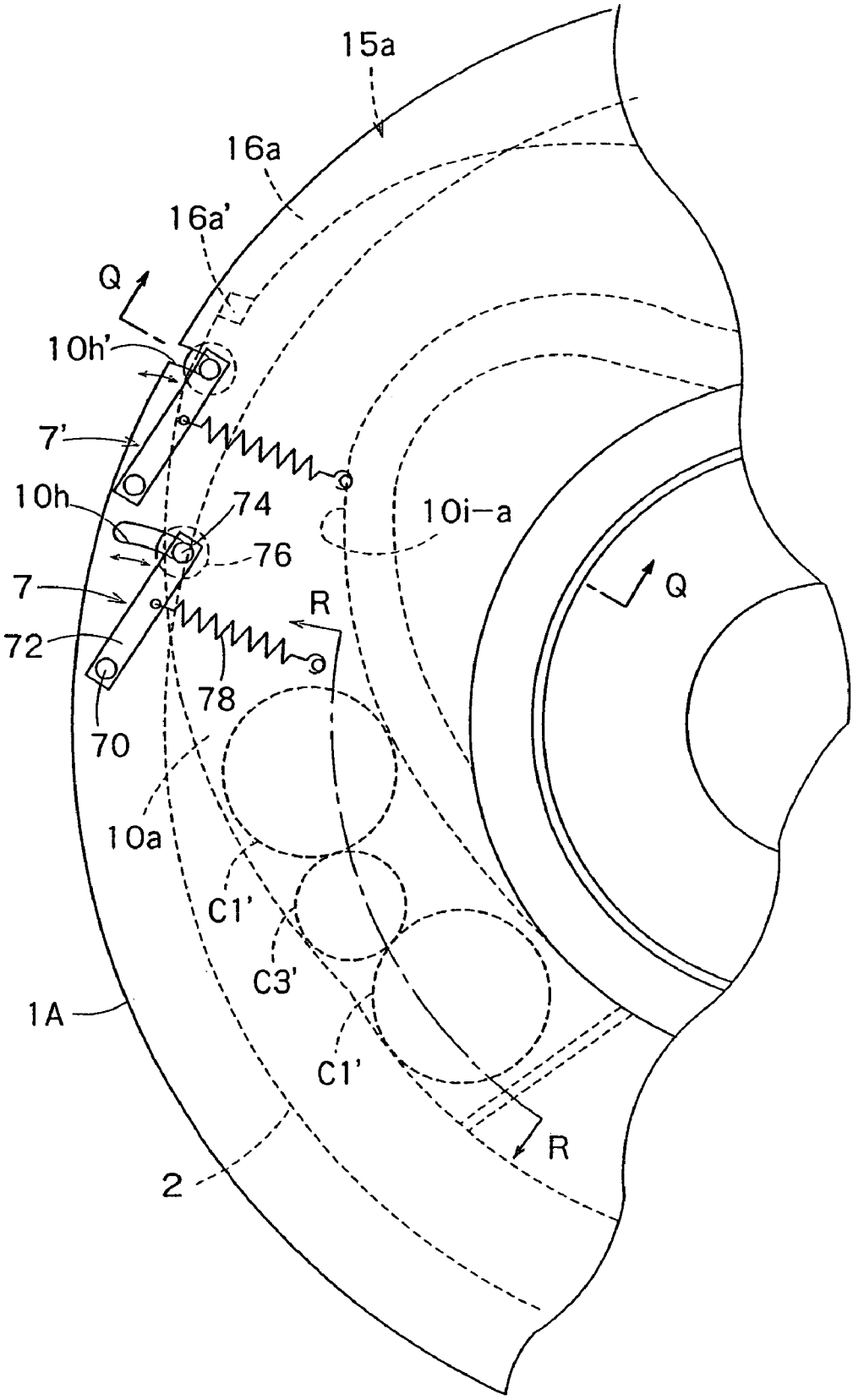
FIG. 20 is a view, similar to FIG. 7, of essential parts of a coin sorting apparatus in a third modification of the coin sorting apparatus in the first embodiment.
Figure 21:
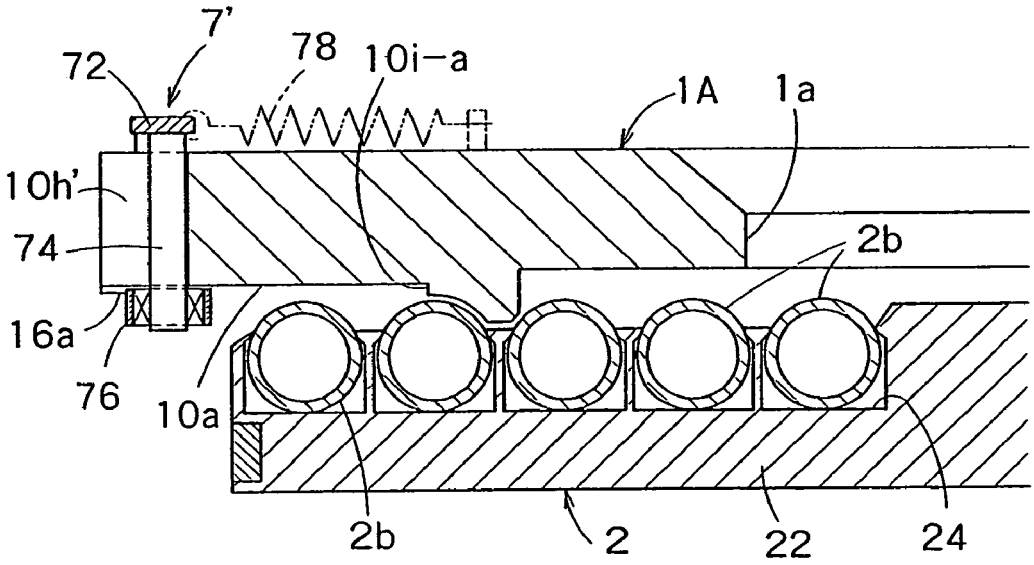
FIG. 21 is a sectional view taken on line Q—Q in FIG. 20.
Figure 22:
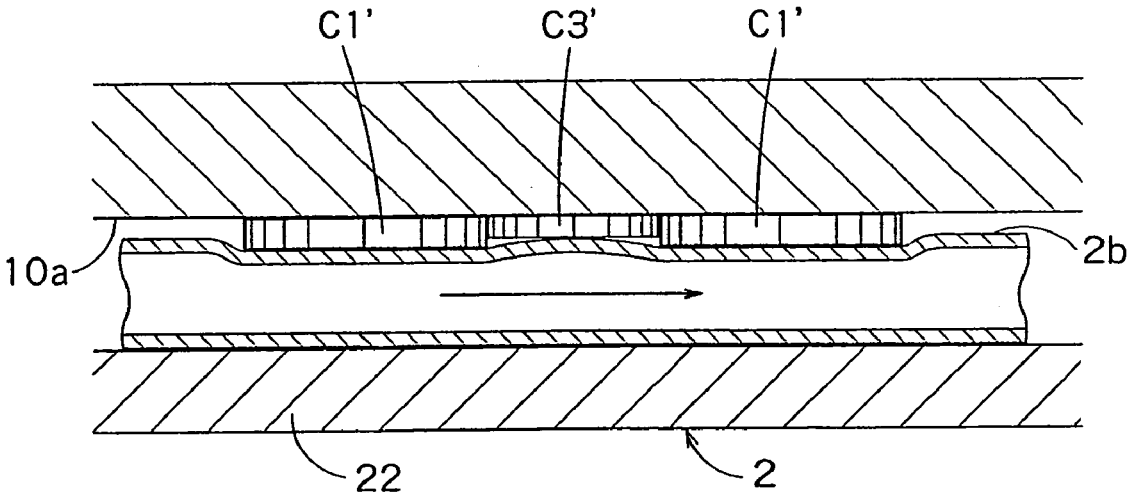
FIG. 22 is a sectional view taken on line R—R in FIG. 20.

(3) Referring to FIGS. 20 to 22 showing essential parts of a coin sorting apparatus in a third modification of the coin sorting apparatus in the first embodiment, a stationary disk 1A has a coin passage having a large-coin passage section 10*a* and a step 16*a*, and provided with pressing devices (pressing means) 7 and 7' disposed on the upstream side of the step 16*a* to press a coin toward the radial inner edge portion 10*i-a* of the coin passage.

Each of the pressing devices 7 and 7' includes a lever 72 pivotally supported by a shaft 70 on the upper surface of the stationary disk 1A, a supporting rod 74 attached to the free end of the lever 72 and a roller 76 (e.g. bearing assembly) supported on the lower end of the supporting rod 74. The supporting rods 74 are extended through slots 10*h* and 10*h*' formed in the stationary disk 1A so as to project from the lower surface of the stationary disk 1A.

Each of the pressing devices 7 and 7' further includes a coil spring 78 forcing the lever 72 to turn toward the radial inner edge portion 10*i-a*. Normally, each coil spring 78 forces the lever 72 to turn so that the roller 76 enters the large-coin passage section 10*a*. When a coin engages the roller 76, the coin shifts the roller 76 radial outward by a distance depending on the diameter of the coin, against the resilience of the coil spring 78.

In this modification, the rollers 76 of the pressing devices 7 and 7' engage coins and urge the coins toward the radial inner edge portion 10*i-a* of the coin passage to ensure that the edges of all the coins engage the radial inner edge portion 10*i-a* of the coin passage. For example, when a thin, small coin C3' lies between thick, large coins C1' as shown in FIGS. 20 and 22, the small coin C3' cannot be firmly held by an elastic belt 2*b* (FIG. 22) and hence it is possible that the small coin C3' move radially outward. In such a state, the small coin C3' can be surely brought into contact with the radial inner edge portion 10*i-a* by the pressing devices 7 and 7'.

Although the pressing devices 7 and 7' are disposed on the upstream side of the step 16*a* on the assumption that coins to be sorted include large coins C1', pressing members 7 and 7' similar to those pressing devices 7 and 7' may be disposed on the upstream side of a step 16*b* for sorting medium coins, when necessary. The stationary disk 1A does not need necessarily to be provided with the two pressing devices 7 and 7', and pressing devices provided with plate springs or the like may be used instead of the pressing devices 7 and 7' provided with the levers.

Figure 23:
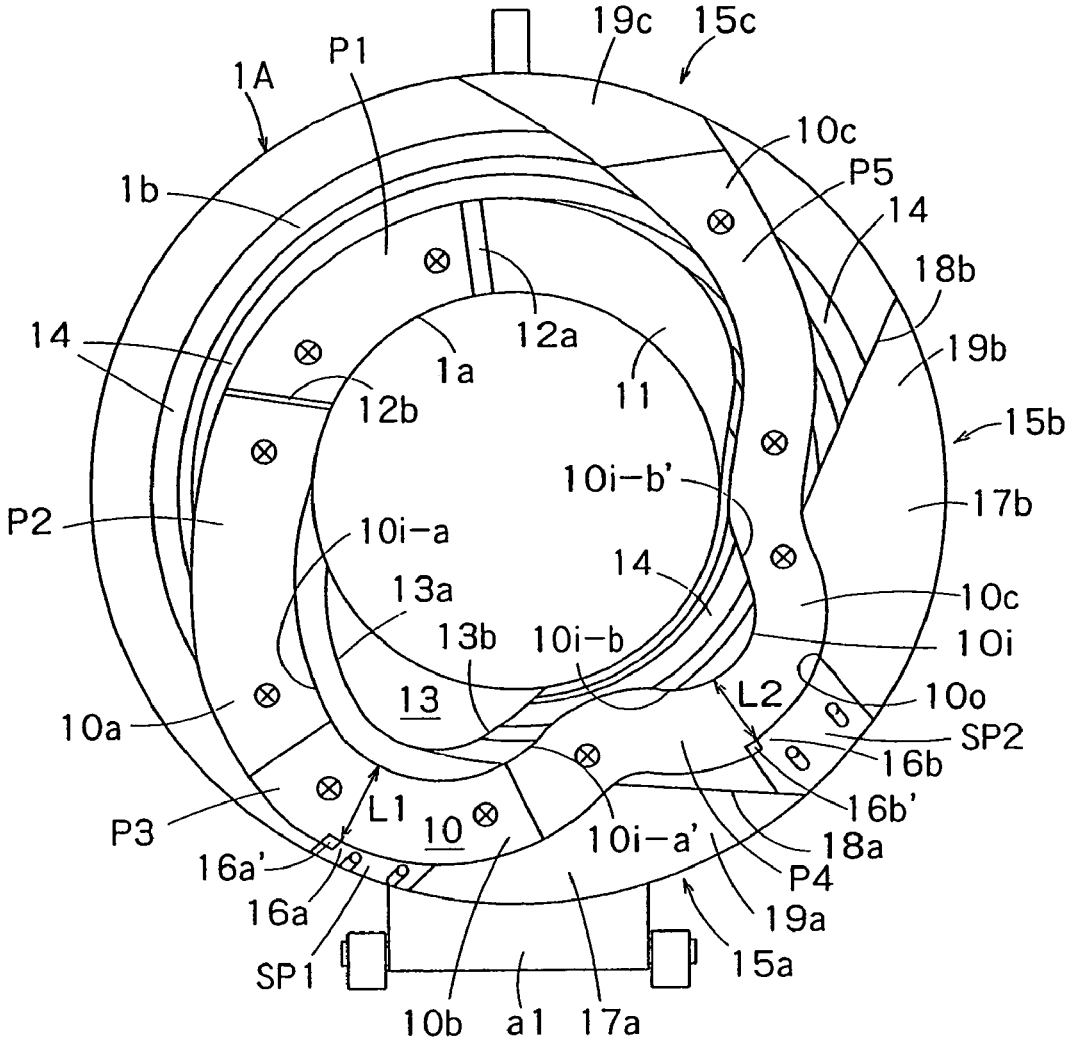
FIG. 23 is a view, similar to FIG. 6, of essential parts of a coin sorting apparatus in a fourth modification of the coin sorting apparatus in the first embodiment.
Figure 24:
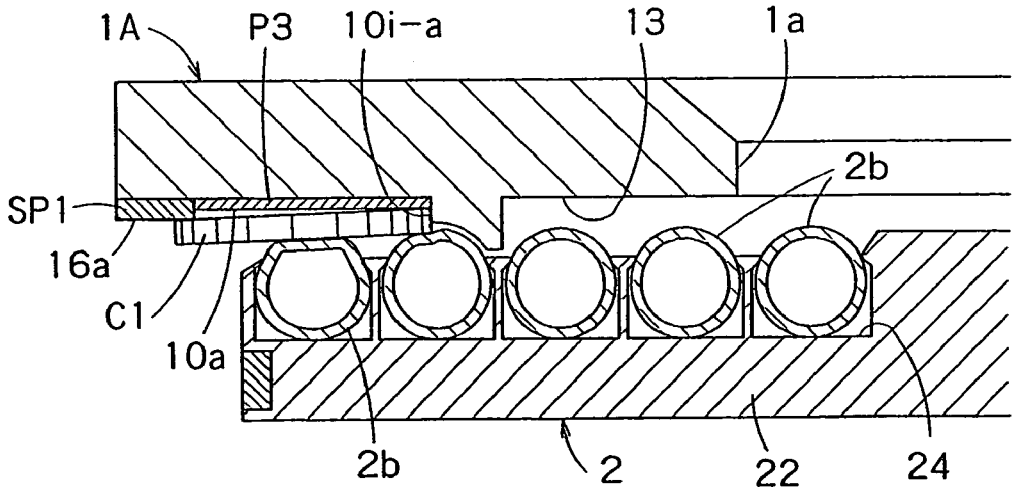
FIG. 24 is a view, similar to FIG. 18, of the parts shown in FIG. 23.

(4) Referring to FIGS. 23 to 24 showing essential parts of a coin sorting apparatus in a fourth modification of the coin sorting apparatus in the first embodiment, the coin sorting apparatus has separate passage plates P1 to P5 forming bottom walls of passage sections 10*a* to 10*c* of a coin passage 10, step plates (step-forming plates) SP1 and SP2 respectively forming steps 16*a* and 16*b*, and a main body of a stationary disk 1A. The passage plates P1 to P5 and the step plates SP1 and SP2 are attached to the main body of the stationary disk 1A. FIG. 24 shows the passage plate P3 and the step plate SP1 in a sectional view.

The passage plates P1 to P5 are attached detachably to the main body of the stationary disk 1A with, for example, screws. Therefore, the passage plates P1 to P5, and the stationary disk 1A can be formed of different materials and can be easily subjected to different processes, respectively. For example, only the passage plates P1 to P5 may be formed of an abrasion-resistant material and may be treated by a hardening process. The coin passage 10 may be formed of an optional number of passage plates or may be formed of a single passage plate.

The positions of the step plates SP1 and SP2 on the stationary disk 1A with respect to the width of the coin passage 10 are adjustable. The widths L1 and L2 of the coin passage 10 corresponding to the steps 16*a* and 16*b* are adjusted so that the widths L1 and L2 conform to the diameter of coins to be sorted. The reliability and smoothness of a coin sorting process can be enhanced by finely adjusting the widths L1 and L2 of the coin passage 10. The step plates SP1 and SP2, similarly to the passage plates P1 to P5, may be formed of an abrasion-resistant material separately from the stationary disk 1A and may be subjected to a hardening process.

Figure 25:
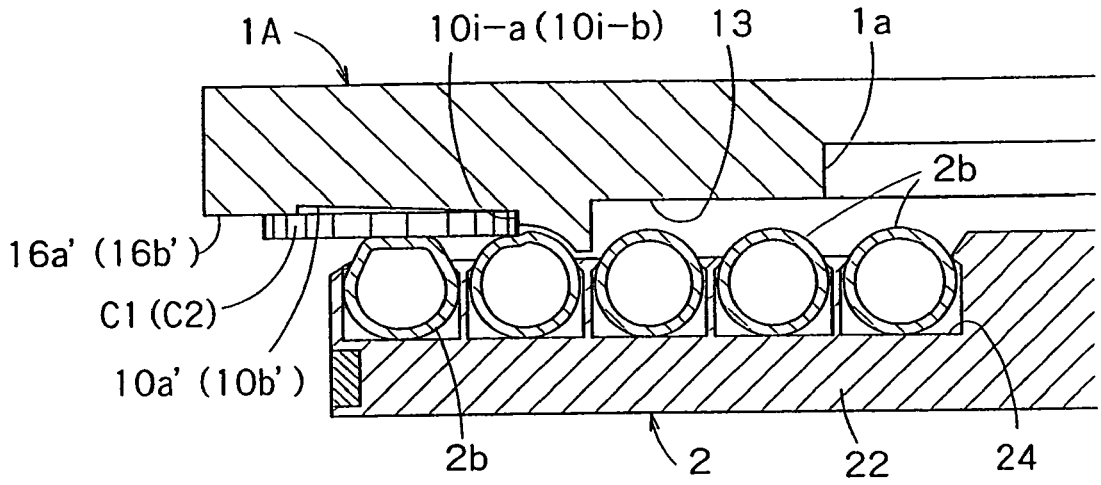
FIG. 25 is a view, similar to FIG. 18, of essential parts of a coin sorting apparatus in a fifth modification of the coin sorting apparatus in the first embodiment.

(5) Referring to FIG. 25 showing essential parts of a coin sorting apparatus in a fifth modification of the coin sorting apparatus in the first embodiment, a stationary disk 1A is provided with a coin passage 10 including passage sections 10*a*' and 10*b*' having bottom surfaces sloping down along the width of the passage sections 10*a*' and 10*b*' toward steps 16*a* and 16*b* so that radial inner edge portions 10*i-a* and 10*i-b*, and steps 16*a* and 16*b* are substantially at the same level. Thus, coins C1 and C2 lie in a substantially horizontal position after the same have run onto the steps 16*a* and 16*b*. In FIG. 25, only the passage section 10*a*', the step 16*a* and the large coin C1 are shown.

The fifth modification is capable of preventing the coins C1 and C2 from being caught in coin sorting guides 15*a* and 15*b* due to tilting and of smoothly ejecting the coins C1 and C2. Smaller coins having smaller diameters are more liable to be caught in the coin sorting guides due to tilting. Therefore, only the bottom surface of the passage section for the medium coin C2 may slope down toward the step 16*b*.

(6) FIGS. 26 to 35 show essential parts of a coin sorting apparatus in a sixth modification of the coin sorting apparatus in the first embodiment. This coin sorting apparatus has a stationary disk 1" (FIG. 26) provided with a foreign matter sorting means 8, and a rotary disk 2" (FIG. 28) provided with a laminated resilient member 200.

The foreign matter sorting means 8 is disposed on the stationary disk 1" at a position corresponding to a downstream end of a coin passage 10 formed in the stationary disk ". The foreign matter sorting means 8 ejects selectively foreign matters F (FIG. 27) thinner than the thinnest coin. The foreign matters F are, for example, paper clips and staples for a stapler. As shown in FIGS. 26, 27 and 32 to 35, the foreign matter sorting means 8 has a foreign matter passage 80 branched off from a small-coin passage section 10*c* and terminating to the outside of the stationary disk 1". A stepped gate 82 is formed at the junction of the small-coin passage section 10*c* and the foreign matter passage 80.

The foreign matter passage 80 extends in a direction substantially perpendicularly to the radius of the stationary disk 1" (tangential direction). The small-coin passage section 10*c* extends obliquely to the foreign matter passage 80 toward the periphery of the stationary disk 1". A gap 84 of a thickness greater than those of foreign matters F and smaller than that of the thinnest coin, i.e., a small coin C3, is formed between the stepped gate 82 and the resilient member 200 of the rotary disk 2'.

Figure 27:
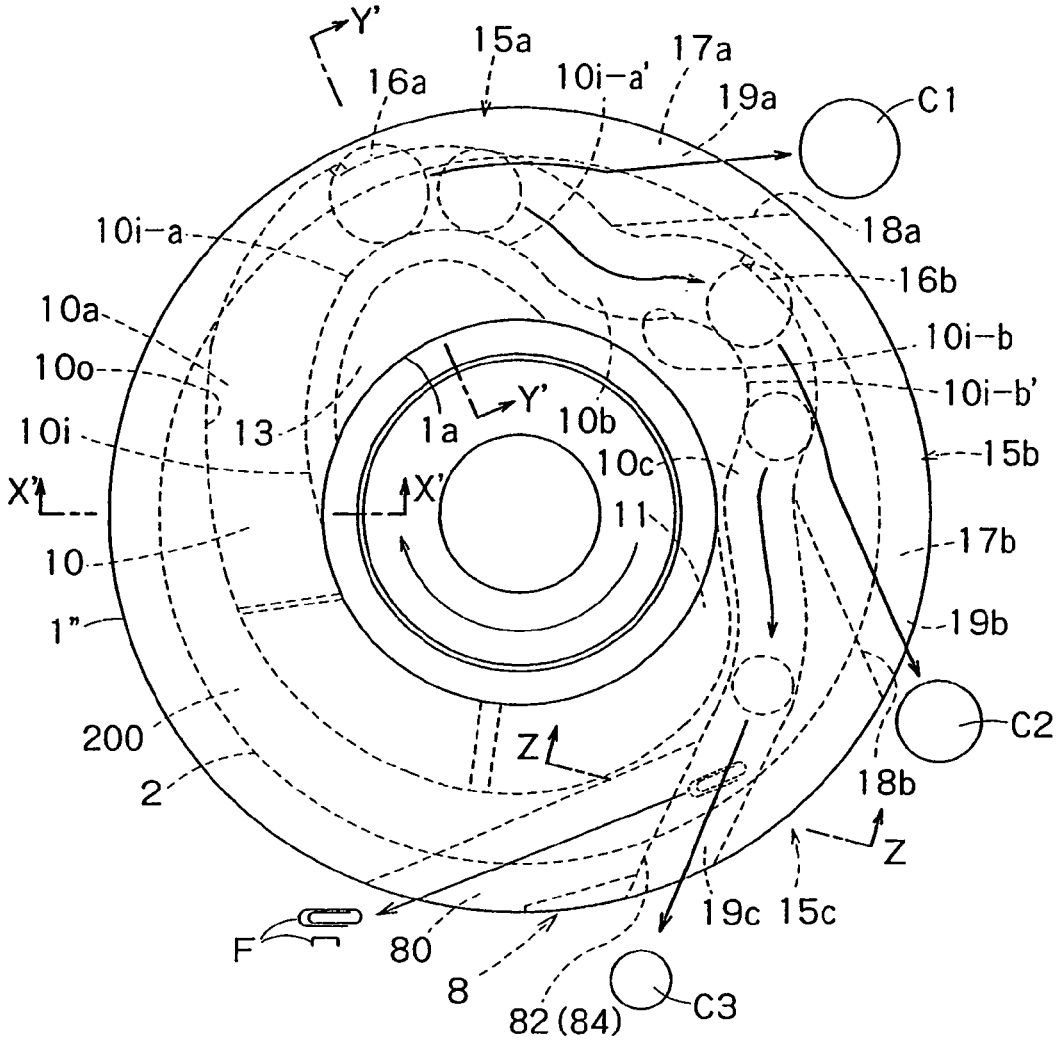
FIG. 27 is a view, similar to FIG. 15, of the parts shown in FIG. 26.

As shown in FIG. 27, small coins C3 and foreign matters F move through the small-coin passage section 10*c*. Since the small coins C3 are unable to pass the gate 82, the small coins C3 are forced through the small-coin passage section 10*c* into an outlet 19*c*. The foreign matters F thinner than the small coins C3 are caused to move tangentially by the rotation of the rotary disk 2'. Consequently, the foreign matters F pass the gate 82 and enter the foreign matter passage 80, so that the foreign matters F are separated from the small coins C3. Then, the foreign matters F are ejected from the foreign matter passage 80 outside the stationary disk 1". Thus, the foreign matters F and coins C1 to C3 can be collected separately.

Figure 34:
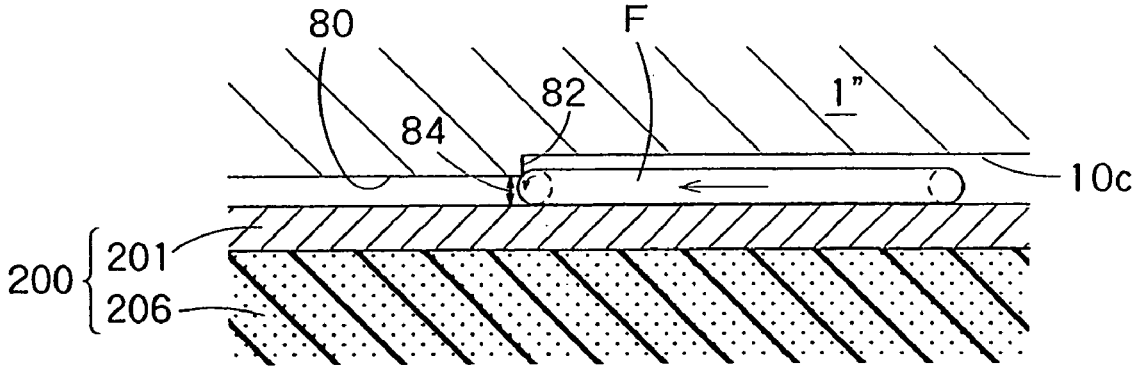
FIG. 34 is a view, similar to FIG. 33, showing the relation between a particular foreign matter and a step.
Figure 35:
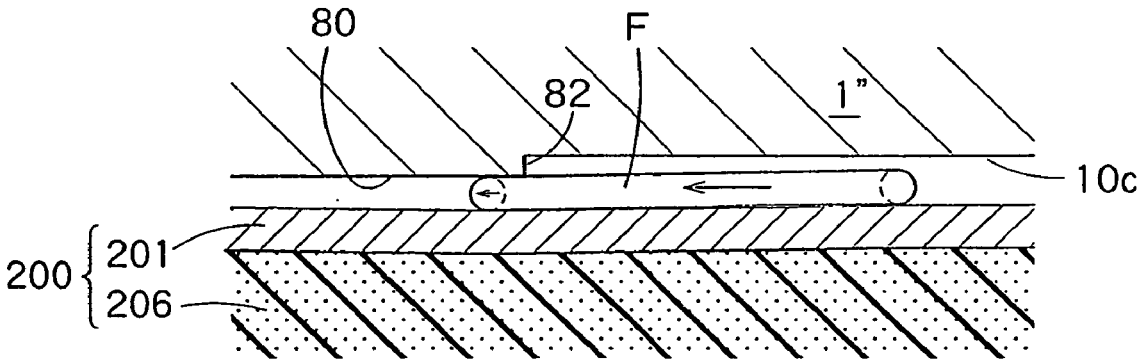
FIG. 35 is a view, similar to FIG. 34, showing a state where the particular foreign matter is passed.

As shown in FIG. 34 and 35, some foreign matters F having round edges, such as paper clips, are able to pass by the gate 82 even if the thickness thereof is slightly greater than the gap 84, because the resilient member 200 is deformable. Therefore, the thickness of the gap 84 is determined taking the deformation of the resilient member 200 into consideration. For example, supposing that the thickness of the thinnest coin C3 is 1.2 mm, the thickness of the gap 84 is on the order of 0.8 mm.

Figure 28:
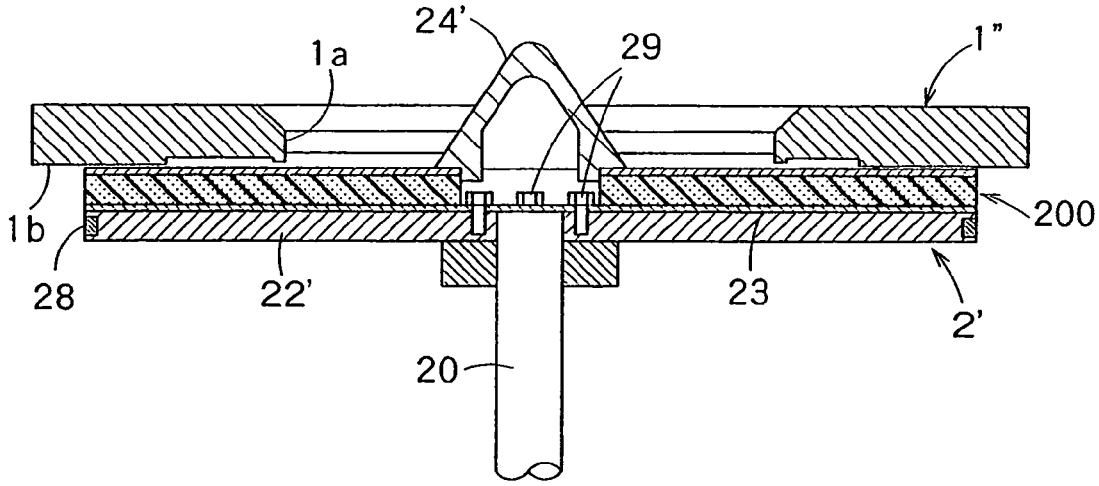
FIG. 28 is a view, similar to FIG. 13, of the parts shown in FIG. 26.
Figure 29:
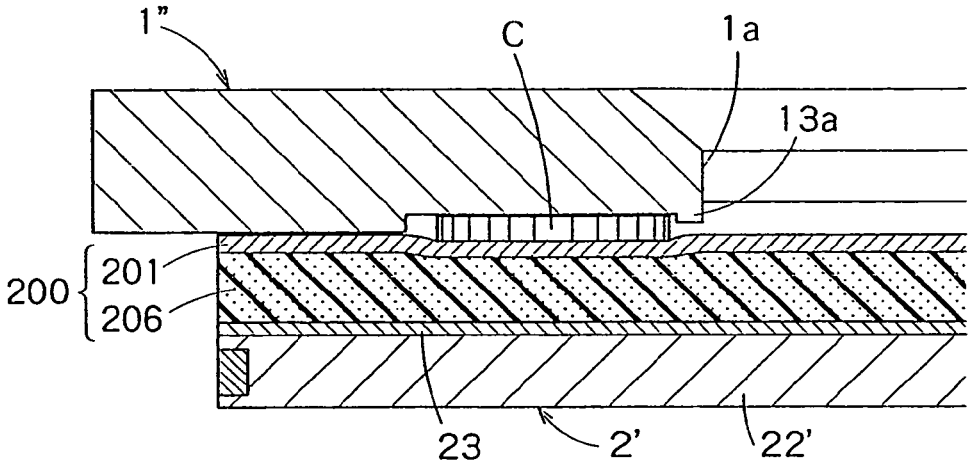
FIG. 29 is a view (a sectional view taken on line X'—X' in FIG. 27), corresponding to FIG. 16, of the parts shown in FIG. 26.
Figure 30:
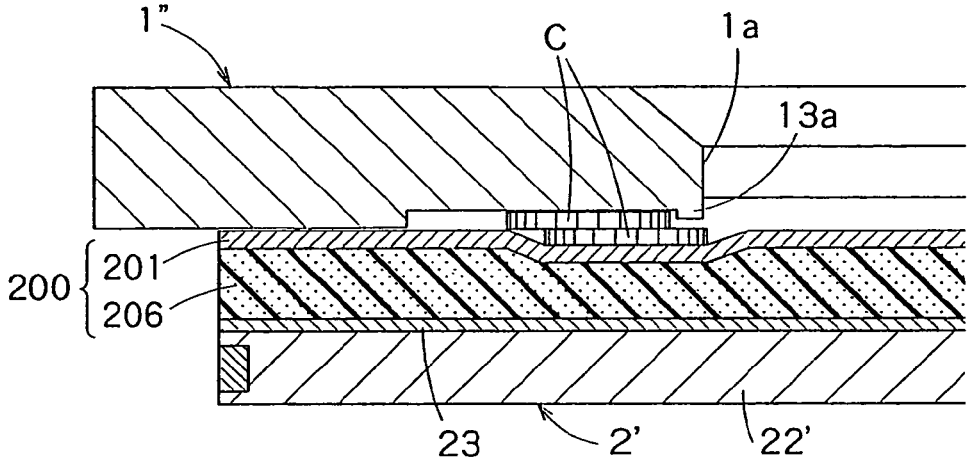
FIG. 30 is a view (a sectional view taken on line X'—X' in FIG. 27), corresponding to FIG. 17, of the parts shown in FIG. 26.
Figure 31:
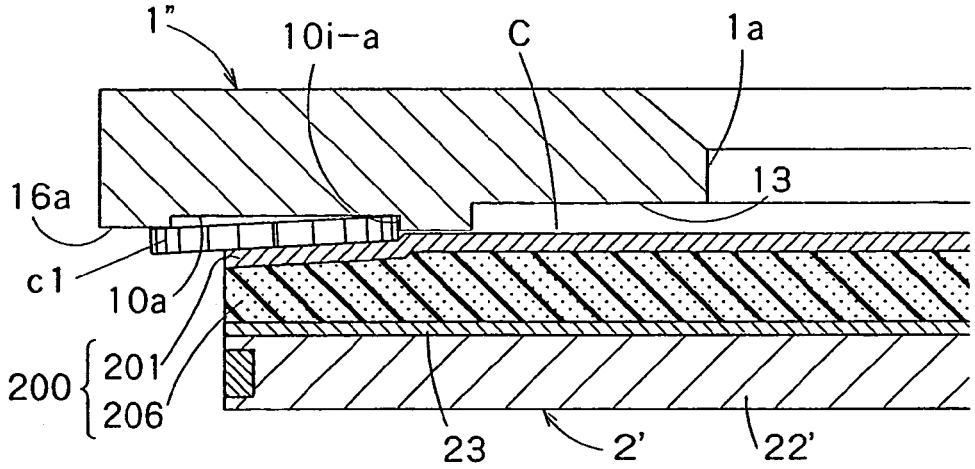
FIG. 31 is a view (a sectional view taken on line Y'—Y' in FIG. 27), similar to FIG. 18, of the parts shown in FIG. 26.
Figure 32:
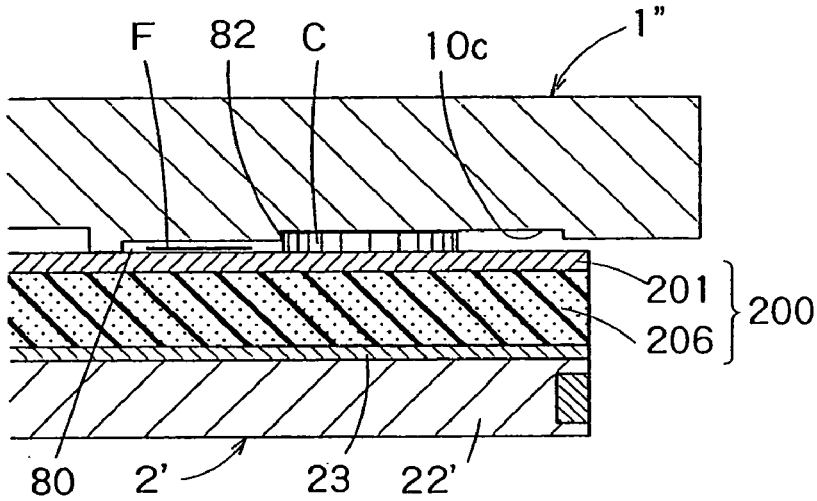
FIG. 32 is a sectional view taken on line Z—Z in FIG. 17.
Figure 33:
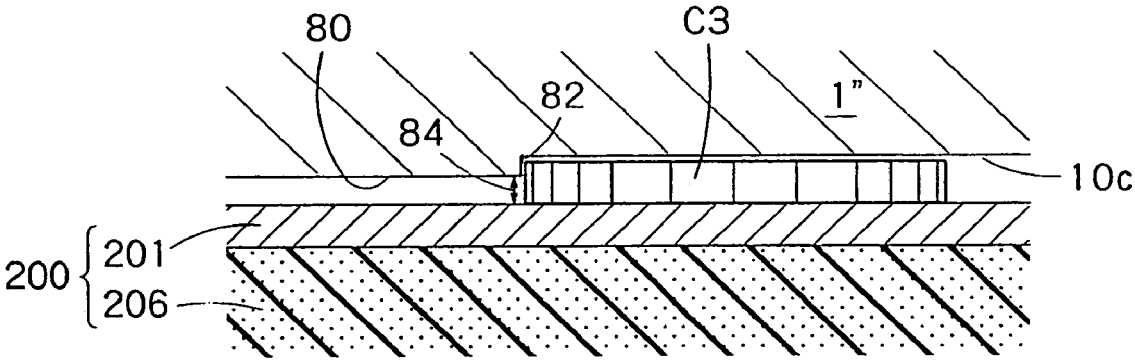
FIG. 33 is an enlarged view of a part of FIG. 32.

As shown in FIG. 28, the rotary disk 2' has a disk body 22', and the laminated resilient member 200 is attached to the flat upper surface of the disk body 22'. As shown in FIGS. 29 to 32, the resilient member 200 has a thin urethane rubber layer 201, and a porous resilient layer 201 underlying the urethane rubber layer 201. Preferably, the porous resilient layer 206 is formed of rubber sponge (foam rubber). A metal plate 23 is attached to the lower surface of the resilient member 20, and the metal plate 23 is fastened detachably to the disk body 22' with screws 29 (FIG. 28).

Figure 26:
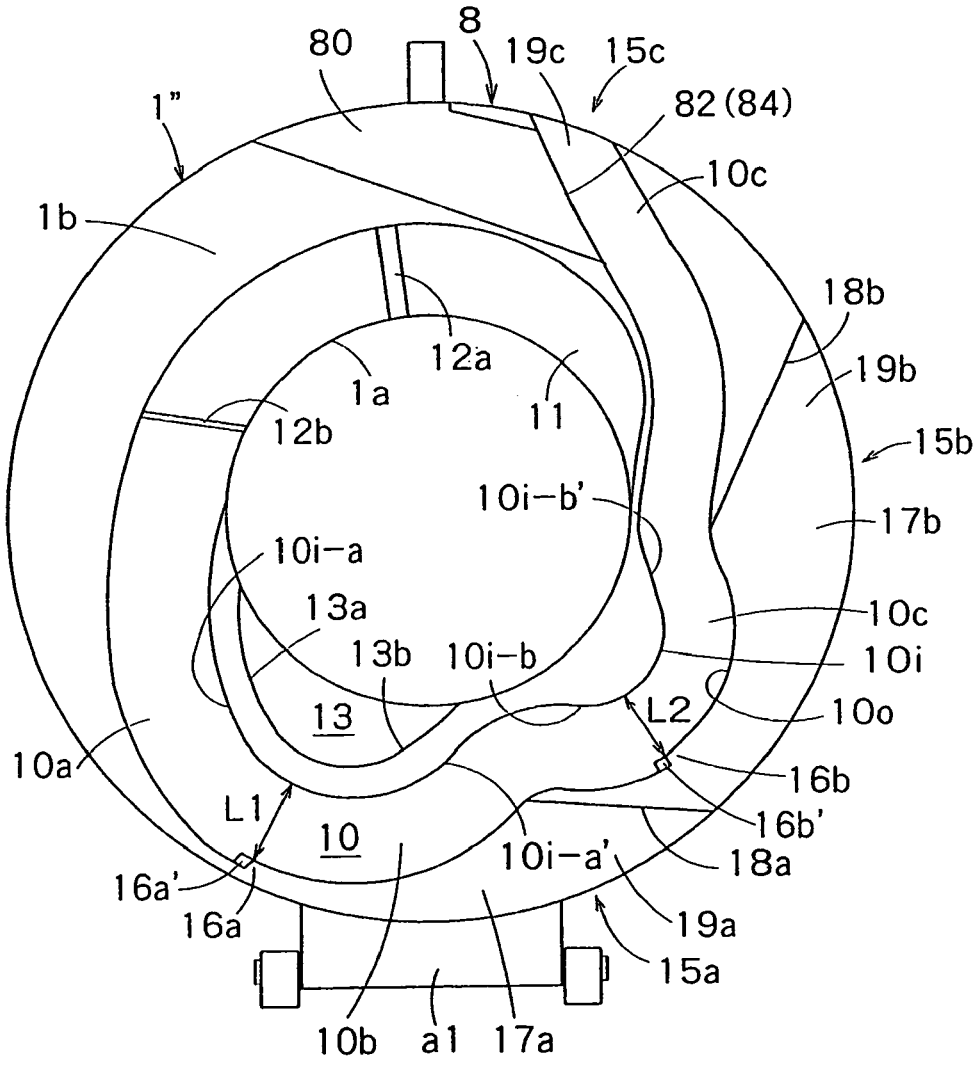
FIG. 26 is a view, similar to FIG. 14, of essential parts of a coin sorting apparatus in a sixth modification of the coin sorting apparatus in the first embodiment.
Figure 36:
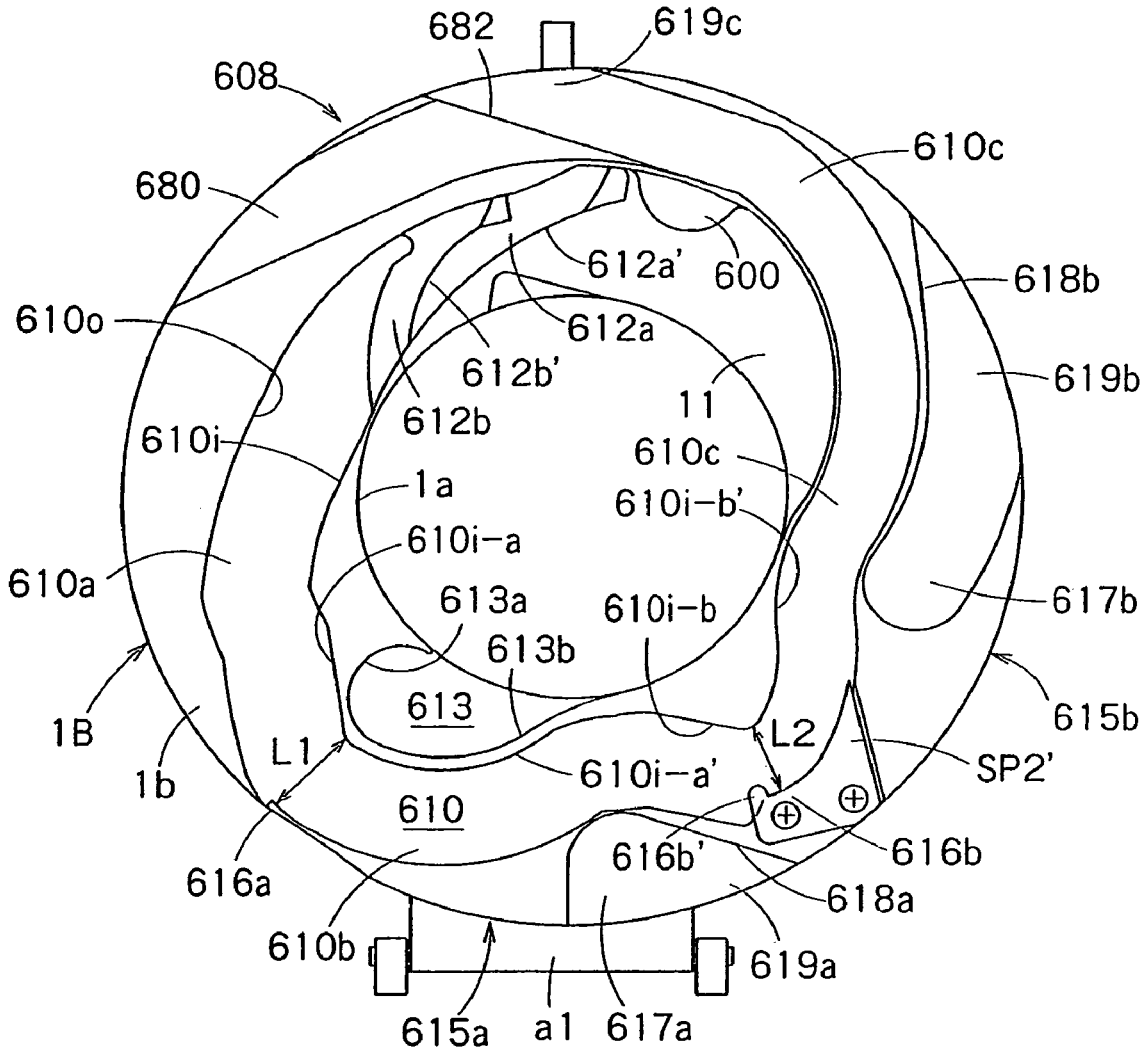
FIG. 36 is a view similar to FIG. 6, of essential parts of a coin sorting apparatus in a seventh modification of the coin sorting apparatus in the first embodiment.

(7) FIG. 36 shows essential parts of a coin sorting apparatus in a seventh modification of the coin sorting apparatus in the first embodiment. This coin sorting apparatus has a stationary disk 1B differing in details in shape from the stationary disk 1" shown in FIG. 26 employed in the coin sorting apparatus in the sixth modification described in (6). In FIG. 36, parts like those of the stationary disk 1" shown in FIG. 26 are denoted by the same reference characters, and parts corresponding to those of the stationary disk 1" shown in FIG. 26 are denoted by reference numerals produced by adding 600 to those denoting the parts of the stationary disk 1" shown in FIG. 26. Principal differences between the stationary disk 1B and the stationary disk 1" shown in FIG. 26 will be described.

Referring to FIG. 36, a coin entrance 11 is provided with a semicircular protrusion 600. The protrusion 600 pushes the upper one (a coin on the side of the stationary disk 1B) of two superposed coins back toward an inlet opening 1*a*.

The stationary disk 1B is provided with stairs 612*a* and 612*b* respectively having guide edges 612*a*' and 612*b*' curving toward the inlet opening 1*a*. The guide edges 612*a*' and 612*b*' guide coins which are apart from the radial outer edge 610*o* of a coins passage 610 and the upper one of superposed coins toward the inlet opening 1*a*. The second stair 612*b* projects toward the lower surface 1*b* of the stationary disk 1B more than the surface of a large-coin passage section 610*a* extending on the downstream side of the second step 612*b* to form shoulders on the upstream and the downstream side of the second step 612*b*.

In the stationary disk 1B, a step 616*b* formed in a medium-coin sorting guide 615*b* is formed by an adjustable step plate SP2' similar to the step plate SP2 shown in FIG. 23. The position of the step plate SP2' is adjustable. A ramp 616*b*' formed in the step plate SP2' projects into a small-coin passage section 610*c* having a width L2. Small coins C3 having a diameter smaller than the width L2 of the small-coin passage section 610*c* are able to climb over a projecting part of the ramp 616*b*' and to advance from a medium-coin passage section 610*b* into the small-coin passage section 610*c*.

The stationary disk 1B is provided with a superposed coin returning part 613, and ejecting passages 617*a* and 617*b*, which are somewhat different in shape from but substantially the same in function as those of the stationary disk 1" shown in FIG. 26.

Second Embodiment

A coin sorting apparatus in a second embodiment according to the present invention will be described with reference to FIGS. 37 to 40. The coin sorting apparatus in the second embodiment is provided with a rotary disk 2' basically the same as the rotary disk 2' (FIG. 28) of the coin sorting apparatus in the sixth modification of the first embodiment.

Figure 37:
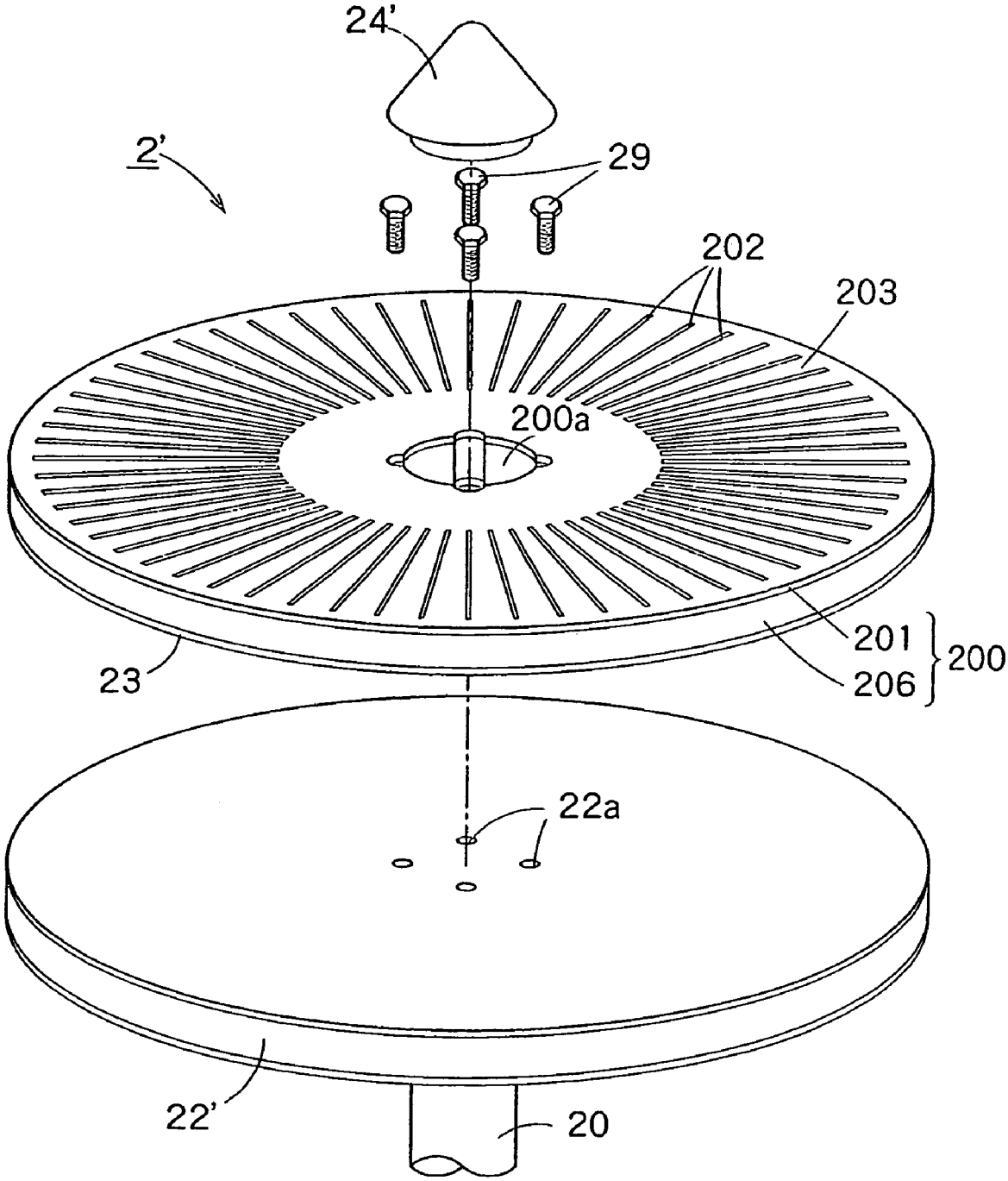
FIG. 37 is an exploded perspective view of a rotary disk included in a coin sorting apparatus in a second embodiment according to the present invention.

Referring to FIG. 37, the rotary disk 2' has a disk body 22' supported by a shaft 20 for rotation, a resilient member 200 having the shape of a laminated disk and attached to the upper surface of the disk body 22'. As shown in FIGS. 37 and 38, the resilient member 200 has a thin urethane rubber layer 201 and a porous resilient layer 206 underlying the urethane rubber layer 201. Preferably, the porous resilient layer 206 is formed of rubber sponge (foam rubber) having a comparatively high impact resilience of, for example, a compression load in the range of about 630 to about 950 g/cm$^2$ at 25% compression.

As shown in FIGS. 37 to 39*b*, a plurality of radial grooves 202 are formed in the outer surface 203 of the urethane rubber layer 201. The radial grooves 202 are arranged so that circumferential intervals I (FIG. 39*b*) of the outer ends of the radial grooves 202 on the periphery of the resilient member 200 are smaller than the diameter of the smallest coin.

As shown in FIGS. 39*a* and 39*b*, a part of some of the radial grooves 202 is formed in a depth smaller than other parts of the radial groove 202 to form a wear indicator 204. For example, the urethane rubber layer 201 has a thickness of about 1 mm, the depth D2 of the part of the radial groove 202 corresponding to the wear indicator 204 is about 0.1 mm and the depth D1 of other parts of the radial groove 202 is 0.3 mm.

The urethane rubber layer 201 provided with the radial grooves 202 is formed of a thermoplastic urethane rubber and can be easily manufactured by injection molding.

As shown in FIGS. 37 and 38, a circular metal plate 23 is attached to the lower surface of the resilient member 200. The metal plate 23 is fastened to the disk body 22' with four screws 29 to attach the resilient member 200 detachably to the disk body 22'. A center hole 200*a* is formed in the resilient member 200 to receive the heads of the screws 29 therein. The center hole 200*a* is covered with a conical member 24' for preventing coins dropped onto the rotary disk 2' from accumulating in a central part of the rotary disk 2'. Four threaded holes 22*a* for the four screws 29 are formed in a central part of the disk body 22'.

The resilient member 200 attached to the disk body 22' holds coins together with the stationary disk 1, moves the coins as the rotary disk 2' rotates, and absorbs the variation of the thickness of the gap between the resilient member 200 and the stationary disk 1, and differences in thickness between coins of different denominations (FIG. 40).

The resilient member 200 having an upper surface coated with the urethane rubber layer 201 of the rotary disk 2' of the second embodiment has abrasion resistance higher than those of other resilient members of other synthetic rubbers. Since the radial grooves 202 formed in the outer surface 203 of the urethane rubber layer 201 engage the outer edges of coins C as shown in FIG. 40, the rotary disk 2' is able to exert an increased carrying force on coins C in the rotating direction of the rotary disk 2' without increasing holding force restraining coins C from radial movement.

The plurality of radial grooves 202 formed in the outer surface 203 of the urethane rubber layer 201 enhances the flexibility of the urethane rubber layer 201 (FIG. 40). Therefore, even if coins respectively having different thicknesses are arranged side by side, those coins can be firmly held between the urethane rubber layer 201 and the stationary disk 1. For the reasons stated above, the coin sorting apparatus is capable of performing a reliable coin sorting operation for an extended period of time.

Since the radial grooves 202 are arranged so that the circumferential intervals I of the radial grooves 202 on the periphery of the resilient member 200 are smaller than the diameter of the smallest coin, all the small coins lie on the radial grooves 202 even if the small coins lie successively in the circumferential direction on the resilient member 200, and hence the aforesaid function and effect of the radial grooves 202 can always be exercised. Since the wear indicator 204 is formed in a part of some of the radial grooves 202 in a depth smaller than other parts of the radial groove 202, the bottom surface of the wear indicator 204 appears first as the urethane rubber layer 201 is abraded gradually to provide notification of the abrasion of the urethane rubber layer or to provide information for deciding the time for replacing the resilient member 200 with a new one (FIGS. 39*a* and 39*b*).

Since the resilient member 200 has the porous resilient layer 206 underlying the urethane rubber layer 201, the resilient member 200 is highly compressible and is capable of flexibly dealing with coins respectively having different thicknesses. Since the porous resilient layer 206 is formed of rubber sponge having particularly high resilience among porous resilient materials, the resilient member 200 is capable of surely holding adjacently arranged coins respectively having different thicknesses.

Since the resilient member 200 is attached detachably to the disk body 22' by fastening the metal plate 23 to the disk body 22' with the screws 29 (FIG. 37), the resilient member 200 can be very easily replaced with a new one.

Third Embodiment

A coin receiving system in a third embodiment according to the present invention will be described with reference to FIGS. 41 to 44. The coin receiving system in the third embodiment is provided with a coin sorting apparatus similar to the coin sorting apparatus in the first embodiment. In FIGS. 41 to 44, parts like or corresponding to those of the coin sorting apparatus in the first embodiment shown in FIGS. 1 to 12*b* will be denoted by the same reference characters, and reference will be made to FIGS. 1 to 12*b* when necessary. Description of mechanisms and operations identical with those of the first embodiment will be partly or entirely omitted. The construction, operation, function, effect and modification of the third embodiment will be described in sequence.

[Construction]

The coin receiving system is intended to receive mixed coins including Euro coins of a new currency unit (new coins) and coins of old currency units, such as those of European currencies including DM currency, to be converted into Euro coins. Euro coins are sorted by operations previously described in connection with the first embodiment.

Figure 41:
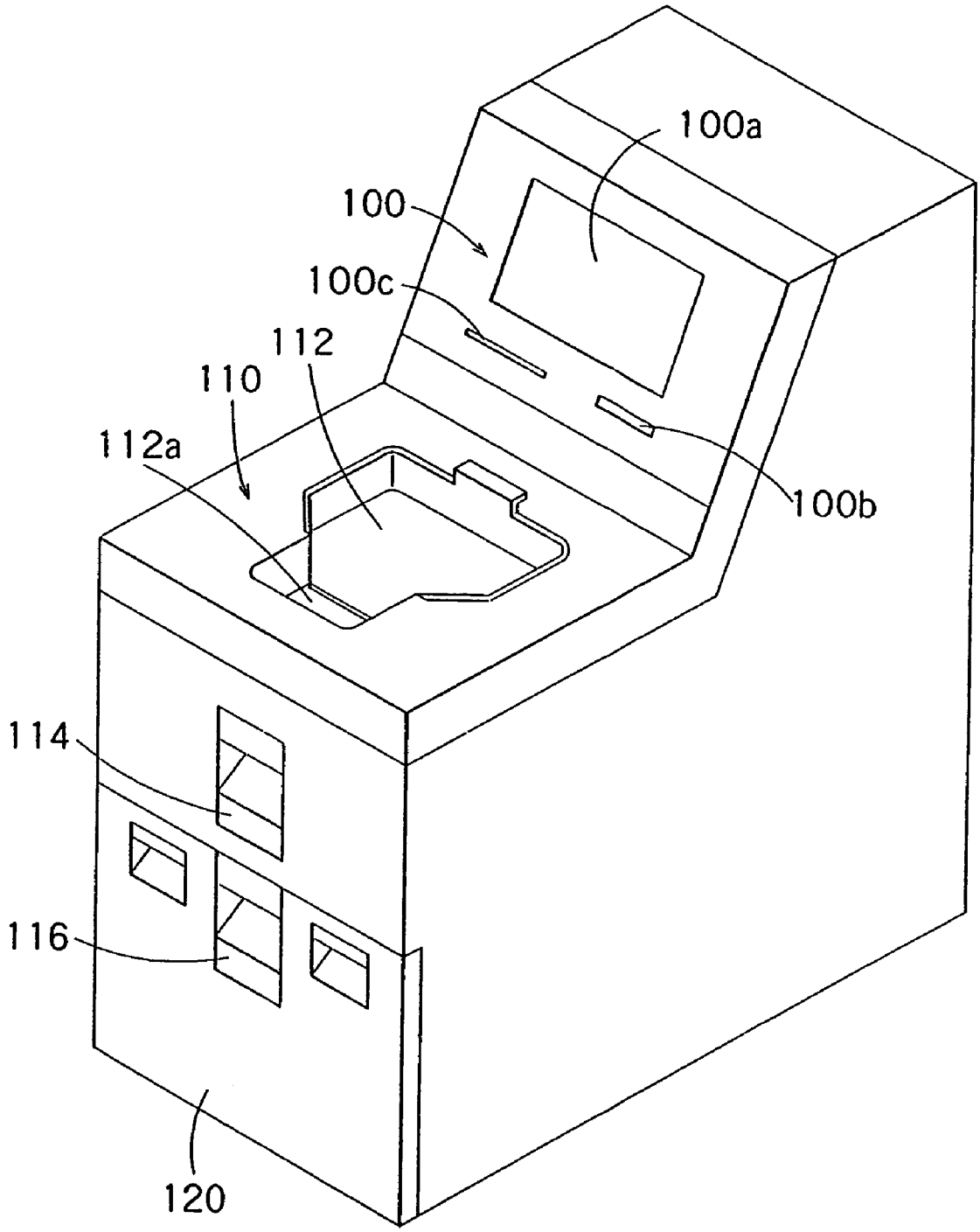
FIG. 41 is a perspective view of a coin receiving system in a third embodiment according to the present invention.

Referring to FIG. 41 showing the appearance of the coin receiving system in the third embodiment, a display/control panel 100*a* consisting of a touch-screen display, a card slot 100*b* and a receipt slot 100*c* are arranged on the front wall of an information processing unit 100.

The coin receiving system has a storage unit 120 having a plurality of coin storing cassettes 124*a* to 124*j*, and temporary storage boxes 130 respectively corresponding to the storing cassettes 124*a* to 124*j* (FIGS. 3 and 4). The storing cassettes 124*a* to 124*h* are new coin storing cassettes (new coin storing unit) each for storing new coins of corresponding denomination, respectively. The coin storing cassettes 124*i* and 124*j* are old coin storing cassettes (old coin storing unit) each for storing old coins of mixed denominations. The temporary storage boxes 130 are divided into those each for temporarily holding the new coins of corresponding denomination (new coin holding units), and those for temporarily holding the old coins of mixed denominations (old coin holding units).

Figure 42:
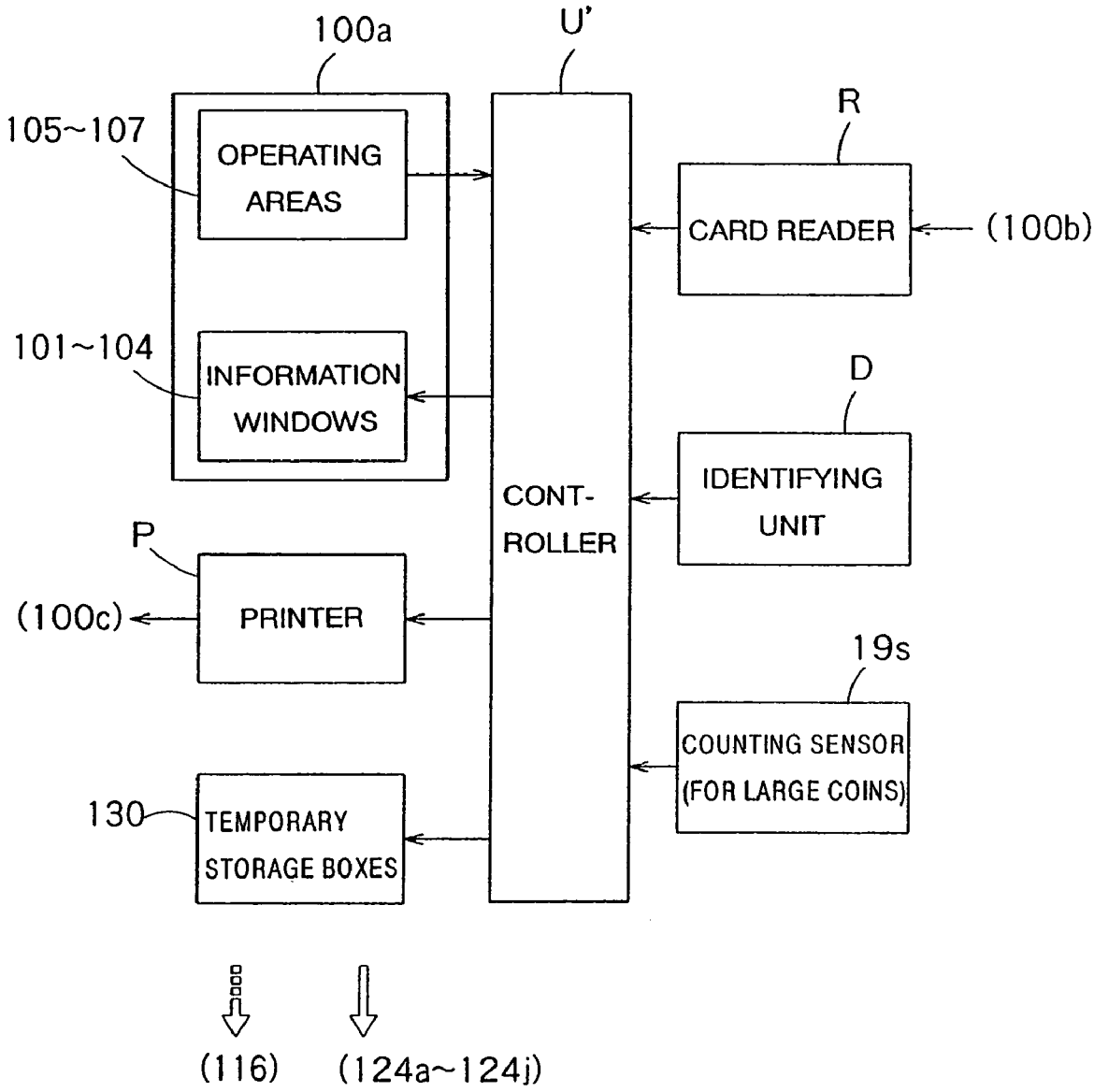
FIG. 42 is a block diagram of a controller included in the coin receiving system shown in FIG. 41.

The coin receiving system has a controller (counting means, arithmetic means and money receiving means) U' as shown in FIG. 42. Information windows (display means) 101 to 104 and operating areas 105 to 107 included in the display/control panel 100*a* are connected to the controller U'. A card reader R for reading information from a card inserted in the card slot 100*b*, and a printer (printing means) P for printing a receipt to be issued through the receipt slot 100*c* are connected to the controller U'. An identification unit (identifying and counting means) D, a large coin counting sensor (counting means) 19*s* (FIG. 6) and a driving circuit for driving the temporary storage boxes 130 are connected to the controller U'.

Sensors T disposed immediately in front of the sorting holes 5*a* to 5*d* and sorting holes 5*e* to 5*h* of the main sorting units B1 and B2 shown in FIG. 1 are connected to the controller U' shown in FIG. 42. The sensors T recognizes the passage of coins in addition to identification of coins by denomination and counting of coins by the identification unit D to enhance the reliability of the controller (counting means) U' in counting operation.

Figure 43:
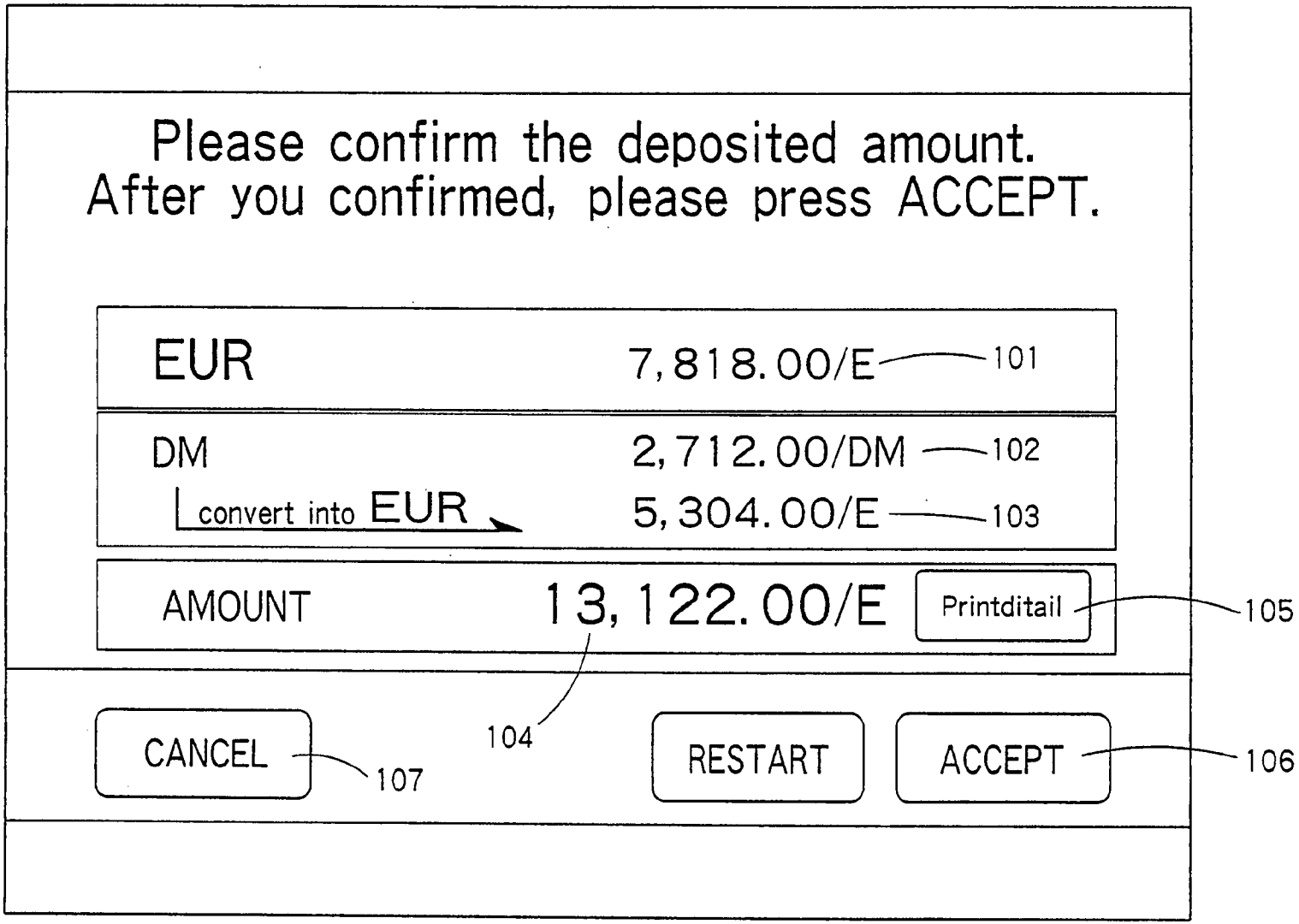
FIG. 43 is a view of an example of a picture displayed on a touch screen of a display included in the coin receiving system shown in FIG. 41.
Figure 45:
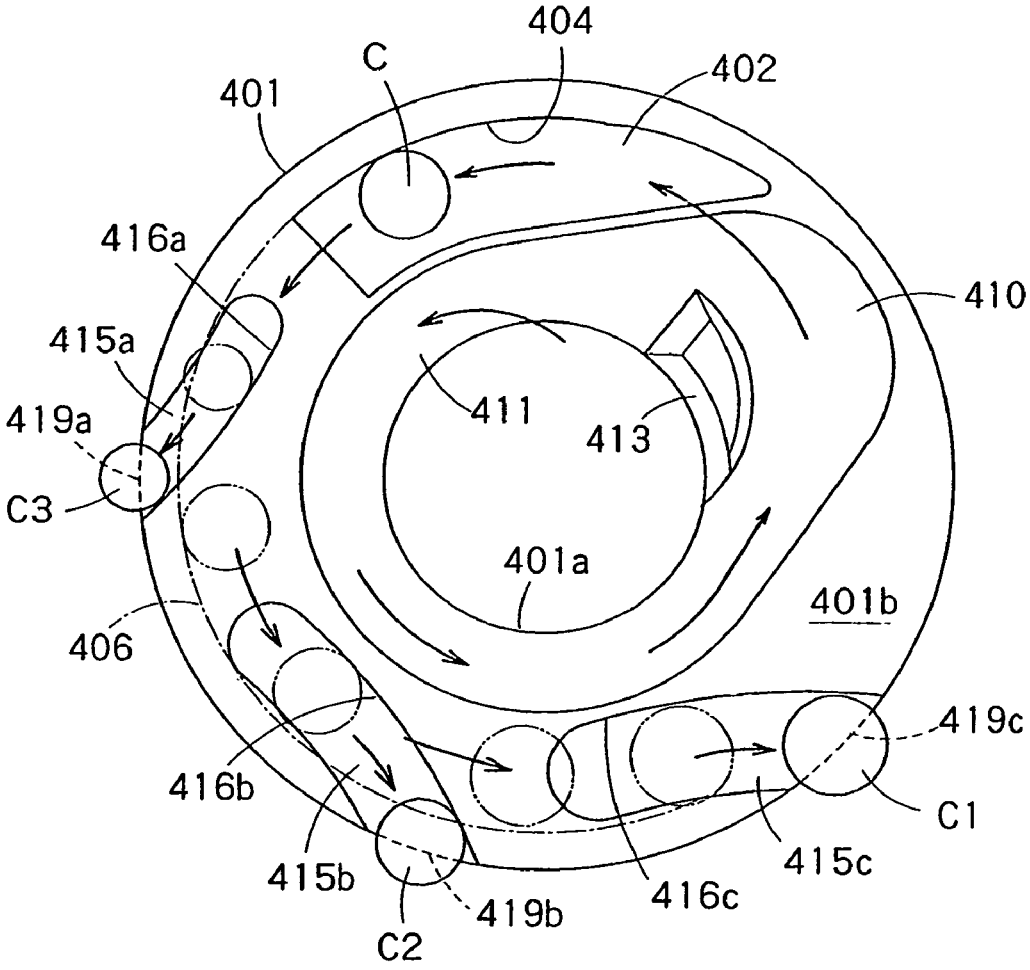
FIG. 45 is a bottom view of a stationary disk included in a conventional coin sorting apparatus.
Figure 46:
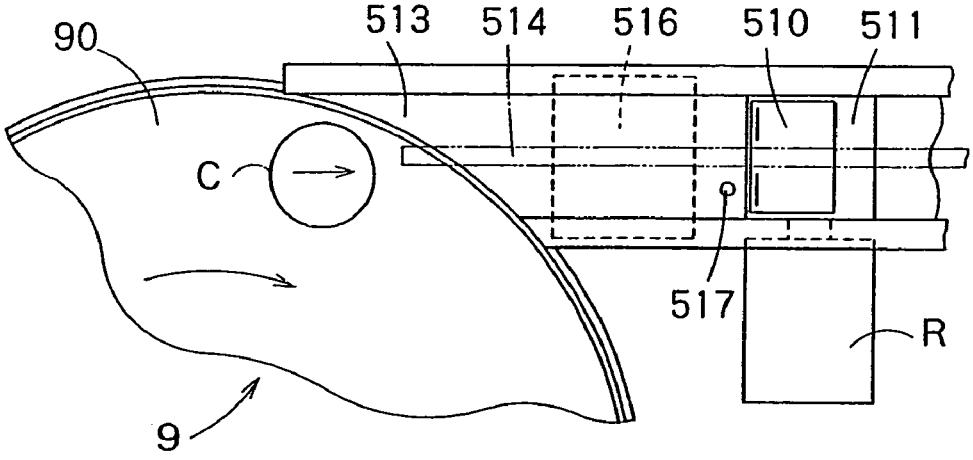
FIG. 46 is a partly omitted plan view of the conventional coin sorting apparatus.
Figure 47:
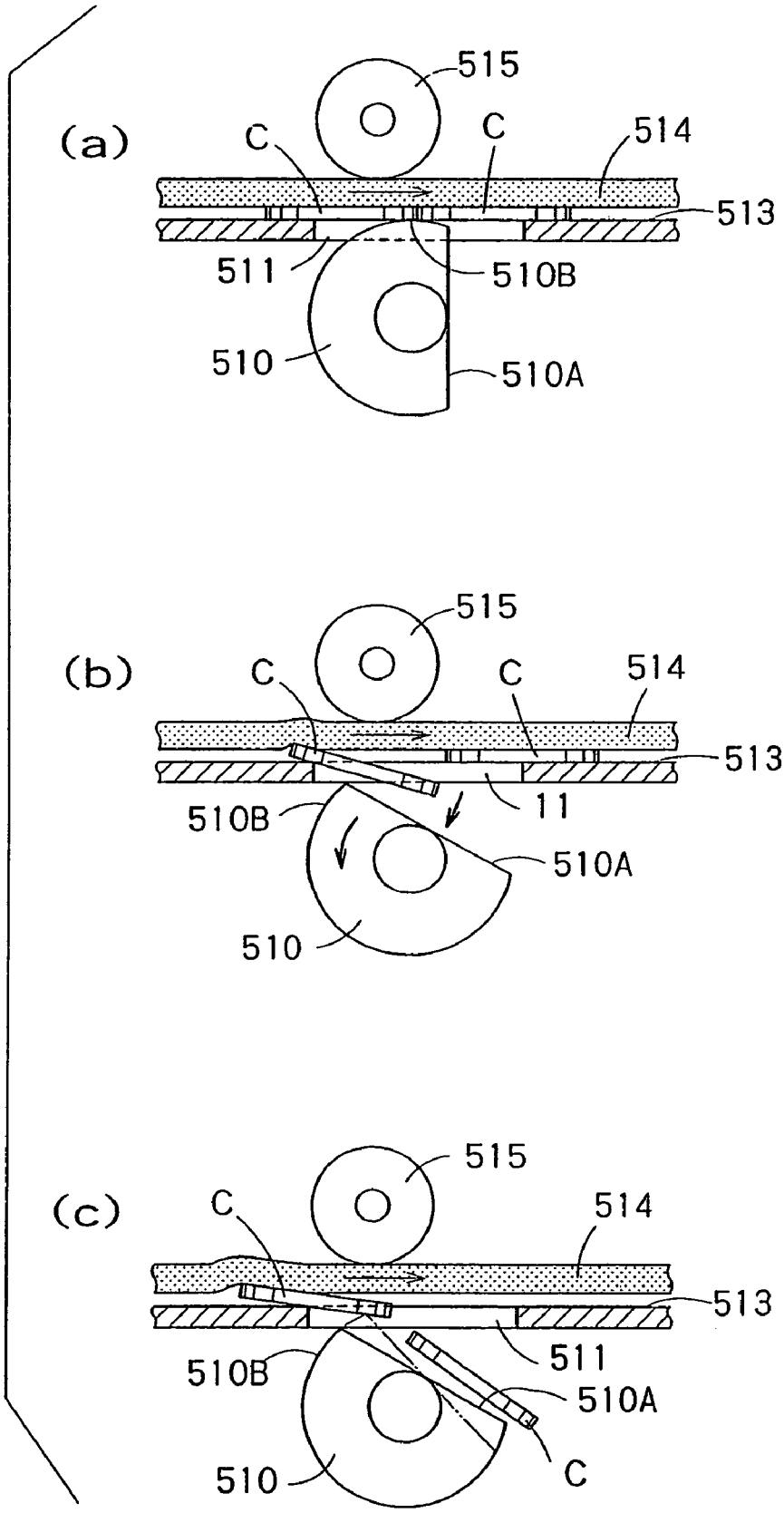
FIG. 47 shows longitudinal sectional views of essential parts of the coin sorting apparatus shown in FIG. 46 in (a) a state for passing a coin, (b) a state for ejecting a coin and (c) a transient state between the states (a) and (b), respectively.

FIG. 43 is a view of an example of a picture displayed on the touchscreen of the display/control panel 100*a* shown in FIG. 41, i.e., information displayed in information windows 101 to 104 and the operating areas 105 to 107. The picture shown in FIG. 43 includes a "total amount of money in the new currency unit" 101, a "total amount of money in the old currency unit" 102, a "converted amount of money in the new currency unit" 103 and a "sum total amount of money in the new currency unit" 104.

The operating areas 105 to 107 serve as a print button (printing-instruction means) 105, an acceptance button (accepting-instruction means) 106 and a cancellation button 107, respectively. The print button 105 is used for giving an accepting instruction to the controller U' (FIG. 42), and for giving a printing instruction for printing a receipt is given to the printer P (FIG. 42). The acceptance button 106 is used for giving the accepting instruction to the controller U' (FIG. 42).

The display/control panel 100*a* is capable of displaying other pictures including a ten-key (numeric keypad) picture for entering numeric characters representing an account number and such. An account number and such may be entered by reading information recorded in a card inserted in the card slot 100*b* (FIG. 41) by the card reader R (FIG. 42).

FIG. 44 shows an example of a receipt printed and issued by the printer P (FIG. 42). Printed on the receipt shown in FIG. 44 is data similar to those indicated in the information windows 101 to 104 and including the "total amount of money in the new currency unit" 101, the "total amount of money in the old currency unit" 102, the "converted amount of money in the new currency unit" 103 and the "sum total amount of money in the new currency unit" 104. The denomination I1, the number-of-coins I2 and the amount-of-money (value) I3 of received coins of each denomination of each currency unit are itemized in the receipt.

The controller U' shown in FIG. 42 has the following functions of counting means, arithmetic means and money receiving means.

The controller U' functions as a counting means and calculates the "total amount of money in the new currency unit" 101, and the "total amount of money in the old currency unit" 102 on the basis of identification of the coins by the identification unit D. As shown in FIG. 44, each of the total amounts of money to be displayed in the information windows 101 and 102 can be calculated by calculating the amount of money of each denomination by using (Amount (Value) I3 of money)=(Denomination I1)×(Number I2 of coins), and adding up the amounts I3 of money of coins of all the denominations.

The, the controller U' functions as an arithmetic means and converts the "total amount of money in the old currency unit" 102 into the "converted amount of money in the new currency unit" 103 by using a predetermined exchange rate, such as 1.95583 Euro/DM, and then calculates the "sum total amount of money in the new currency unit" 104 by adding up the "total amount of money in the new currency unit" 101 and the "converted amount of money in the new currency unit" 103.

Then, in response to the accepting instruction provided by the print button 105 or the acceptance button 106 (FIGS. 42 and 43), the controller U' functions as a money receiving means to transfer the new coins and the old coins temporarily stored in the temporary storage boxes 130 to the coin storing cassettes 124*a* to 124*j*, and to receive the "sum total amount of money in the new currency unit" 104.

[Operations and Functions]

The operations and functions of the coin receiving system in the third embodiment will be described hereinafter on an assumption that the coin receiving system deals with mixed coins including new coins of eight denominations, i.e., Euro coins, old coins and different coins.

Mixed coins are put in the hopper 112 shown in FIG. 41, then the presorting unit A and the main sorting units B1 and B2 of the coin sorting apparatuses, similarly to those of the coin sorting apparatus in the first embodiment, sort the coins (FIG. 1), and store the sorted coins in the temporary storage boxes 130 for temporary storage (FIG. 3).

The controller U' functions as the counting and the arithmetic means to calculate the "total amount of money in the new currency unit" 101, the "total amount of money in the old currency unit" 102, the "converted amount of money in the new currency unit" 103 and the "sum total amount of money in the new currency unit" 104 of the Euro coins (large, medium and small coins), i.e., the new coins, and the old coins temporarily stored in the temporary storage boxes 130, and displays those total amounts of money in the information windows 101 to 104 of the touchscreen of the display/control panel 100*a* (FIGS. 42 and 43).

In the picture shown in FIG. 43 by way of example, the "total amount of money in the new currency unit" 101 is 7,818.00 E (Euro), the "total amount of money in the old currency unit" 102 is 2,712.00 DM (Deutsche mark), the "converted amount of money in the new currency unit" 103 calculated by using the exchange rate of 1.95583 E/DM (Euro/Deutsche mark) is 5,304.00 E, and the "sum total amount of money in the new currency unit" 104 is 13,122.00 E (=7,818.00+5,304.00).

When the acceptance button 106 (FIGS. 42 and 43) is touched to provide the accepting instruction to receive the money according to the information displayed in the information windows 101 to 104, the controller (money receiving means) U' executes a money receiving operation for receiving the "sum total amount of money in the new currency unit" 104. On the other hand, when the print button 105 (FIGS. 42 and 43) is touched to provide the accepting instruction and the printing instruction, the controller U' executes the money receiving operation and the printer P prints the receipt printed with the information and issues the receipt through the receipt slot 100*c* (FIG. 41). The user pulls out the receipt.

The controller U' actuates the driving circuit for driving the temporary storage boxes 130 to transfer the new coins and old coins from the temporary storage boxes 130 to the corresponding coin cassettes 124*a* to 124*j* (FIGS. 3 and 4). Coins that need to be returned among those temporarily stored in the temporary storage boxes 130 due to disagreement between the confirmed amounts of money are returned from the temporary storage boxes 130 to the return box 116 (FIGS. 3 and 4), when the cancellation button 107 (FIGS. 42 and 43) is touched to give a return command to the controller U'.

[Effect]

As apparent from the foregoing description, the coin receiving system in the third embodiment is capable of dealing with the mixed coins including the Euro coins (new coins) of eight denominations which are sorted by the sorting holes 5*a* to 5*h* of the main sorting units B1 and B2 of the coin sorting apparatuses, the large coins C1, i.e., old coins to be sorted by the large-coin sorting guide 15*a* of the presorting unit A and the old coins to be sorted by the old coin sorting units 6*b*. Thus, the coin receiving system is capable of dealing with coins of both the new currency unit and the old currency unit, and of receiving money for the "sum total amount of money in the new currency unit" 104 represented by those coins of both currency units.

Since the total amount of money in the new currency unit, the total amount of money in the old currency unit, the converted amount of money in the new currency unit and the sum total amount of money in the new currency unit are displayed in the information windows 101 to 104, the final money receiving operation can be performed by giving the accepting instruction by operating the print button 105 or the acceptance button 106 after precisely recognizing those amounts of money. The final money receiving operation can be carried out and the results of the money receiving operation can be printed on a receipt by giving the accepting instruction and the printing instruction by operating the print button 105.

The coin receiving system in the third embodiment, similarly to the coin sorting apparatus in the first embodiment, sorts the new coins by denomination by the sorting holes 5*a* to 5*h* of the main sorting units B1 and B2, and sorts old coins regardless of denomination by the large-coin sorting guide 15*a* and the old coin sorting units 6*b*. The temporary storage boxes 130 for temporarily holding the new coins and the new coin storing cassettes 124*a* to 124*h* for storing the new coins are assigned to each denomination of the new coins, respectively. On the other hand, the temporary storage boxes 130 for temporarily holding the old coins and the old coin storing cassettes 124*i* and 124*j* for storing the old coins are adapted to temporary store and store the old coins of mixed denominations, respectively. Thus, new coins to be reused can be collected in individual denominations, and old coins not to be reused and to be disposed of are collected in mixed denominations to achieve efficient coin recovery.

[Modifications]

Information to be printed on the receipt is not limited to that shown in FIG. 44 and, for example, only the "total amount of money in the new currency unit" 101, the "total amount of money in the old currency unit" 102, the "converted amount of money in the new currency unit" 103 and the "sum total amount of money in the new currency unit" 104 of the touchscreen of the display/control panel 100*a* may be displayed.

What is claimed is:

1. A coin sorting apparatus comprising:

a stationary member provided with a central coin-feed opening; and a rotary disk supported for rotation, disposed under the stationary member closely adjacent to the lower surface of the stationary member, and having a disk body and a resilient member attached to an upper surface of the disk body;

the coin sorting apparatus being constructed such that coins fed into the coin-feed opening of the stationary member slide along the lower surface of the stationary member as the rotary disk rotates, wherein the stationary member is provided with guide structures for selectively guiding coins sliding along the lower surface thereof, according to their diameters, and the resilient member of the rotary disk has a urethane rubber layer having a surface provided with a plurality of radial grooves.

2. The coin sorting apparatus according to claim 1, wherein circumferential intervals between the radial grooves at the periphery of the resilient member are smaller than a diameter of the smallest coin.

3. The coin sorting apparatus according to claim 1, wherein the urethane rubber layer of the resilient member is formed of a thermoplastic urethane rubber.

4. The coin sorting apparatus according to claim 1, wherein the resilient member has a porous resilient layer underlying the urethane rubber layer.

5. The coin sorting apparatus according to claim 4, wherein the porous resilient layer is formed of rubber sponge.

6. The coin sorting apparatus according to claim 1, wherein a part of at least one of the radial grooves of the urethane rubber layer is configured to have a depth shallower than other parts of the same groove so as to serve as an indicator.

7. The coin sorting apparatus according to claim 1, wherein a metal plate, detachable from the disk body, is fixed to the lower surface of the resilient member.

8. The coin sorting apparatus according to claim 2, wherein the urethane rubber layer of the resilient member is formed of a thermoplastic urethane rubber.

9. The coin sorting apparatus according to claim 2, wherein the resilient member has a porous resilient layer underlying the urethane rubber layer.

10. The coin sorting apparatus according to claim 9, wherein the porous resilient layer is formed of rubber sponge.

11. The coin sorting apparatus according to claim 2, wherein a part of at least one of the radial grooves of the urethane rubber layer is configured to have a depth shallower than other parts of the same groove so as to serve as an indicator.

12. The coin sorting apparatus according to claim 2, wherein a metal plate, detachable from the disk body, is fixed to the lower surface of the resilient member.

13. A coin sorting apparatus comprising:

a stationary member having a central coin-feed opening; and a rotary disk operable to rotate and arranged under said stationary member so as to be adjacent to a lower surface of said stationary member, said stationary member and said rotary disk being arranged so that coins fed into said coin-feed opening of said stationary member slide along said lower surface of said stationary member as said rotary disk rotates, said stationary member having a guide structure for selectively guiding coins sliding along said lower surface thereof based on diameters of the coins, said guide structure comprising:

a coin passage in said lower surface of the stationary member, said coin passage having a radial inner edge for engaging outer edges of the coins; and at least one coin-sorting guide in said lower surface of the stationary member, each of said at least one coin-sorting guide having:

a step at a radial outer edge of said coin passage and arranged so that a peripheral part of a coin having a diameter greater than a reference diameter runs up onto said step while an outer edge opposite the peripheral part of the coin engages said radial inner edge of said coin passage; and an ejecting passage for guiding the coin run up onto said step away from said coin passage and for ejecting the coin outside of said stationary member.

14. The coin sorting apparatus according to claim 13, wherein said radial inner edge and said radial outer edge of said coin passage are configured to engage outer edges of coins moving along said coin passage, and said coin passage is shaped in a curved manner such that an upstream section of said coin passage at an upstream side of said step extends away from a center of said stationary member, and such that a downstream section of said coin passage at a downstream side of said step approaches said center of said stationary member.

15. The coin sorting apparatus according to claim 14, wherein said guide structure further comprises a pressing member for pressing the coins toward said radial inner edge of said coin passage, said pressing member being arranged at an upstream side of said step.

16. The coin sorting apparatus according to claim 14, wherein said guide structure of said stationary member is shaped and arranged so that the coin that has run up onto said step lies in a substantially horizontal position.

17. The coin sorting apparatus according to claim 14, wherein said guide structure of said stationary member includes a step-forming plate forming said step and is movable along a width of said coin passage for positional adjustment.

18. The coin sorting apparatus according to claim 14, wherein said guide structure further comprises a foreign matter sorting member in said downstream section of said coin passage for selectively guiding foreign matter having a thickness smaller than a thickness of a thinnest coin so that the foreign matter is ejected outside said stationary member.

19. The coin sorting apparatus according to claim 18, wherein said foreign matter sorting member has:

a foreign matter passage formed in said stationary member so as to branch away from said coin passage to an outside of said stationary member; and a gate portion at a junction of said coin passage and said foreign matter passage, said gate portion forming a gap with said rotary disk, said gap having a size to allow the foreign matter to pass but not the thinnest coin.

20. The coin sorting apparatus according to claim 13, wherein said guide structure further comprises a pressing member for pressing the coins toward said radial inner edge of said coin passage, said pressing member being arranged at an upstream side of said step.

21. The coin sorting apparatus according to claim 13, wherein said guide structure of said stationary member is shaped and arranged so that the coin that has run up onto said step lies in a substantially horizontal position.

22. The coin sorting apparatus according to claim 13, wherein said guide structure of said stationary member includes a step-forming plate forming said step and is movable along a width of said coin passage for positional adjustment.

23. The coin sorting apparatus according to claim 13, wherein said guide structure further comprises a foreign matter sorting member in said downstream section of said coin passage for selectively guiding foreign matter having a thickness smaller than a thickness of a thinnest coin so that the foreign matter is ejected outside said stationary member.

24. The coin sorting apparatus according to claim 23, wherein said foreign matter sorting member has:

a foreign matter passage formed in said stationary member so as to branch away from said coin passage to an outside of said stationary member; and a gate portion at a junction of said coin passage and said foreign matter passage, said gate portion forming a gap with said rotary disk, said gap having a size to allow the foreign matter to pass but not the thinnest coin.

25. The coin sorting apparatus according to claim 13, wherein said step has a ramp portion at an upstream side thereof so as to allow the peripheral potion of the coin to run up onto said step and into said ejecting passage downstream of said step.

* * * * *